US006527878B1

(12) United States Patent
Sugawara et al.

(10) Patent No.: US 6,527,878 B1
(45) Date of Patent: Mar. 4, 2003

(54) THIXOCAST CASTING MATERIAL, PROCESS FOR PREPARING THIXOCASTING SEMI-MOLTEN CASTING MATERIAL, THIXOCAST PROCESS, FE-BASED CAST PRODUCT, AND PROCESS FOR THERMALLY TREATING FE-BASED CAST PRODUCT

(75) Inventors: Takeshi Sugawara, Saitama (JP); Haruo Shiina, Saitama (JP); Masayuki Tsuchiya, Saitama (JP); Kazuo Kikawa, Saitama (JP); Isamu Takagi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/669,219

(22) Filed: Sep. 25, 2000

Related U.S. Application Data

(62) Division of application No. 09/077,169, filed as application No. PCT/JP97/03058 on Sep. 2, 1997, now Pat. No. 6,136, 101.

(30) Foreign Application Priority Data

| | | |
|---|---|---|
| Sep. 2, 1996 | (JP) | 8-250953 |
| Sep. 2, 1996 | (JP) | 8-250954 |
| Nov. 21, 1996 | (JP) | 8-325957 |
| Jan. 7, 1997 | (JP) | 9-011993 |
| Jan. 8, 1997 | (JP) | 9-220704 |
| Aug. 27, 1997 | (JP) | 9-246233 |

(51) Int. Cl.[7] ..... C21D 5/00

(52) U.S. Cl. ..... 148/321; 148/543; 148/612

(58) Field of Search ..... 148/543, 612, 148/312, 614, 616, 617, 618, 321

(56) References Cited

U.S. PATENT DOCUMENTS 5,858,127 A * 1/1999 Ott et al. ..... 148/321

FOREIGN PATENT DOCUMENTS

| | | |
|---|---|---|
| GB | 1 564 275 | 4/1980 |
| GB | 2294000 A | 4/1996 |
| JP | 5-43978 | 2/1993 |
| JP | 5-44010 | 2/1993 |

OTHER PUBLICATIONS

Callister, William, "Materials Science and Engineering: an Introduction", 3rd ed., (1994) pp 274, 275, 361.*
JP 081 112661 Patent Abstract in English.
Search Report.

* cited by examiner

*Primary Examiner*—George Wyszomierski
*Assistant Examiner*—Janelle Combs Morillo
(74) *Attorney, Agent, or Firm*—Lyon & Lyon LLP

(57) ABSTRACT

A thixocast casting material is formed of an Fe—C—Si based alloy in which an angle endothermic section due to the melting of a eutectic crystal exists in a latent heat distribution curve and has a eutectic crystal amount Ec in a range of 10% by weight<Ec<50% by weight. This composition comprises 1.8% by weight≦C≦2.5% by weight of carbon, 1.4% by weight≦Si≦3% by weight if silicon and a balance of Fe including inevitable impurities.

4 Claims, 49 Drawing Sheets

EXAMPLE 1 OF Fe-BASED CAST PRODUCT

25 μm

EXAMPLE 7(2,5)
EXAMPLE 10
100 % BY WEIGHT EUTECTIC LINE
EXAMPLE 5
$a_4$(2.42,3)
EXAMPLE 9
b1
EXAMPLE 8
$a_3$(2.5,2.6)
EXAMPLE 6
50 % BY WEIGHT EUTECTIC LINE
$a_2$(2.5,1.4)
40 % BY WEIGHT EUTECTIC LINE
30 % BY WEIGHT EUTECTIC LINE
EXAMPLE 4
b
EXAMPLE 3
b2
EXAMPLE 2
$a_1$(1.98,1.4)
EXAMPLE 1
20 % BY WEIGHT EUTECTIC LINE
$a_5$(1.8,3)
SOLID PHASE LINE
10 % BY WEIGHT EUTECTIC LINE
$a_6$(1.8,2.26)
CONTENT OF Si (% BY WEIGHT)
CONTENT OF C (% BY WEIGHT)
0
0.5
1
1.5
2
2.5
3
3.5
4
1
1.5
1.8
2
2.14
2.356
2.5
2.572
2.788
3
3.22
3.004
3.5
4
4.3
4.5

EXAMPLE 3 OF Fe-BASED CAST PRODUCT

25 μm

EXAMPLE 7 OF Fe-BASED CAST PRODUCT

25 μm

EXAMPLE 10 OF Fe-BASED CAST PRODUCT

25 μm

EXAMPLE 11 OF Fe-BASED CAST PRODUCT

BELOW EUTECTOID TEMPERATURE

JUST BELOW EUTECTIC TEMPERATURE

IN SEMI-MOLTEN STATE

BELOW EUTECTOID TEMPERATURE 0.1mm

JUST BELOW EUTECTIC TEMPERATURE 0.1mm

IN SEMI-MOLTEN STATE 0.1mm

JUST BELOW EUTECTIC TEMPERATURE

IN SEMI-MOLTEN STATE

JUST BELOW EUTECTIC TEMPERATURE 0.1mm

IN SEMI-MOLTEN STATE 0.1mm

EXAMPLE 1
POLISHED SURFACE 0.1mm

ETCHED 0.1mm

COMPARATIVE EXAMPLE 1
POLISHED SURFACE 0.1mm

ETCHED 0.1mm

EXAMPLE 2
POLISHED SURFACE 0.1mm

ETCHED 0.1mm

COMPARATIVE EXAMPLE 2
POLISHED SURFACE 0.1mm

ETCHED 0.1mm

EXAMPLE 3
POLISHED SURFACE 0.1mm

ETCHED 0.1mm

COMPARATIVE EXAMPLE 3
POLISHED SURFACE 0.1mm

ETCHED 0.1mm 0.1mm

Al-Si BASED CASTING MATERIAL 0.1mm

JUST BELOW EUTECTIC TEMPERATURE 0.1mm

IN SEMI-MOLTEN STATE 0.1mm

EXAMPLE 2 OF Fe-BASED CAST PRODUCT
(AS-CAST PRODUCT)

EXAMPLE 2 OF Fe-BASED CAST PRODUCT
(AS-CAST PRODUCT)

100 μm

EXAMPLE 2 OF Fe-BASED CAST PRODUCT
(THERMALLY-TREATED PRODUCT)

100 μm

EXAMPLE 24 OF Fe-BASED CAST PRODUCT
(AS-CAST PRODUCT)

EXAMPLE 1 OF Fe-BASED CAST PRODUCT

25 μm

THIXOCAST CASTING MATERIAL, PROCESS FOR PREPARING THIXOCASTING SEMI-MOLTEN CASTING MATERIAL, THIXOCAST PROCESS, FE-BASED CAST PRODUCT, AND PROCESS FOR THERMALLY TREATING FE-BASED CAST PRODUCT

This application is a divisional application of Ser. No. 09/077,169 filed Nov. 9, 1998, now U.S. Pat. No. 6,136,101, which is a 371 of PCT/JP97/03058 filed Sep. 2, 1997.

FIELD OF THE INVENTION

The present invention relates to a thixocast casting material, a process for preparing a thixocast semi-molten casting material, a thixocasting process, an Fe-based cast product, and a process for thermally treating an Fe-based cast product.

BACKGROUND ART

In carrying out a thixocasting process, a procedure is employed which comprises heating a casting material into a semi-molten state in which a solid phase (a substantially solid phase and this term will also be applied hereinafter) and a liquid phase coexist, filling the semi-molten casting material under a pressure into a cavity in a casting mold, and solidifying the semi-molten casting material under the pressure.

An Fe—C—Si based alloy having a eutectic crystal amount Ec set in a range of 50% by weight≦Ec≦70% by weight is conventionally known as such type of casting material (see Japanese Patent Application Laid-open No.5-43978). However, if the eutectic crystal amount Ec is set in a range of Ec≧50% by weight, an increased amount of graphite is precipitated in such alloy and hence, the mechanical properties of a cast product is substantially equivalent to those of a cast product made by a usual casting process, namely, by a melt producing process. Therefore, there is a problem that if the conventional material is used, an intrinsic purpose to enhance the mechanical properties of the cast product made by the thixocasting process cannot be achieved.

If a thixocast casting material made by utilizing a common continuous-casting process can be used, it is economically advantageous. However, a large amount of dendrite exists in the casting material made by the continuous-casting process. The dendrite phases cause a problem that the pressure of filling of the semi-molten casting material into the cavity is raised to impede the complete filling of the semi-molten casting material into the cavity. Thus, it is impossible to use such casting material in the thixocasting. Therefore, a relatively expensive casting material made by a stirred continuous-casting process is conventionally used as the casting material. However, a small amount of dendrite phases exist even in the casting material made by the stirred continuous-casting process and hence, a measure for removing the dendrite phases is essential.

In carrying out the thixocasting process, a semi-molten casting material prepared in a heating device must be transported to a pressure casting apparatus and placed in an injection sleeve of the pressure casting apparatus. To carry out the transportation of a semi-molten casting material, for example, a semi-molten Fe-based casting material, a measure is conventionally employed for forming an oxide coating layer on a surface of the material prior to the semi-melting of the Fe-based casting material, so that the oxide coating layer functions as a transporting container for the main portion of the semi-molten material (see Japanese Patent Application Laid-open No.5-44010). However, the conventional process suffers from a problem that the Fe-based casting material must be heated for a predetermined time at a high temperature in order to form the oxide coating layer and hence, a large amount of heat energy is required, resulting in a poor economy. Another problem is that even if a disadvantage may not be produced, when the oxide coating layer is pulverized during passing through a gate of the mold to remain as fine particles in the Fe-based cast product, and if the oxide coating layer is sufficiently not pulverized to remain as coalesced particles in the Fe-based casting material, the mechanical properties of the Fe-based cast product are impeded, for example, the Fe-based cast product is broken starting from the coalesced particles.

The present inventors have previously developed a technique in which the mechanical strength of an Fe-based cast product can be enhanced to the same level as of a carbon steel for a mechanical structure by finely spheroidizing carbide existing in the Fe-based cast product of an Fe—C—Si based alloy after the casting, i.e., mainly cementite, by a thermal treatment. Not only the finely spheroidized cementite phases but also graphite phases exist in the metal texture of the Fe-based cast product after the thermal treatment. The graphite phases include ones that exist before the thermal treatment, i.e., ones originally possessed by the Fe-based cast product after the casting, and ones made due to C (carbon) produced by the decomposition of a portion of the cementite phases during the thermal treatment of the Fe-based cast product. If the amount of the graphite phases exceeds a given amount, there arises a problem that the enhancement of the mechanical strength of the Fe-based cast product after the thermal treatment is hindered.

There is a conventionally known Fe-based cast product having a free-cutting property and made of a flake-formed graphite cast iron. However, the flake-formed graphite cast iron has a difficulty in that the mechanical property thereof is low, as compared with a steel. Therefore, measures for spheroidizing the graphite and increasing the hardness of a matrix have been employed to provide a mechanical strength equivalent to that of the steel. However, if such a measure is employed, there arises a problem that the cutting property of the Fe-based cast product is largely impeded. This is because the graphite phases precipitated in crystal grains is coagulated into a crystal grain boundary due to the spheroidizing treatment and hence, the graphite does not exist in the crystal grains, or even if the graphite exists, the amount thereof is extremely small, and as a result, the cutting property of a matrix surrounding the crystal grains is good, while the cutting property of the crystal grains is poor, whereby a large difference is produced in cutting property between the matrix and the crystal grains.

DISCLOSURE OF THE INVENTION

It is an object of the present invention to provide a thixocast casting material of the above-described type, from which a cast product having mechanical properties enhanced as compared with a cast product made by a melt casting process can be produced by setting the eutectic crystal amount at a level lower than that of a conventional material.

To achieve the above object, according to the present invention, there is provided a thixocast casting material which is formed of an Fe—C—Si based alloy in which an angled endothermic section due to the melting of a eutectic crystal exists in a latent heat distribution curve, and a eutectic crystal amount Ec is in a range of 10% by weight≦Ec≦50% by weight.

A semi-molten casting material having liquid and solid phases coexisting therein is prepared by subjecting the casting material to a heating treatment. In the semi-molten casting material, the liquid phase produced by the melting of a eutectic crystal has a large latent heat. As a result, in the course of solidification of the semi-molten casting material, the liquid phase is sufficiently supplied around the solid phase in response to the solidification and shrinkage of the solid phase and is then solidified. Therefore, the generation of air voids of micron order in the cast product is prevented. In addition, the amount of graphite phases precipitated can be reduced by setting the eutectic crystal amount Ec in the above-described range. Thus, it is possible to enhance the mechanical properties of the cast product, i.e., the tensile strength, the Young's modulus, the fatigue strength and the like.

In the casting material in which the eutectic crystal amount is in the above-described range, the casting temperature (temperature of the semi-molten casting material and this term will also be applied hereinafter) for the casting material can be lowered, thereby providing the prolongation of the life of a casting mold.

However, if the eutectic crystal amount Ec is in a range of Ec≦10% by weight, the casting temperature for the casting material approximates a liquid phase line temperature due to the small eutectic crystal amount Ec and hence, a heat load on a device for transporting the material to the pressure casting apparatus is increased. Thus, the thixocasting cannot be performed. On the other hand, a disadvantage arisen when Ec≧50% by weight is as described above.

The present inventors have made various studies and researches for the spheroidizing treatment of dendrite phases in a casting material produced by a common continuous-casting process and as a result, have cleared up that in a casting material in which a difference between maximum and minimum solid-solution amounts of an alloy component solubilized to a base metal component is equal to or larger than a predetermined value, the heating rate Rh of the casting material between a temperature providing the minimum solid-solution amount and a temperature providing the maximum solid-solution amount is a recursion relationship to a mean secondary dendrite arm spacing D, in the spheroidization of the dendrite phase comprised of the base metal component as a main component.

The present invention has been accomplished based on the result of the clearing-up, and it is an object of the present invention to provide a preparing process of the above-described type, wherein at a stage of heating a casting material into a semi-molten state, the dendrite phase is transformed into a spherical solid phase having a good castability, whereby the casting material used in the common continuous-casting process can be used as a thixocast casting material.

To achieve the above object, according to the present invention, there is provided a process for preparing a thixocast semi-molten casting material, comprising the steps of selecting a casting material in which a difference g-h between maximum and minimum solid-solution amounts g and h of an alloy component solubilized to a base metal component is in a range of g-h≧3.6 atom %, said casting material having dendrite phases comprised of the base metal component as a main component; and heating the casting material into a semi-molten state with solid and liquid phases coexisting therein, wherein a heating rate Rh (°C./min) of the casting material between a temperature providing the minimum solid-solution amount b and a temperature providing the maximum solid-solution amount a is set in a range of $Rh \geqq 63-0.8D+0.013D^2$, when a mean secondary dendrite arm spacing of the dendrite phases is D (μm).

The alloys with the difference g-h in the range of g-h≧3.6 atom % include an Fe—C based alloy, an Al—Mg alloy, an Mg—Al alloy and the like. If the casting material formed of such an alloy is heated at the heating rate Rh between both these temperatures, the diffusion of the alloy component produced between both the temperatures to each of the dendrite phases is suppressed due to the high heating rate, whereby a plurality of spherical high-melting phases having a lower density of the alloy component and a low-melting phase surrounding the spherical high-melting phases and having a higher density of the alloy component appear in each of the dendrite phases.

If the temperature of the casting material exceeds the temperature providing the maximum solid solution amount, the low-melting phase is molten to produce a liquid phase, and the spherical high-melting phases are left as they are, and transformed into spherical solid phases.

However, if g-h<3.6 atom %, or if $Rh<63-0.8D+0.013D^2$, the above-described spheroidizing treatment cannot be performed, whereby the dendrite phases remain. In a temperature range lower than the temperature providing the minimum solid-solution amount, the spheroidization of the dendrite phases does not occur.

It is an object of the present invention to provide a preparing process of the above-described type, wherein a semi-molten casting material, particularly, a semi-molten Fe-based casting material can be prepared within a transporting container by utilizing an induction heating, and the Fe-based casting material can be heated and semi-molten with a good efficiency by specifying a container forming material and the frequency of the induction heating, and the temperature retaining property of the semi-molten Fe-based casting material can be enhanced.

To achieve the above object, according to the present invention, there is provided a process for preparing a thixocast semi-molten casting material, comprising the steps of selecting an Fe-based casting material as thixocast casting material, placing the Fe-based casting material into a transporting container made of a non-magnetic metal material, rising the temperature of the Fe-based casting material from the normal temperature to Curie point by carrying out a primary induction heating with a frequency $f_1$ set in a range of $f_1<0.85$ kHz, and then rising the temperature of the Fe-based casting material from the Curie point to a preparing temperature providing a semi-molten state of the Fe-based casting material with solid and liquid phases coexisting therein by carrying out a secondary induction heating with a frequency $f_2$ set in a range of $f_2 \geqq 0.85$ kHz.

The semi-molten Fe-based casting material is prepared within the container and hence, can be easily and reliably transported as placed in the container. The container can be repeatedly used, leading to a good economy.

The Fe-based casting material is a ferromagnetic material at normal temperature and in a temperature range lower than the Curie point, while the container is made of a non-magnetic material. Therefore, in the primary induction heating, the temperature of the Fe-based casting material can be quickly and uniformly risen preferentially to the container by setting the frequency $F_1$ at a relatively low value as described above.

When the temperature of the Fe-based casting material is risen to the Curie point, it is magnetically transformed from the ferromagnetic material to a paramagnetic material. Therefore, in the temperature range higher than Curie point, the temperatures of the Fe-based casting material and the container can be both risen by conducting the secondary induction heating with the frequency $f_2$ set at a relatively high value as described above. In this case, the rising of the temperature of the container has a preference to the rising of the temperature of the Fe-based casting material. Therefore, the container can be sufficiently heated to have a temperature retaining function, and the overheating of the Fe-based casting material can be prevented, thereby preparing a semi-molten Fe-based casting material having a temperature higher than a predetermined preparing temperature, namely, a casting temperature which is a temperature at the start of the casting.

In the subsequent course of transportation of the semi-molten Fe-based casting material, the temperature of the material can be retained equal to or higher than the casting temperature by the heated container.

When the temperature $T_1$ of the Fe-based casting material reaches a point in a range of $T_2-100°$ C.$\leqq T_1 \leqq T_2-50°$ C. in the relationship to the preparing temperature $T_2$ in the course of rising of the temperature by the secondary induction heating, the heating system is switched over to a tertiary induction heating with a frequency $f_3$ set in a range of $f_3<f_2$, to cause the preferential rising of the temperature of the Fe-based casting material. Thus, the drop of the temperature of the semi-molten Fe-based casting material during transportation thereof can be further inhibited.

If the frequency $f_1$ in the primary induction heating is equal to or higher than 0.85 kHz, the rising of the temperature of the Fe-based casting material is slowed down. If the frequency $f_2$ in the secondary induction heating is lower than 0.85 kHz, the rising of the temperature of the Fe-based casting material is likewise slowed down.

It is an object-of the present invention to provide an Fe-based cast product of the above-described type, wherein the amount of graphite phases produced by the thermal treatment is substantially constant and hence, the amount of graphite phases produced by a casting can be suppressed to a predetermined value, thereby realizing the enhancement in mechanical strength by the thermal treatment.

To achieve the above object, according to the present invention, there is provided an Fe-based cast product, which is produced using an Fe—C—Si based alloy which is a casting material by utilizing a thixocasting process, followed by a finely spheroidizing thermal treatment of carbide, wherein an area rate $A_1$ of graphite phases existing in a metal texture of said cast product is set in a range of $A_1<5\%$.

With the above configuration of the Fe-based cast product, in the area rate $A_1$ of the graphite phases lower than 5% after the casting, the area rate $A_2$ of the graphite phases after the thermal treatment can be suppressed to a value in a range of $A_2<8\%$, thereby enhancing the mechanical strength, particularly, the Young's modulus, of the Fe-based cast product to a level higher than that of, for example, a spherical graphite cast iron.

In the area rate $A_1$ of the graphite phases after the casting equal to 0.3%, the area rate $A_2$ of the graphite phases after the thermal treatment can be suppressed to a value equal to 1.4%, thereby enhancing the Young's modulus of the Fe-based cast product to the same level as that of a carbon steel for a mechanical structure.

However, if the area rate Al of the graphite phases after the casting is equal to or larger than 5%, the mechanical strength of the Fe-based cast product after the thermal treatment is substantially equal to or lower than that of the spherical graphite cast iron.

It is an object of the present invention to provide a thixocasting process of the above-described type, which is capable of mass-producing an Fe-based cast product of the above-described configuration.

To achieve the above object, according to the present invention, there is provided a thixocasting process comprising a first step of filling a semi-molten casting material of an Fe—C—Si based alloy having a eutectic crystal amount Ec lower than 50% by weight into a casting mold, a second step of solidifying the casting material to provide an Fe-based cast product, a third step of cooling the Fe-based cast product, the mean solidifying rate Rs of the casting material at the second step being set in a range of Rs$\geqq$500° C./min, and the mean cooling rate Rc for cooling to a temperature range on completion of the eutectoid transformation of the Fe-based cast product at the third step being set in a range of Rc$\geqq$900° C./min.

The eutectic crystal amount Ec is related to the area rate of the graphite phases. Therefore, if the eutectic crystal amount Ec is set at a value lower than 50% by weight and the mean solidifying rate Rs is set at a value equal to or higher than 500° C./min, the amount of the graphite phases crystallized in the Fe-based cast product can be suppressed to a value in a range of $A_1<5\%$ in terms of the area rate $A_1$. If the mean cooling rate Rc is set in the range of Rc$\geqq$900° C./min, the precipitation of the graphite phases in the Fe-based cast product can be obstructed, and the area rate $A_1$ of the graphite phases can be maintained in the range of $A_1<5\%$ during the solidification.

However, if the eutectic crystal amount Ec is in a range of Ec$\geqq$50% by weight, the area rate $A_1$ of the graphite phases assumes a value in a range of $A_1\geqq5\%$, even if the mean solidifying rate Rs and the mean cooling rate Rc are set in the range of Rs$\geqq$500° C./min and in the range of Rc$\geqq$900° C./min, respectively. If the mean solidifying rate Rs is in a range of Rs<500° C./min, the area rate $A_1$ of the graphite phases assumes a value in the range of $A_1\geqq5\%$, even if the eutectic crystal. amount Ec is set in the range of Ec<50% by weight. Further, if the mean cooling rate Rc is in a range of Rc<900° C./min, the area rate $A_1$ of the graphite phases lower than 5% cannot be maintained.

It is an object of the present invention to provide an Fe-based cast product having the free-cutting property of which cutting property is enhanced by dispersing a certain amount of graphite phases even in a group of fine a-grains of a massive shape corresponding to crystal grains, namely, in a massive area formed by coagulation of the fine a-grains.

To achieve the above object, according to the present invention, there is provided an Fe-based cast product which is produced by thermally treating an Fe-based cast product made by utilizing a thixocasting process using an Fe-based casting material as a casting material, the Fe-based cast product including a matrix and a large number of massive groups of fine $\alpha$-grains dispersed in the matrix, the Fe-based cast product having a thermally-treated texture where a large number of graphite phases are dispersed in the matrix and in each of the groups of fine $\alpha$-grains, and the Fe-based cast product having a free-cutting property such that a ratio of B/A of an area rate B of the graphite phases in all the groups of fine $\alpha$-grains to an area rate A of the graphite phases in the entire thermally-treated texture is in a range of B/A$\geqq$0.138.

The massive groups of fine $\alpha$-grains are formed by the transformation of initial crystal $\gamma$-grains at a eutectoid temperature Te, and the graphite phases in the groups of fine α-grains are precipitated from the initial crystal γ-grains. Further, the groups of fine α-grains includes cementite phases. If the amount of graphite phases in all such massive groups of fine α-grains is specified as described above, the cutting property of the groups of fine α-grains can be enhanced, and the difference in cutting property between the groups of fine α-grains and the matrix can be moderated. However, if B/A<0.138, the cutting property of the Fe-based cast product is deteriorated.

Here, the area of the matrix is represented by V. If areas of the individual groups of fine α-grains are represented by $W_1$, $W_2$, $W_3$ - - - $w_n$, respectively, a sum total W of the areas of all the groups of fine α-grains is represented by $W=w_1+w_2+W3$ - - -$+w_n$. Further, areas of the individual graphite phases in the matrix are represented by $x_1$, $x_2$, x3 - - - $x_n$, respectively, a sum total of the areas of all the graphite phases in the matrix is represented by $X=x_1+x_2+x_3$ - - -$+x_n$. Yet further, if areas of all the graphite phases in the individual groups of fine α-grains are represented by $y_1$, $y_2$, $y_3$ - - - $y_n$n, respectively, a sum total Y of the areas of the graphite phases in all the groups of fine α-grains is represented by $Y=y_1+y_2+y_3$ - - -$+y_n$.

Therefore, the area rate A of the graphite phases in the entire thermally-treated texture is represented by $A=\{(X+Y)/(V+W)\}\times 100$ (%). The area rate B of the graphite phases in all the groups of fine α-grains is represented by $B=(Y/W)\times 100$ (%).

It is another object of the present invention to provide a thermally treating process of the above-described type, which is capable of easily mass-producing an Fe-based cast product similar to that described above.

To achieve the above object, according to the present invention, there is provided a process for thermally treating an Fe-based cast product, comprising the step of subjecting an Fe-based as-cast product made by a thixocasting process to a thermal treatment under conditions where, when a eutectoid temperature of the as-cast product is Te, the thermal treating temperature T is set in a range of $Te \leqq T \leqq Te+170°$ C., and the thermally treating time t is set in a range of 20 minutes$\leqq t \leqq$90 minutes, thereby providing a thermally-treated product with a free-cutting property.

Since the Fe-based as-cast product is produced by the thixocasting process, it has a solidified texture resulting from quenching by a mold. If such as-cast product is subjected to a thermal treatment under the above-described conditions, an Fe-based cast product having a free-cutting property of the above-described configuration can be produced.

At least one of a meshed cementite phase and a branch-shaped cementite phase is liable to be precipitated in the solidified texture. This causes deterioration of the mechanical properties of the Fe-based cast product, particularly, the toughness. Thereupon, it is a conventional practice to completely decompose and graphitize the meshed cementite phase and the like by subjecting such Fe-based as-cast product to the thermal treatment. However, if the complete graphitization of the meshed cementite phase and the like is performed, the following problem is encountered: the Young's modulus of the Fe-based cast product is reduced, and because the thermally treating temperature is high, it is impossible to meet the demand for energy-saving.

If the Fe-based as-cast product is subjected to the thermal treatment under the above-described conditions, the meshed cementite phases and the like can be finely divided. The Fe-based cast product having the thermally-treated texture and resulting from the fine division of the meshed cementite phases and the like has a Young's modulus and fatigue strength which are substantially equivalent to those of a carbon steel for a mechanical structure.

However, if the thermally treating temperature T is lower than Te, the thermally-treated texture cannot be produced, and the meshed cementite phase and the like cannot be finely divided. On the other hand, if T>Te+170° C., the coagulation of the graphite phases out of the groups of fine α-grains into the boundary is liable to be produced, and the graphitization of the meshed cementite phases and the like advances. If the thermally treating time t is shorter than 20 minutes, a metal texture as described above cannot be produced. On the other hand, if t>90 minutes, the coagulation and the graphitization advance.

BEST MODE FOR CARRYING OUT THE INVENTION

Figure 1:
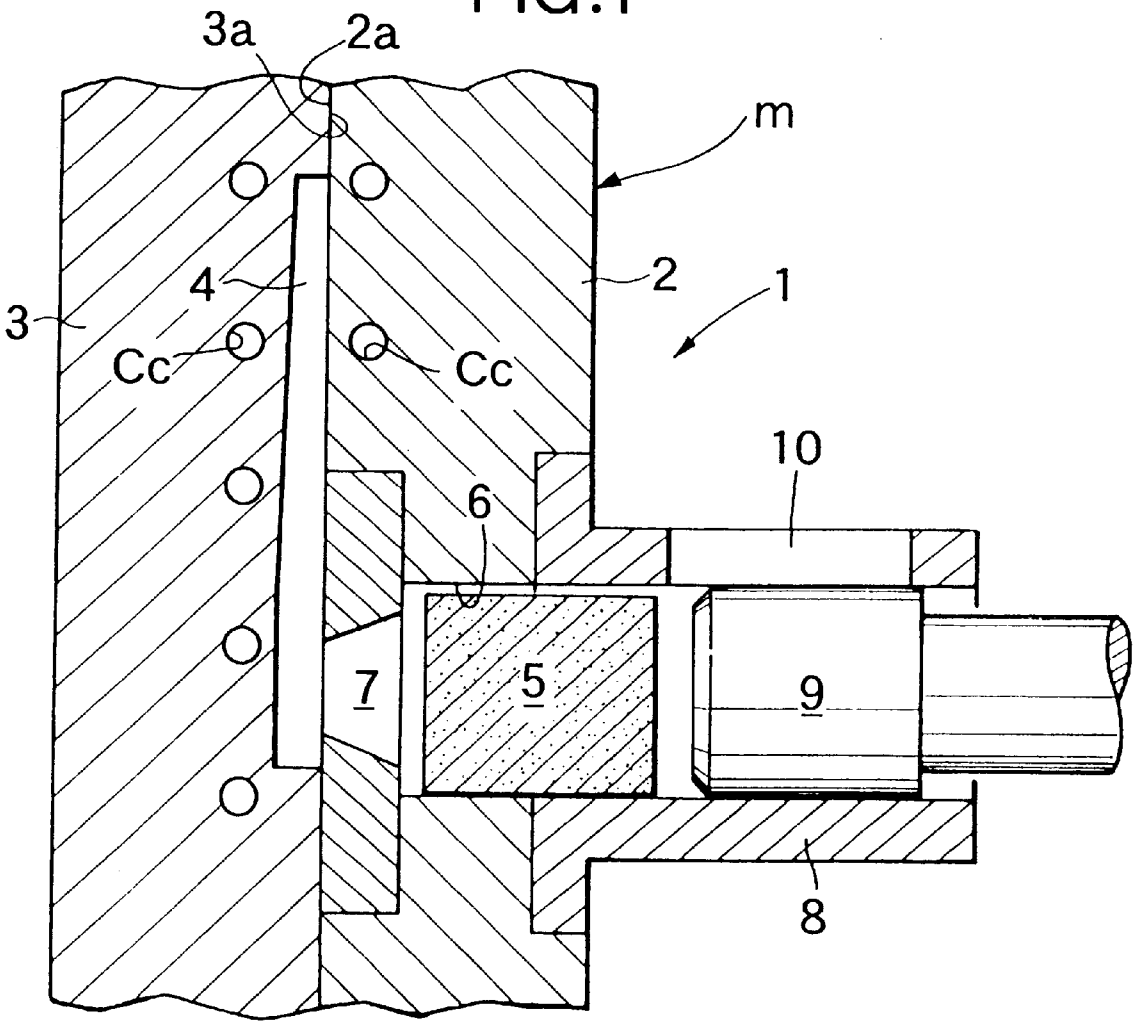
FIG. 1 is a sectional view of a pressure casting apparatus.

A pressure casting apparatus 1 shown in FIG. 1 is used for producing a cast product by utilizing a thixocasting process using a casting material. The pressure casting apparatus 1 includes a casting mold m which is comprised of a stationary die 2 and a movable die 3 having vertical mating faces 2*a* and 3*a*, respectively. A cast product forming cavity 4 is defined between both the mating faces 2*a* and 3*a*. A chamber 6 is defined in the stationary die 2, so that a short cylindrical semi-molten casting material 5 is laterally placed in the chamber 6. The chamber 6 communicates with the cavity 4 through a gate 7. A sleeve 8 is horizontally mounted to the stationary die 2 to communicate with the chamber 6, and a pressing plunger 9 is slidably received in the sleeve 8 and adapted to be inserted into and removed out of the chamber 6. The sleeve 8 has a material inserting port 10 in an upper portion of a peripheral wall thereof. Cooling liquid passages Cc are provided in each of the stationary and movable dies 2 and 3 in proximity to the cavity 4.

EXAMPLE I

Figure 2:
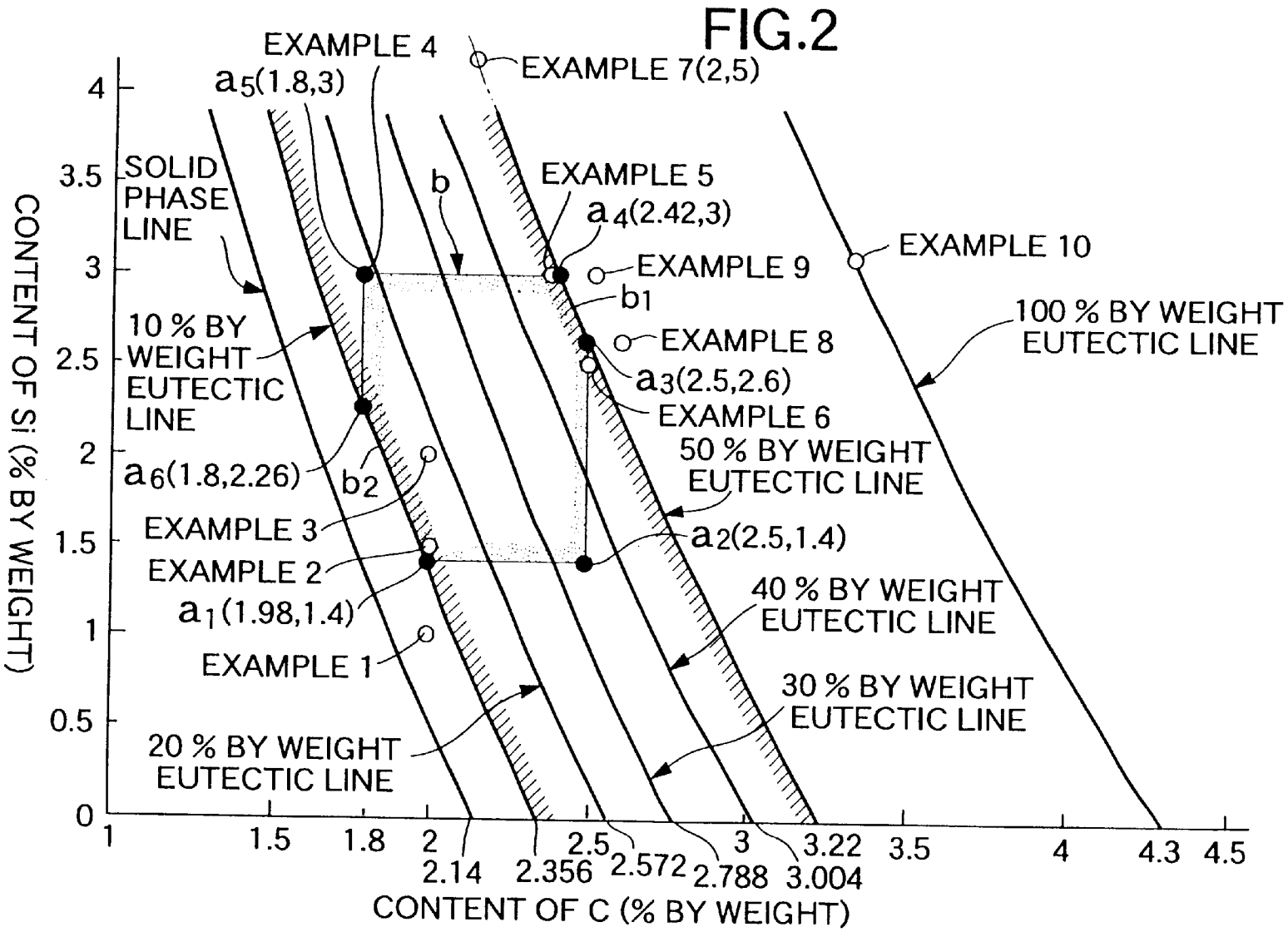
FIG. 2 is a graph illustrating the relationship between the contents of C and Si and the eutectic crystal amount Ec.

FIG. 2 shows the relationship between the contents of C and Si and the eutectic crystal amount Ec in an Fe—C—Si based alloy as a thixocast casting material.

In FIG. 2, a 10% by weight eutectic line with a eutectic crystal amount Ec equal to 10% by weight exists adjacent a high C-density side of a solid phase line, and a 50% by weight eutectic line with a eutectic crystal amount Ec equal to 50% by weight exists adjacent a low C-density side of a 100% by weight eutectic line with a eutectic crystal amount Ec equal to 100% by weight. Three lines between the 10% by weight eutectic line and the 50% by weight eutectic line are 20, 30 and 40% by weight eutectic lines from the side of the 10% by weight eutectic line, respectively.

A composition range for the Fe—C—Si based alloy is a range in which the eutectic crystal amount Ec is in a range of 10% by weight<Ec<50% by weight, and thus, is a range between the 10% by weight eutectic line and the 50% by weight eutectic line. However, compositions on the 10% by weight eutectic line and the 50% by weight eutectic line are excluded.

In the Fe—C—Si based alloy, if the content of C is lower than 1.8% by weight, the casting temperature must be increased even if the content of Si is increased and the eutectic crystal amount is increased. Thus, the advantage of the thixocasting is reduced. On the other hand, if C>2.5% by weight, the amount of graphite is increased and hence, the effect of thermally treating an Fe-based cast product tends to be reduced. If the content of Si is lower than 1.4% by weight, the rising of the casting temperature is caused as when the C<1.8% by weight. On the other hand, if Si>3% by weight, silicon ferrite is produced and hence, the mechanical properties of an Fe-based cast product tend to be reduced.

If these respects are taken into consideration, a preferred composition range for the Fe—C—Si based alloy is within an area of a substantially hexagonal figure provided by connecting a coordinate point $a_1$, (1.98, 1.4), a coordinate point $a_2$ (2.5, 1.4), a coordinate point $a_3$ (2.5, 2.6), a coordinate point $a_4$ (2.42, 3), a coordinate point $a_5$ (1.8, 3) and a coordinate point $a_6$ (1.8, 2.26), when the content of C is taken on an x axis and the content of Si is taken on y axis in FIG. 2. However, compositions at the points $a_3$ and $a_4$ existing on the 50% by weight eutectic line and on a line segment $b_1$ connecting the points $a_3$ and $a_4$ and at the points $a_1$, and $a_6$ existing on the 10% by weight eutectic line and on a line segment $b_2$ connecting the points $a_1$, and $a_6$ are excluded from the compositions on that profile b of such figure which indicates a limit of the composition range.

It is desirable that the solid rate R of a semi-molten Fe—C—Si based alloy is in a range of R>50%. Thus, the casting temperature can be shifted to a lower temperature range to prolong the life of the pressure casting apparatus. If the solid rate R is in a range of R≦50%, the liquid phase amount is increased and hence, when the short columnar semi-molten Fe—C—Si based alloy is transported in a longitudinal attitude, the self-supporting property of the alloy is degraded, and the handlability of the alloy is also degraded.

Table 1 shows the composition (the balance Fe includes P and S as inevitable impurities), the eutectic temperature, the eutectic crystal amount Ec and the castable temperature for examples 1 to 10 of Fe—C—Si based alloys.

placed in the pallet was induction-heated to 1220° C. which was a casting temperature to prepare a semi-molten alloy with solid and liquid phases coexisting therein. The solid phase rate R of the semi-molten alloy was equal to 70%.

Then, the temperature of the stationary and movable dies 2 and 3 in the pressure casting apparatus 1 in FIG. 1 was controlled, and the semi-molten alloy 5 was removed from the pallet and placed into the chamber 6. Thereafter, the pressing plunger 9 was operated to fill the alloy 5 into the cavity 4. In this case, the filling pressure for the semi-molten alloy 5 was 36 MPa. A pressing force was applied to the semi-molten alloy 5 filled in the cavity 4 by retaining the pressing plunger 9 at the terminal end of a stroke, and the semi-molten alloy 5 was solidified under the application of the pressing force to provide an example 3 of an Fe-based cast product.

In the case of the example 1 of the Fe—C—Si based alloy, as apparent from Table 1, the thixocasting could not be performed, because a partial melting of the heating/transporting pallet occurred for the reason that the casting temperature became 1400° C. or more approximating the liquid phase line temperature due to the fact that the eutectic crystal amount Ec was equal to or lower than 10% by weight. Thereupon, examples 2 and 4 to 10 of Fe-based cast products were produced in the same manner as described above, except that the examples 2 and 4 to 10 excluding the example 1 were used, and the casting temperature was varied as required.

Then, the examples 2 to 10 of the Fe-based cast products were subjected to a thermal treatment under conditions of the atmospheric pressure, 800° C., 20 minutes and an air-cooling.

Figure 5:
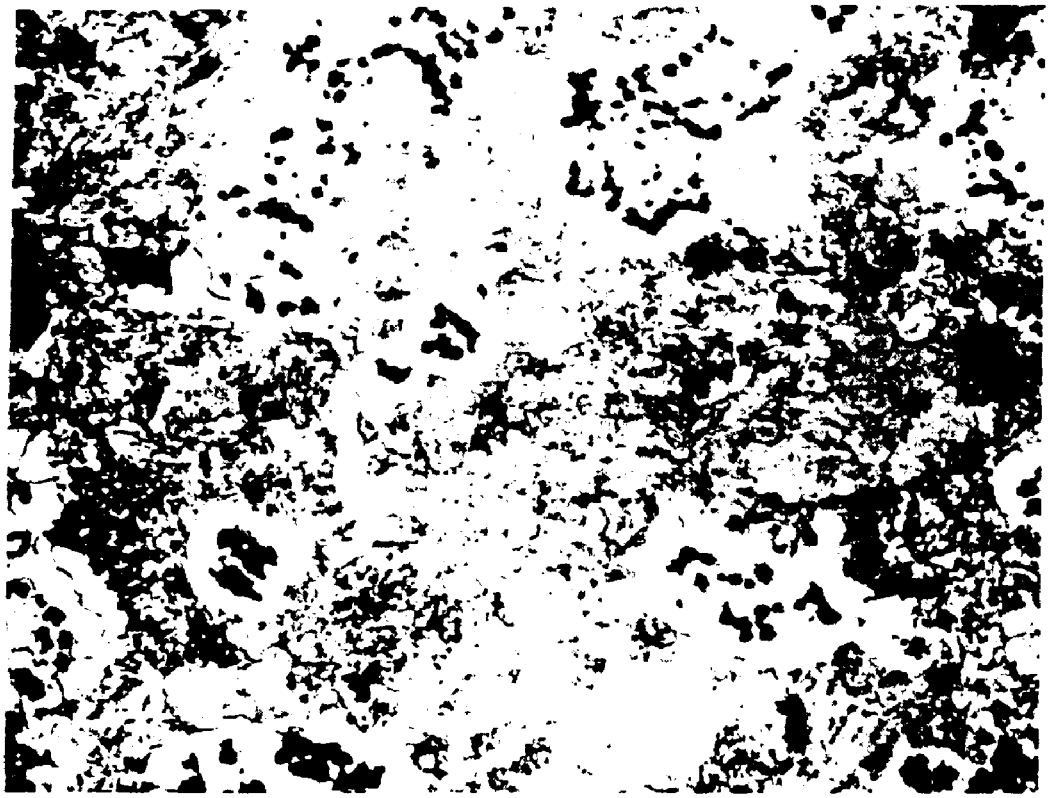
FIG. 5 is a photomicrograph of the texture of an example 3 of an Fe-based cast product.

FIG. 5 is a photomicrograph of a texture of the example 3 of the Fe-based cast product after being thermally treated.

TABLE 1

| Fe—C—Si based alloy | Chemical constituents (% by weight) C | Si | Fe | Eutectic temperature (° C.) | Eutectic crystal amount Ec (% by weight) | Castable temperature (° C.) |
|---|---|---|---|---|---|---|
| Example 1 | 2 | 1 | Balance | 1188 | 6 | 1330 |
| Example 2 | 2 | 1.5 | Balance | 1123 | 12 | 1130 |
| Example 3 | 2 | 2 | Balance | 1160 | 17 | 1170 |
| Example 4 | 1.8 | 3 | Balance | 1135 | 18 | 1147 |
| Example 5 | 2.4 | 3 | Balance | 1167 | 47 | 1167 |
| Example 6 | 2.5 | 2.5 | Balance | 1140 | 48 | 1145 |
| Example 7 | 2 | 5 | Balance | 1180 | 50 | 1180 |
| Example 8 | 2.6 | 2.6 | Balance | 1166 | 52 | 1166 |
| Example 9 | 2.5 | 3 | Balance | 1167 | 52 | 1167 |
| Example 10 | 3.37 | 3.1 | Balance | 1136 | 100 | 1140 |

The examples 1 to 10 are also shown in FIG. 2.

Figure 3:
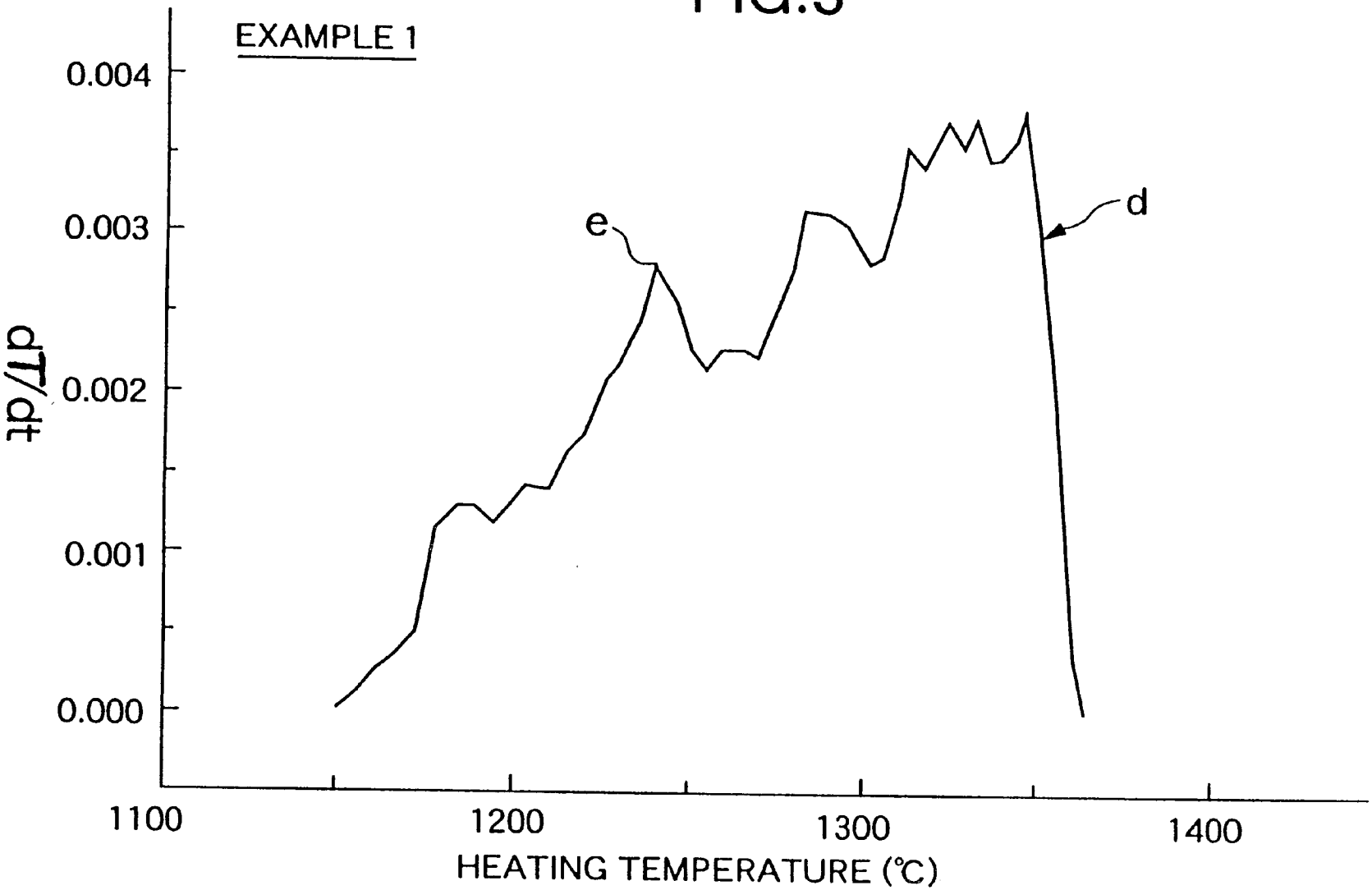
FIG. 3 is a latent heat distribution curve of an example 1 of an Fe—C—Si based alloy.
Figure 4:
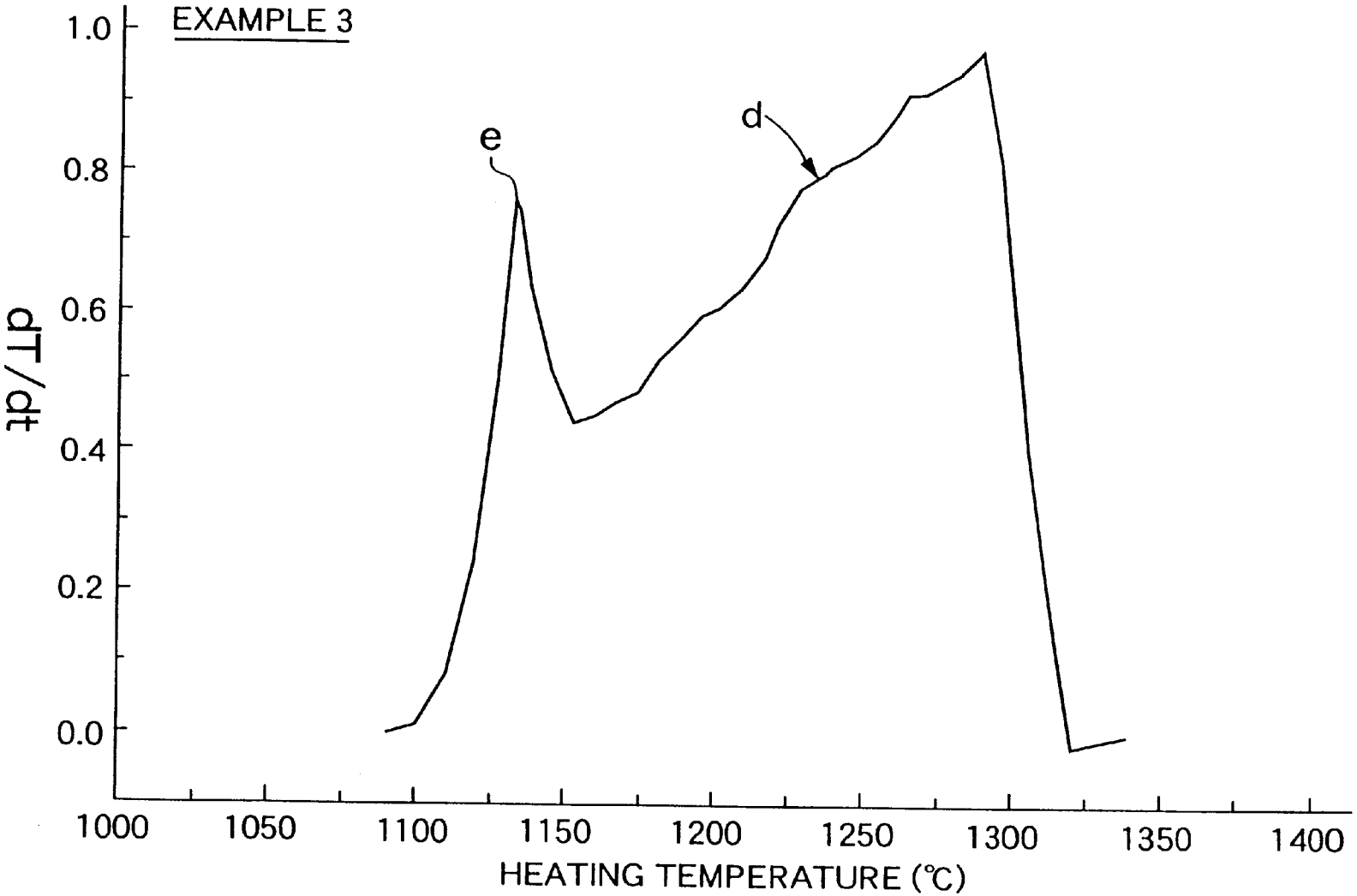
FIG. 4 is a latent heat distribution curve of an example 3 of an Fe—C—Si based alloy.

By carrying out the calorimetry of the examples 1 to 10, it was found that an angle endothermic section due to the melting of a eutectic crystal exists in each of latent heat distribution curves. FIG. 3 shows a latent heat distribution curve d for the example 1, and FIG. 4 shows a latent heat distribution curve d for the example 3. In FIGS. 3 and 4, e indicates the angle endothermic section due to the melting of the eutectic crystal.

In producing an Fe-based cast product in a casting process, a heating/transporting pallet was prepared which had a coating layer comprised of a lower layer portion made of a nitride and an upper layer portion made of a graphite and which was provided on an inner surface of a body made of JIS SUS304. The example 3 of the Fe—C—Si based alloy As apparent from FIG. 5, the example 3 has a sound metal texture. In FIG. 5, black point-shaped portions are fine graphite phases. Each of the examples 2 and 4 to 6 of the cast products also has a metal texture substantially similar to that of the example 3. This is attributable to the fact that the eutectic crystal amount Ec in the Fe—C—Si based alloy is in a range of 10% by weight<Ec<50% by weight.

Figure 6:
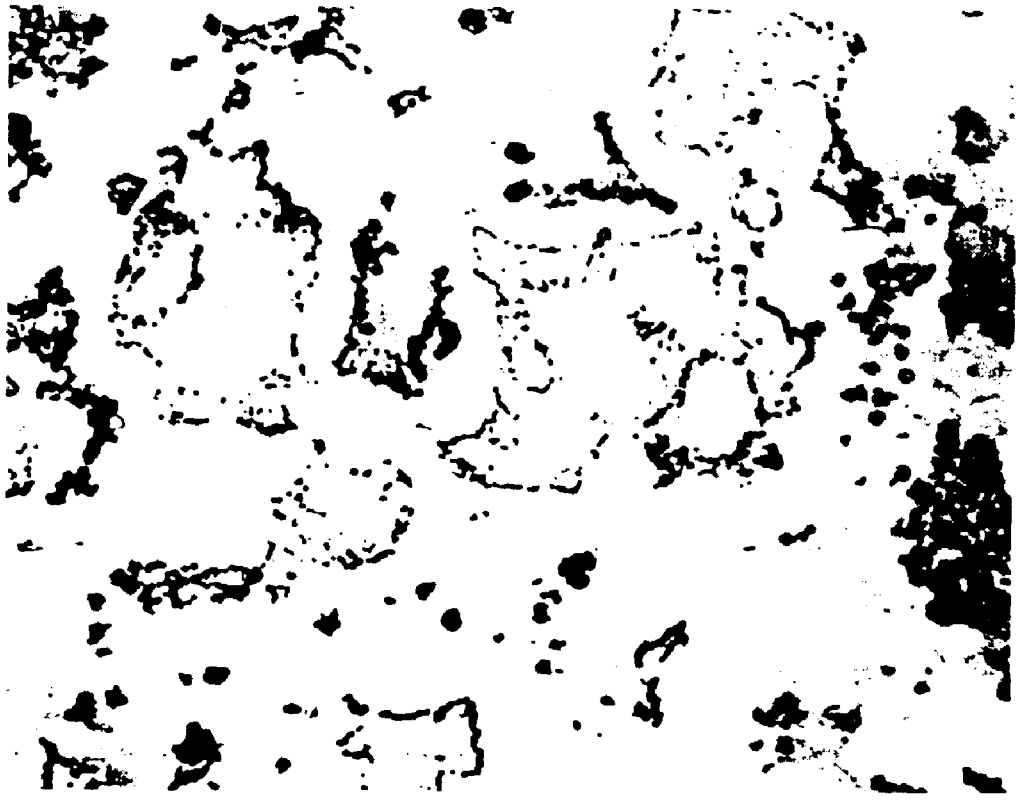
FIG. 6 is a photomicrograph of the texture of an example 7 of an Fe-based cast product.
Figure 7:
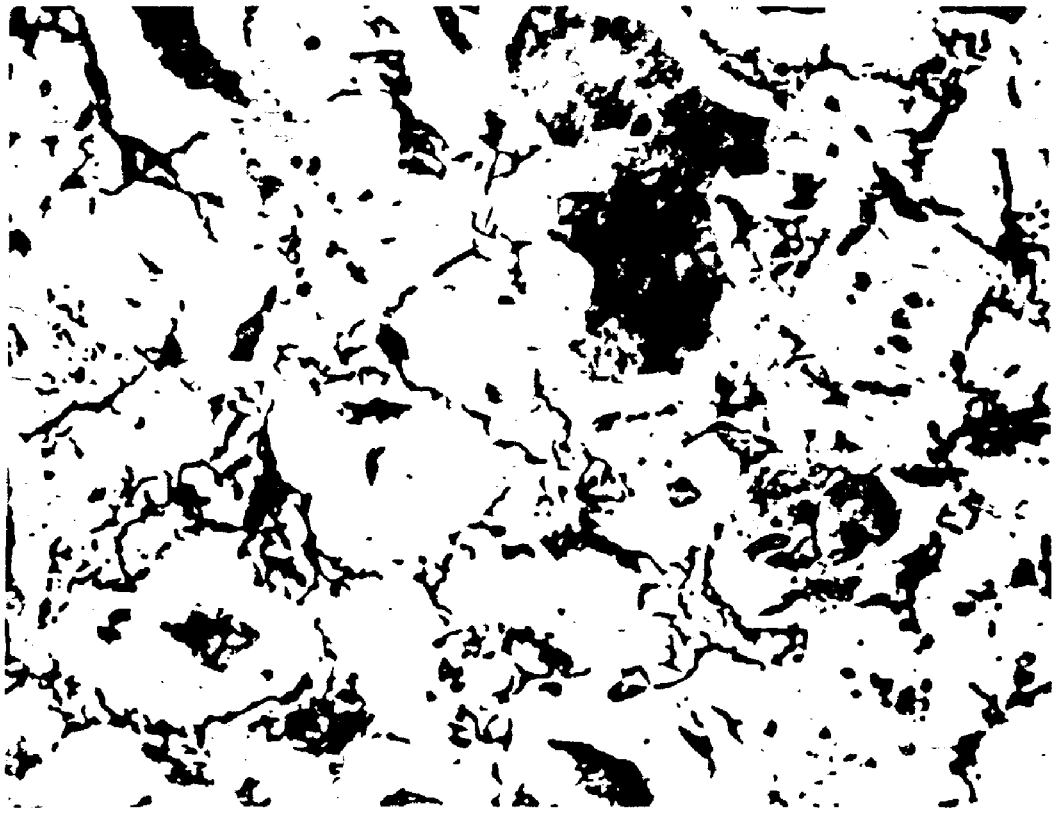
FIG. 7 is a photomicrograph of the texture of an example 10 of an Fe-based cast product.

FIG. 6 is a photomicrograph of a texture of the example 7 of the Fe-based cast product after being thermally treated, and FIG. 7 is a photomicrograph of a texture of the example 10 of the Fe-based cast product after being thermally treated. As apparent from FIGS. 6 and 7, a large amount of graphite phases exist in the examples 7 and 10, as shown as black point-shaped portions and black island-shaped portions. This is attributable to the fact that the eutectic crystal amount Ec in each of the examples 7 and 10 of the Fe—C—Si based alloys is in a range of Ec≦50% by weight.

Figure 8:
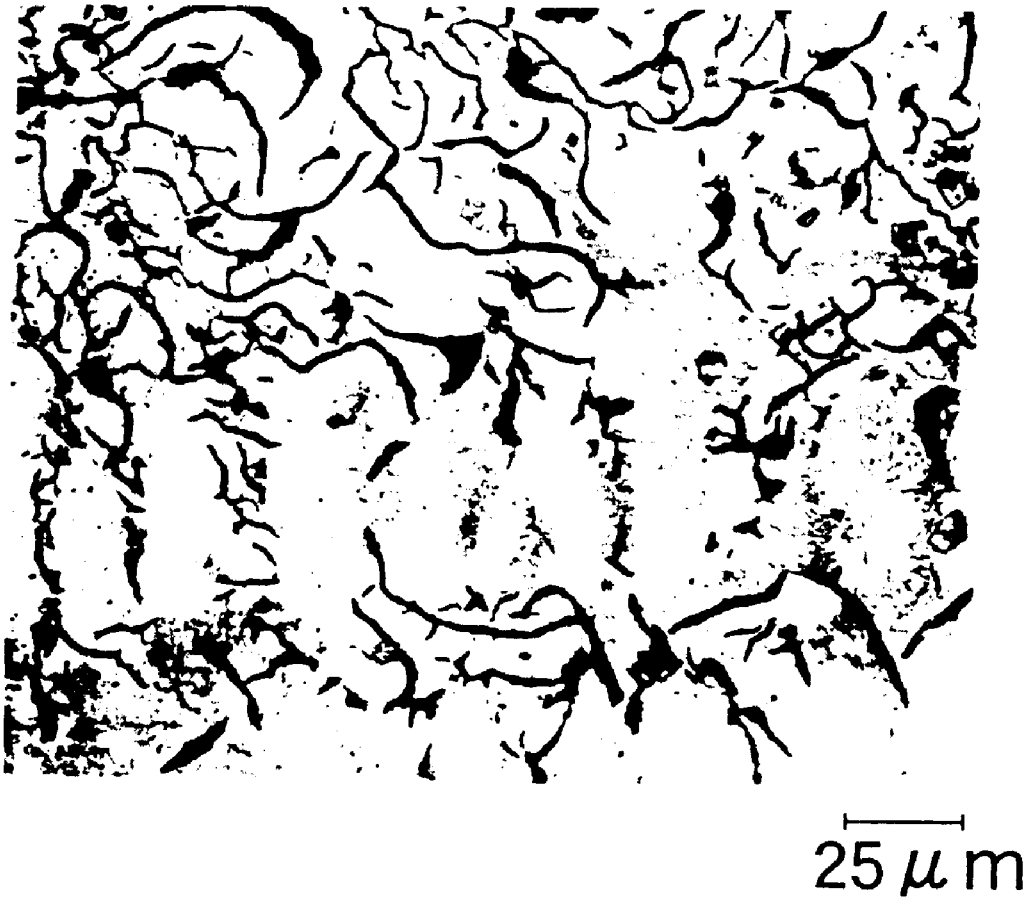
FIG. 8 is a photomicrograph of the texture of an example 11 of an Fe-based cast product.

For comparison, an example 11 of an Fe-based cast product was produced using the example 3 of the Fe—C—Si based alloy by utilizing a melt producing process at a molten metal temperature of 1400° C. FIG. 8 is a photomicrograph of a texture of the example 1 1. As apparent from FIG. 8, a large amount of graphite phases exist in the example 11, as shown as black bold line-shaped portions and black island-shaped portions.

Then, the area rate of the graphite phases, the Young's modulus E and the tensile strength were measured for the examples 2 to 10 of the Fe-based cast products after being thermally treated and the example 11 of the cast product after being produced in the casting manner. In this case, the area rate of the graphite phases was determined using an image analysis device (IP-1000PC made by Asahi Kasei, Co.) by polishing a test piece without etching. This method for determining the area rate of the graphite phases is also used for examples which will be described hereinafter. Table2shows the results.

TABLE 2

| Fe-based cast product | Casting temperature (° C.) | Area rate of graphite phases (%) | Young's modulus E (GPa) | Tensile strength $\sigma_b$ (MPa) |
|---|---|---|---|---|
| Example 2 | 1220 | 1.4 | 190 | 871 |
| Example 3 | 1220 | 2 | 193 | 739 |
| Example 4 | 1200 | 4.8 | 194 | 622 |
| Example 5 | 1180 | 7.8 | 193 | 620 |
| Example 6 | 1200 | 7.9 | 191 | 610 |
| Example 7 | 1180 | 9.3 | 165 | 574 |
| Example 8 | 1180 | 8.2 | 179 | 595 |
| Example 9 | 1180 | 8.5 | 175 | 585 |
| Example 10 | 1150 | 12 | 118 | 325 |
| Example 11 | 1400 | 15 | 98 | 223 |

Figure 9:
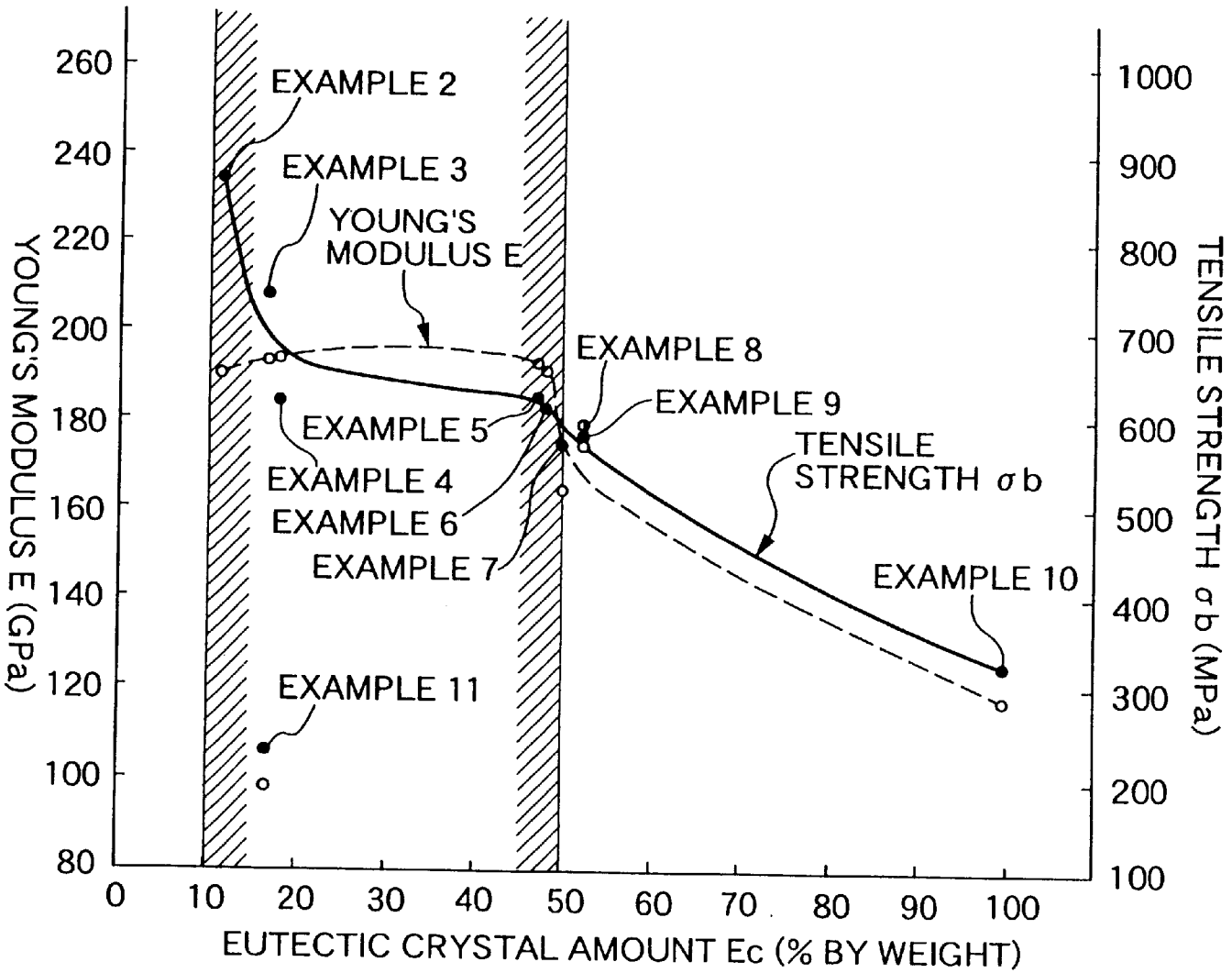
FIG. 9 is a graph illustrating the relationship between the eutectic crystal amount Ec, the Young's modulus E and the tensile strength $\sigma_b$.
Figure 10:
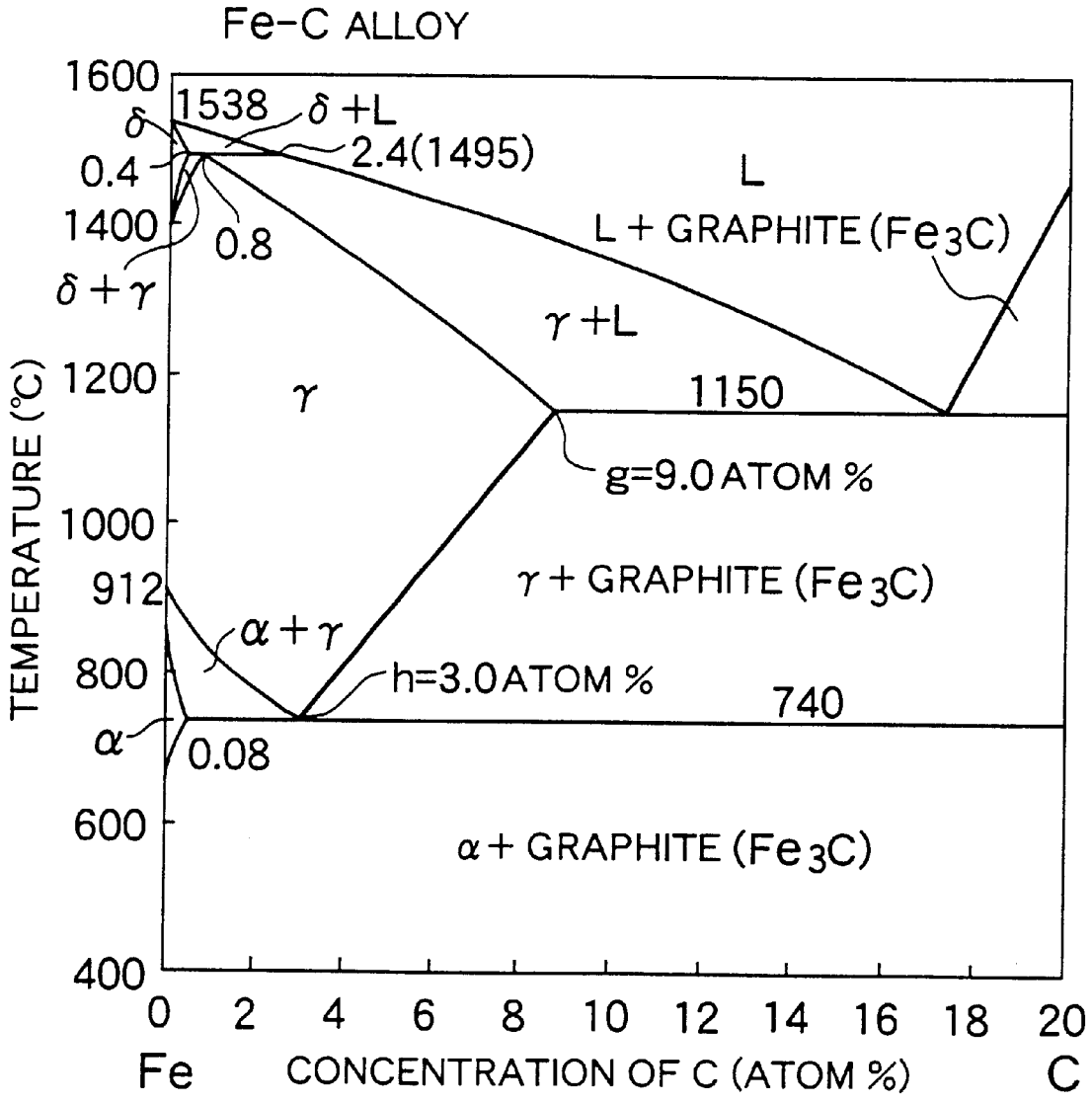
FIG. 10 is a state diagram of an Fe—C alloy.
Figure 11:
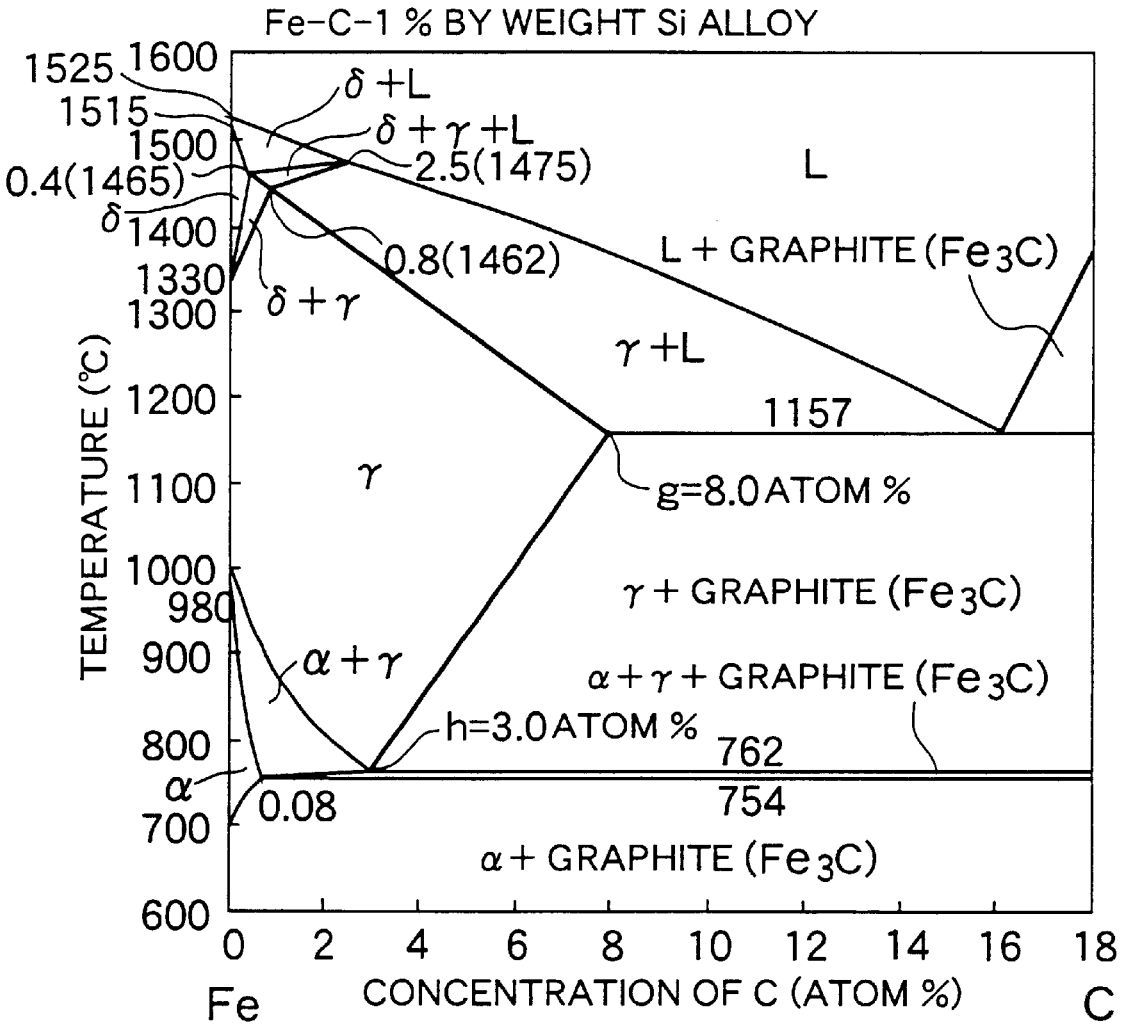
FIG. 11 is a state diagram of an Fe—C—1% by weight Si alloy.

FIG. 9 is a graph taken based on Tables 1 and 2 and illustrating the relationship between the eutectic crystal amount Ec, the Young's modulus E and the tensile strength $\sigma_b$. As apparent from FIG. 9, each of the examples 2 to 6 of the Fe-based cast products made using the examples 2 to 6 of the Fe—C—Si based alloys with the eutectic crystal amount Ec set in the range of 10% by weight<Ec<50% by weight has excellent mechanical properties, as compared with the examples 7 to 10 of the Fe-based cast products with the eutectic crystal amount EC equal to or higher than 50% by weight. It is also apparent that the example 3 of the Fe-based cast product has mechanical properties remarkably enhanced as compared with the example 11 of the Fe-based cast product made by the melt producing process using the same material as for the example 3.

EXAMPLE II

FIGS. 10 to 13 show state diagrams of an Fe—C alloy, an Fe—C—(1% by weight) Si alloy, an Fe—C—(2% by weight) Si alloy and an Fe—C—(3% by weight) Si alloy, respectively.

Table 3 shows the maximum solid-solution amount g of C (carbon) (which is an alloy component) solubilized into an austenite phase (γ) as a base metal component and the temperature providing the maximum solid-solution amount, the minimum solid-solution amount h and the temperature providing the minimum solid-solution amount, and the difference g-h between the maximum and minimum solid-solution amounts g and h for the respective alloys.

TABLE 3

| | Maximum solid-solution amount | | Minimum solid-solution amount | | |
|---|---|---|---|---|---|
| Alloy | g (atom %) | Temperature (° C.) | h (atom %) | Temperature (° C.) | Difference g − h (atom %) |
| Fe—C | 9.0 | 1150 | 3.0 | 740 | 6.0 |
| Fe—C-1 % by weight Si | 8.0 | 1157 | 3.0 | 762 | 5.0 |
| Fe—C-2 % by weight Si | 7.3 | 1160 | 2.9 | 790 | 4.4 |
| Fe—C-3 % by weight Si | 6.4 | 1167 | 2.8 | 825 | 3.6 |

It can be seen from Table 3 that each of the alloys meets the requirement for the difference g-h equal to or higher than 3.6 atom %.

Figure 12:
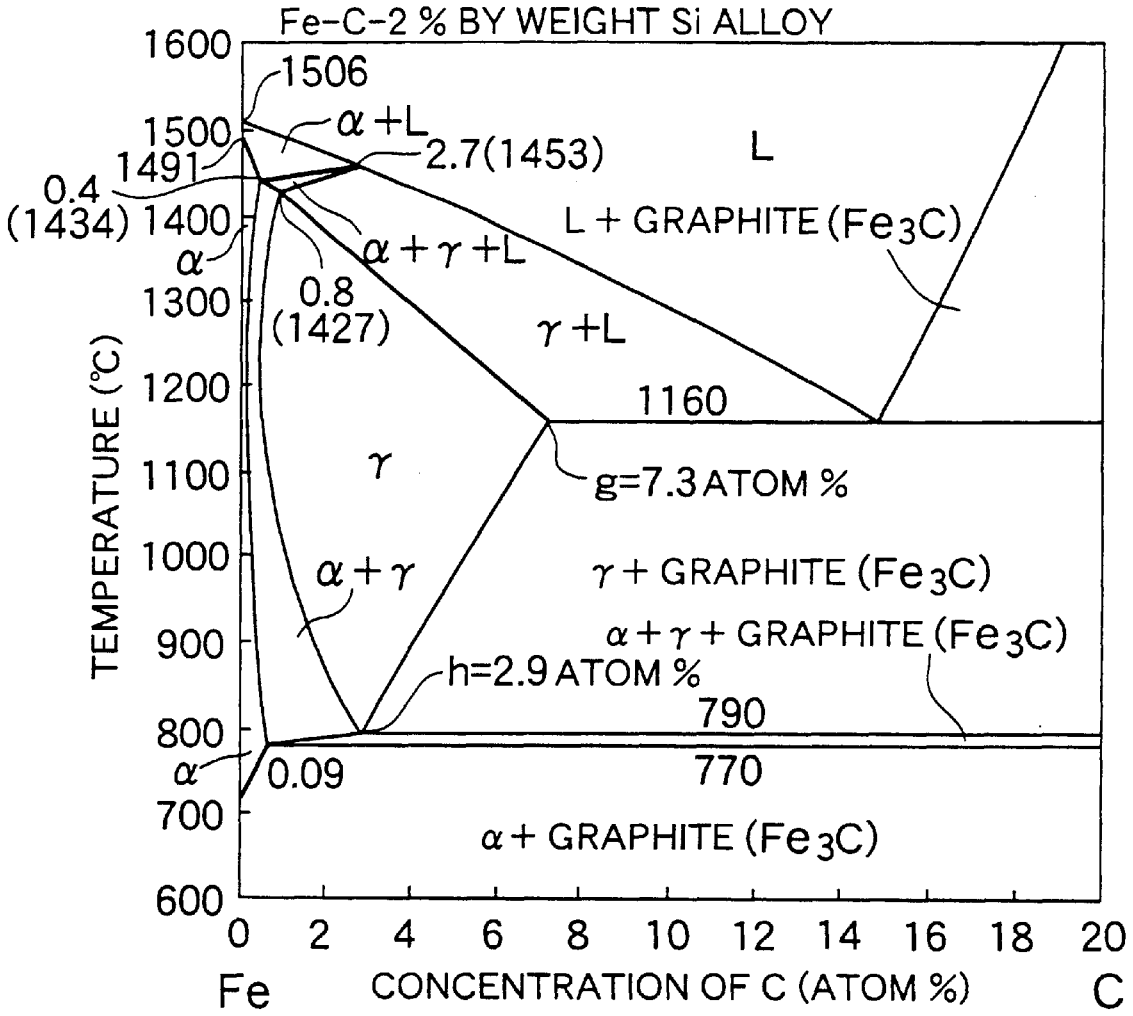
FIG. 12 is a state diagram of an Fe—C-2% by weight Si alloy.
Figure 13:
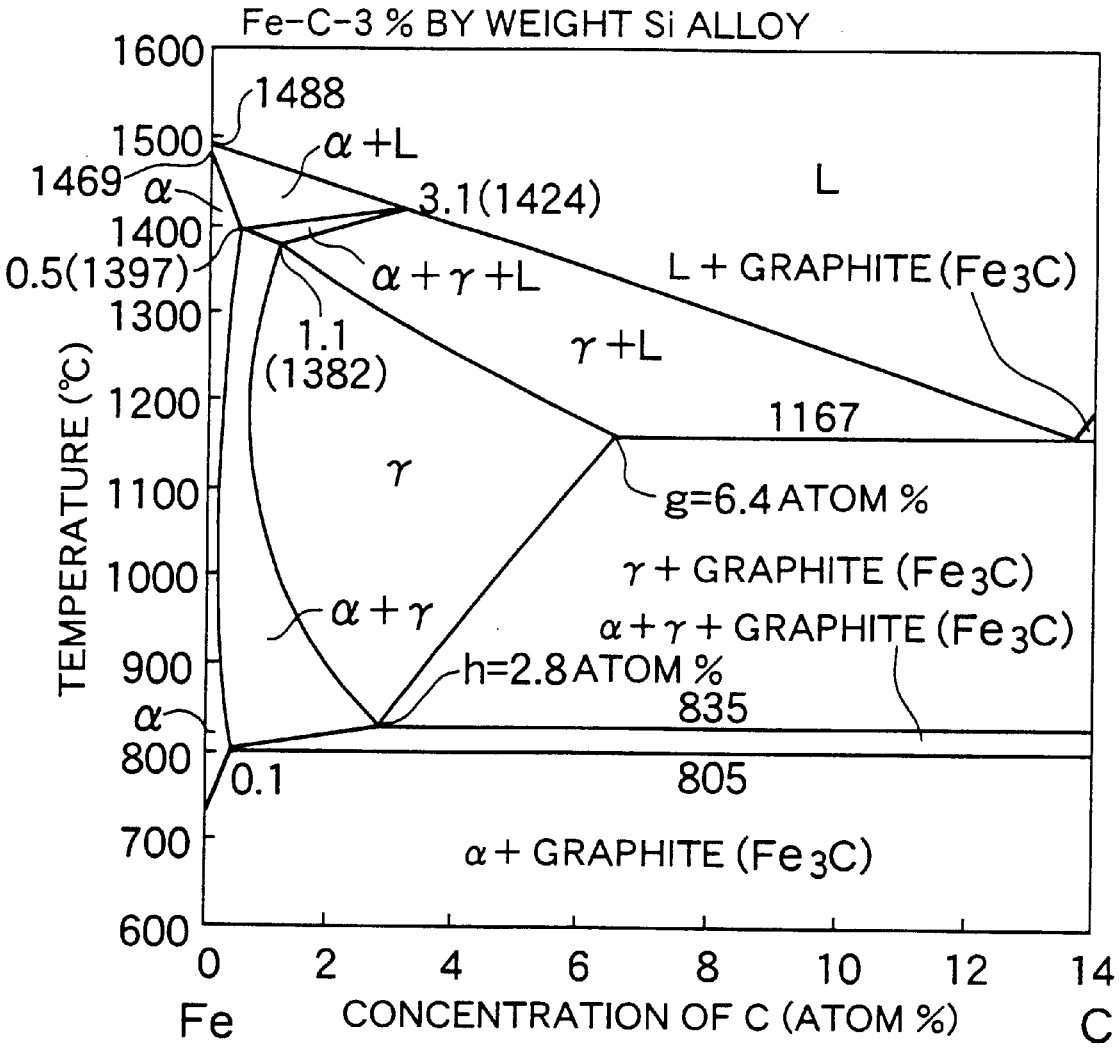
FIG. 13 is a state diagram of an Fe—C-3% by weight Si alloy.

A molten metal of a hypoeutectic Fe-based alloy having a composition comprised of Fe-2% by weight of C-2% by weight of Si-0.002% by weight of P-0.006% by weight of S (wherein P and S are inevitable impurities) was prepared on the basis of FIG. 12. Then, using this molten metal, various Fe-based casting materials were produced by utilizing a common continuous-casting process without stirring under varied conditions.

Figure 14:
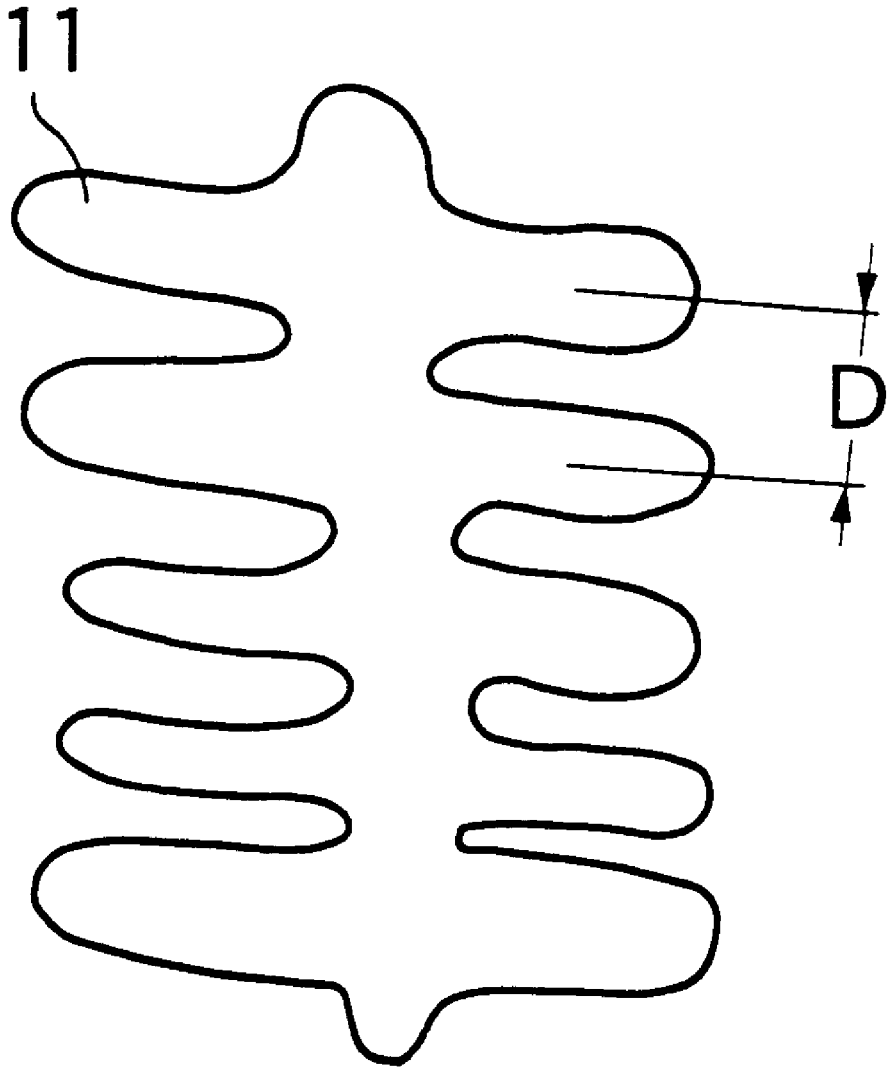
FIG. 14 is a schematic diagram of a dendrite.

Each of the Fe-based casting materials has a large number of dendrite phases d as shown in FIG. 14 with different mean secondary dendrite arm spacings (which will be referred to as a mean DAS2 hereinafter) D. The mean DAS2 D was determined by performing the image analysis.

Then, each of the Fe-based casting materials was subject to an induction heating with the heating rate Rh between the eutectoid temperature (770° C.) which was a temperature providing the minimum solid-solution amount h and the eutectic temperature (1160° C.) which was a temperature providing the maximum solid-solution amount g being varied. When the temperature of each Fe-based casting material reached 1200° C. (a temperature lower than the solid phase line) beyond the eutectic temperature at the above-described heating rate, each Fe-based casting material was water-cooled, whereby the metal texture thereof was fixed.

Thereafter, the metal texture of each of the Fe-based casting materials was observed by a microscope to examine the presence or absence of dendrite phases and to determine the relationship between the mean DAS2 D at the time when the dendrite phases disappeared and the minimum value Rh (min) of ting rate Rh, thereby providing results shown in Table 4.

TABLE 4

| Mean DAS2 D (μm) | Heating rate Rh (min) (° C./min) | Mean DAS2 D (μm) | Heating rate Rh (min) (° C./min) |
|---|---|---|---|
| 10 | 50 | 70 | 70.7 |
| 20 | 50 | 76 | 77 |
| 25 | 50 | 80 | 82.2 |
| 28 | 51 | 90 | 96.3 |
| 30 | 50.7 | 94 | 103 |
| 40 | 51.8 | 100 | 113 |
| 50 | 55.5 | 120 | 154.2 |
| 60 | 61.8 | 150 | 235.5 |

Figure 15:
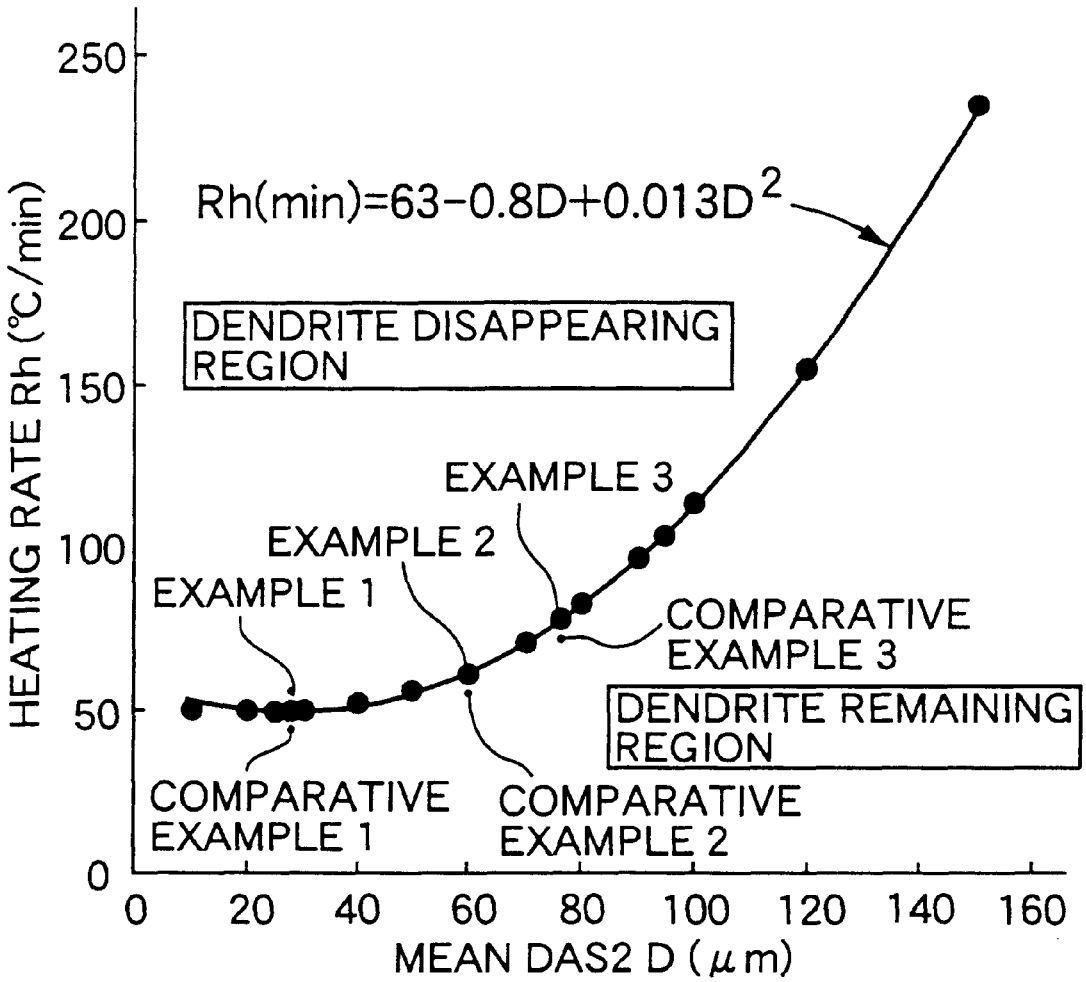
FIG. 15 is a graph illustrating the relationship between the mean DAS2 D and the heating rate Rh.

On the basis of Table 4, the relationship between the mean DAS2 D and the minimum value Rh (min) of the heating rate Rh was plotted by taking the mean DAS2 D on the axis of abscissas and the heating rate Rh on the axis of ordinates, respectively, and the plots were connected to each other, thereby providing a result shown in FIG. 15.

It was cleared up from FIG. 15 that the line segment can be represented as being Rh (min)=$63-0.8D+0.013D^2$ and therefore, the dendrite phases can be spheroidized to disappear by setting the heating rate Rh in a range of Rh≦Rh (min) with each of mean DAS2 D.

Figure 16A:
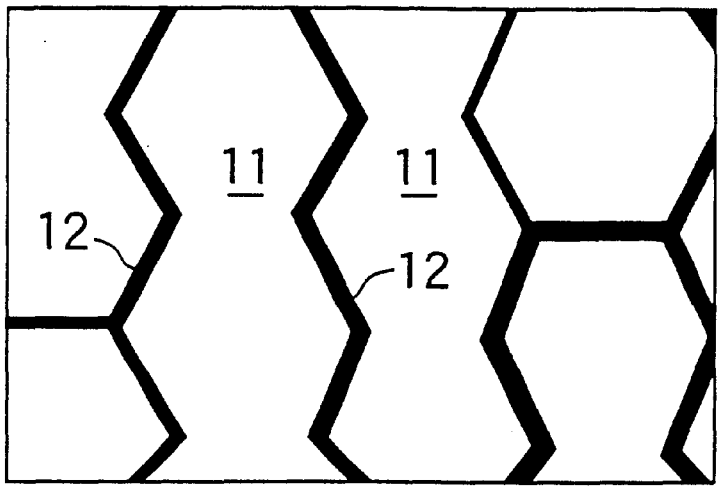
FIGS. 16A to 16C are illustrations for explaining dendrite spheroidizing mechanisms.
Figure 16B:
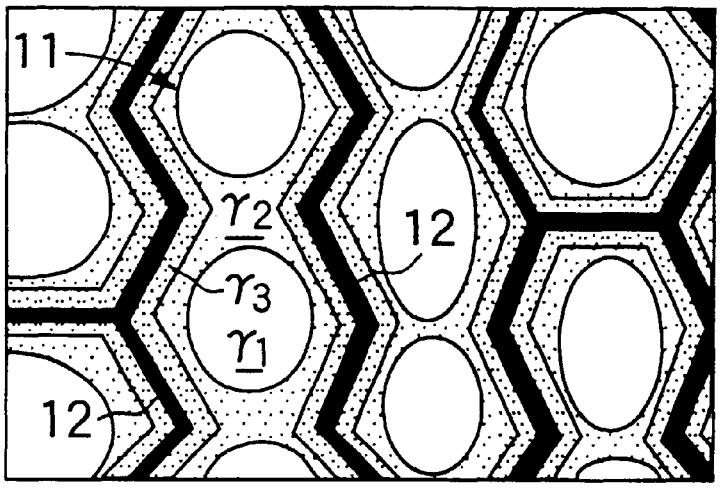
Figure 16C:
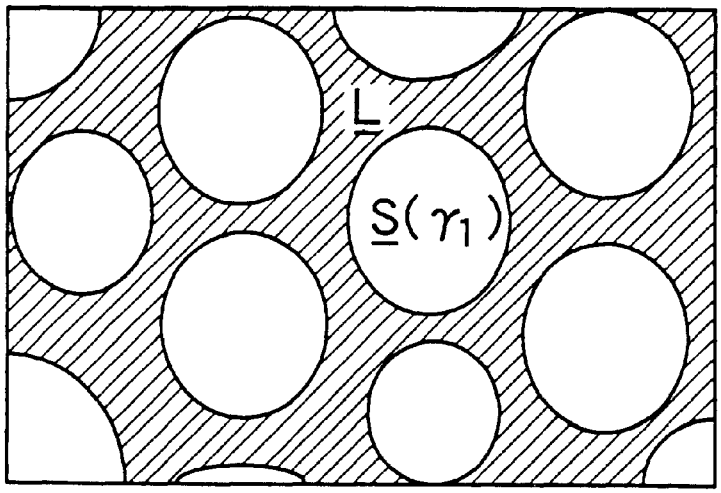

FIGS. 16A to 16C show dendrite spheroidizing mechanisms when the heating rate Rh was set in a range of Rh≦$63-0.8D+0.013D^2$.

As shown in FIG. 16A, when the temperature of the Fe-based casting material made by the common continuous-casting process without stirring is equal to or lower than the eutectoid temperature, a large number of dendrite phases (pearlite, $\alpha+Fe_3C$) 11 and eutectic crystal portions (graphite, $Fe_3C$) 12 existing between the adjacent dendrite phases 11, appear in the metal texture.

As shown in FIG. 16B, if the temperature of the Fe-based casting material exceeds the eutectoid temperature as a result of the induction heating, the diffusion of carbon (C) from the eutectic crystal portions (graphite, $Fe_3C$) 12 having a higher concentration of carbon (C) into each of the dendrite phases (γ) 11 is started.

In this case, if the heating rate Rh is set in the above-described range, the diffusion of carbon into the dendrite phases (γ) 11 little reaches center portions of the dendrite phases due to the higher rate Rh. For this reason, at just below the eutectic temperature, a plurality of spherical γphases $\gamma_1$ having a lower concentration of carbon, a γ phase $\gamma_2$ having a medium concentration of carbon and surrounding the spherical γ phases $\gamma_1$, and a γ phase $\gamma_3$ having a higher concentration of carbon and surrounding the γ phase $\gamma_2$ having the medium concentration of carbon, appear in each of the dendrite phases (γ) 11.

As shown in FIG. 16C, if the temperature of the Fe-based casting material exceeds the eutectic temperature, the remaining eutectic crystal portions (graphite, $Fe_3C$) 12, the γ phase $\gamma_3$ having the higher concentration of carbon and the γ phase $\gamma_2$ having the medium concentration of carbon are eutectically molten in the named order, thereby providing a semi-molten Fe-based casting material comprised of a plurality of spherical solid phases (spherical γ phases $\gamma_1$) S and a liquid phase L.

Figure 17A:
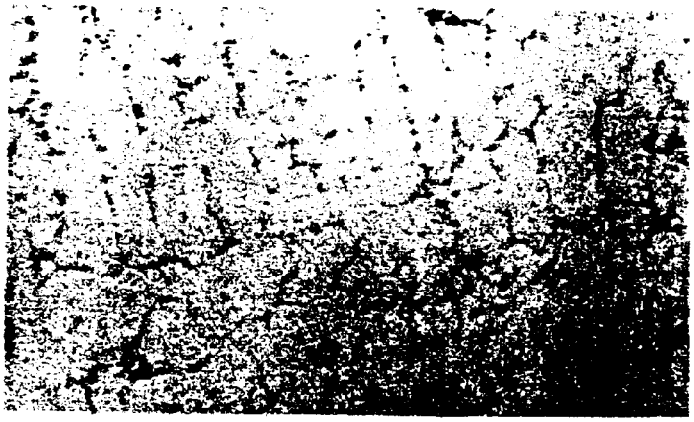
FIGS. 17A to 17C are photomicrographs of textures of Fe-based casting materials corresponding to FIGS. 16A to 16C.
Figure 18A:
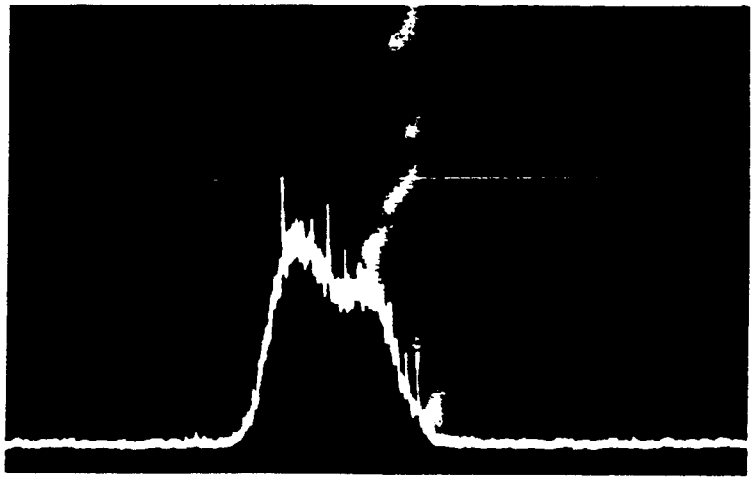
FIGS. 18A to 18C are illustrations of metal textures, taken by EPMA, of Fe-based casting materials corresponding to FIGS. 17A to 17C.

FIG. 17A is a photomicrograph of a texture of an Fe-based casting material with its temperature equal to or lower than the eutectoid temperature, and corresponds to FIG. 16A. From FIG. 17A, dendrite phases are observed and the mean DAS2 D thereof was equal to 94 μm. Flake-formed graphite phases exist to surround the dendrite phases. This is also apparent from a wave form indicating the existence of graphite phases in the metal texture illustration in FIG. 18A taken by EPMA.

Figure 17B:
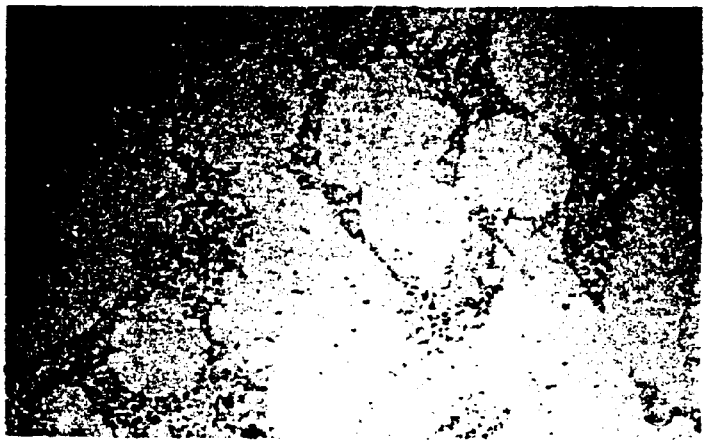
Figure 18B:
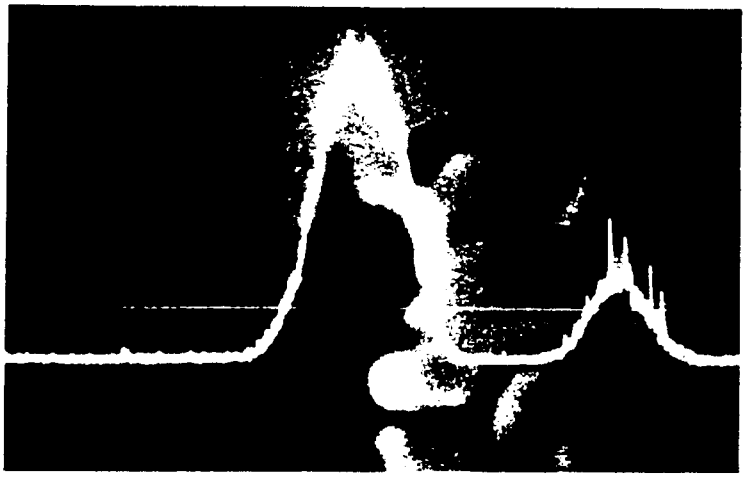

FIG. 17B is a photomicrograph of a texture of an Fe-based casting material heated to just below the eutectic temperature, and corresponds to FIG. 16B. This Fe-based casting material was prepared by subjecting an Fe-based casting material to an induction heating with the heating rate Rh from the eutectoid temperature being set at a value equal to 103° C./min, and water-cooling the resulting material at 1130° C. From FIG. 17B, a spherical γ phase and diffused carbon (C) surrounding the spherical γ phase are observed. This is also apparent from the fact that the graphite phase is finely divided into an increased wide and diffused in a metal texture illustration in FIG. 18B taken by EPMA.

Figure 17C:
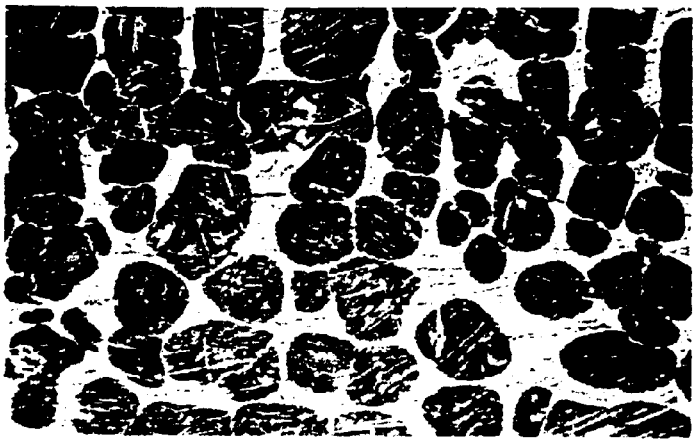
Figure 18C:
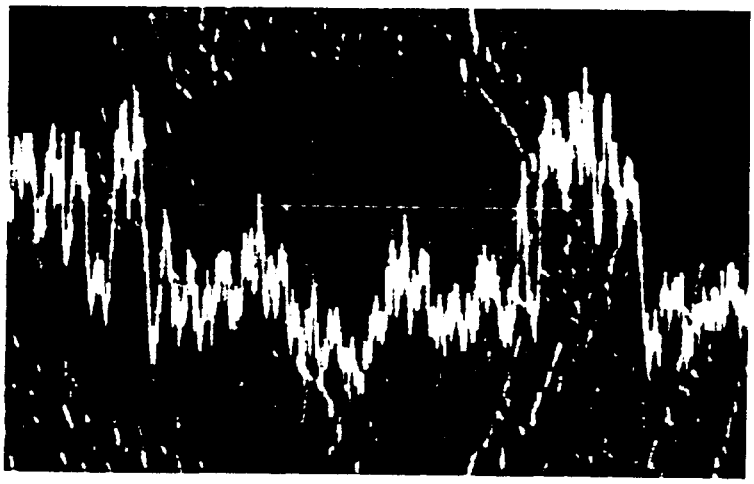

FIG. 17C is a photomicrograph of a texture of an Fe-based casting material in a semi-molten state, and corresponds to FIG. 16C. This Fe-based casting material was prepared by subjecting an Fe-based casting material to an induction heating with the heating rate Rh from the eutectoid temperature being likewise set at a value equal to 103° C./min, and water-cooling the resulting material at 1200° C. It can be seen from FIG. 17C that spherical solid phases and a liquid phase exist. This is also apparent from the fact that spherical martensite phases corresponding to the spherical solid phases and a ledeburite phase corresponding the liquid phase appear in a metal texture illustration in FIG. 18C taken by EPMA.

Figure 19A:
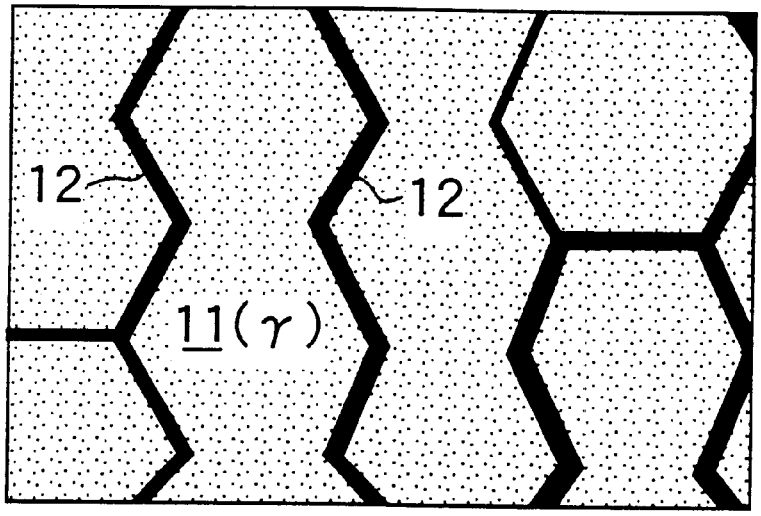
FIGS. 19A and 19B are illustrations for explaining dendrite-remaining mechanisms.
Figure 19B:
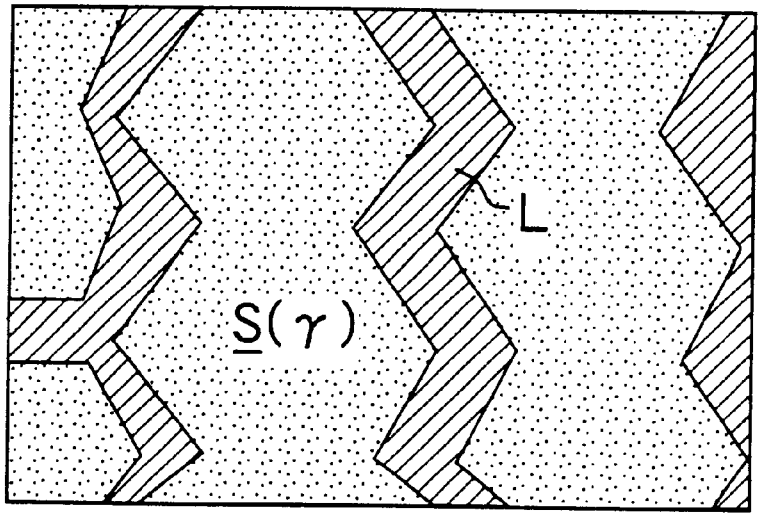

FIGS. 19A and 19B show dendrite-remaining mechanisms when the above-described Fe-based casting material was used and the heating rate Rh was set in a range of Rh<$63-0.8D+0.013D^2$.

As shown in FIG. 19A, if the temperature of the Fe-based casting material exceeds the eutectoid temperature, the diffusion of carbon (C) from the eutectic crystal portions (C, $Fe_3C$) 12 into each of the dendrite phases (γ) 11 is started. In this case, the diffusion of carbon (C) into each of the dendrite phases (γ) 11 sufficiently reaches a center portion of the dendrite phase due to the lower heating rate Rh. Therefore, at just below the eutectic temperature, the concentration of carbon in each of the dendrite phases (γ) 11 is substantially uniform all over and lower. In this case, the metal texture is little different from that equal to or lower than the eutectoid temperature in FIG. 16A.

As shown in FIG. 19B, if the temperature of the Fe-based casting material exceeds the eutectic temperature, the surfaces of the remaining eutectic crystal portions 12 and the dendrite phases (γ) 11 contacting the remaining eutectic crystal portions 12 are molten and hence, a liquid phase L is produced, but each of the dendrite phases (γ) 11 remains intact. As a result, the spheroidization of the dendrite phases (γ) and thus the solid phases S is not performed. On the other hand, the coalescence of the solid phases S occurs.

Figure 20A:
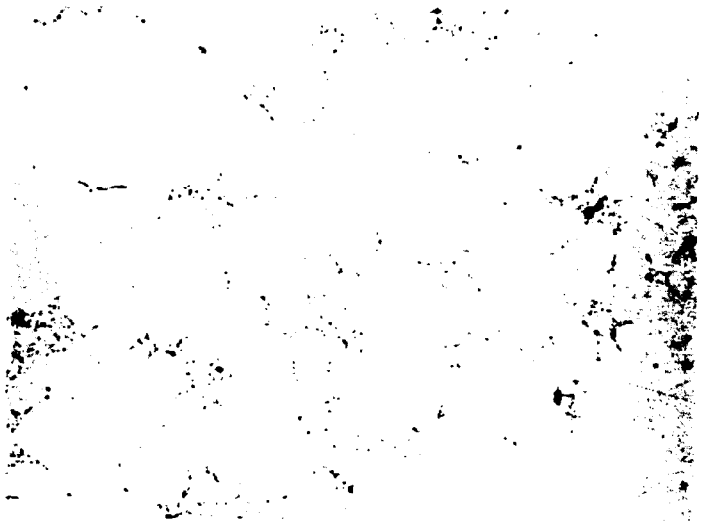
FIGS. 20A and 20B are photomicrographs of textures of Fe-based casting materials corresponding to FIGS. 19A and 19B.

FIG. 20A is a photomicrograph of a texture of an Fe-based casting material with its temperature being just below the eutectic temperature, and corresponds to FIG. 19A. This Fe-based casting material was prepared by subjecting an Fe-based casting material having a mean DAS2 D equal to 94 μm and as shown in FIG. 17A to an induction heating with the heating rate Rh from the eutectoid temperature being set at a value equal to 75° C./min (<103° C./min), and water-cooling the resulting material at 1130° C. It can be seen that this metal texture is little different from that shown in FIG. 17A.

Figure 20B:
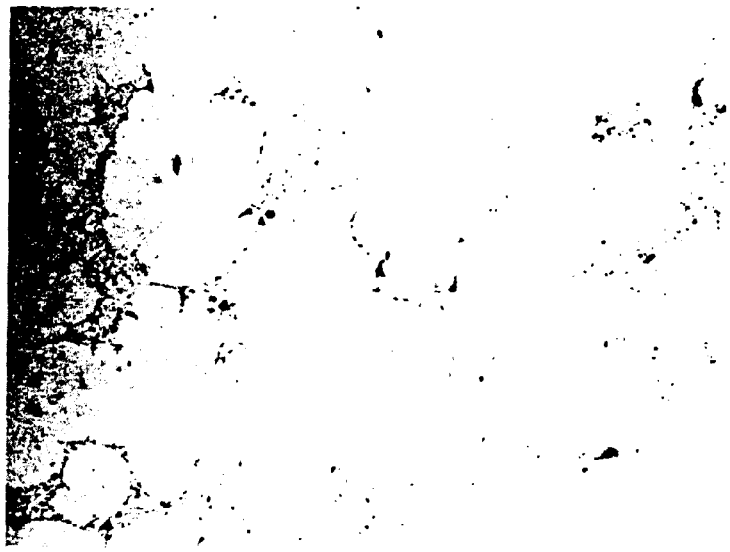

FIG. 20B is a photomicrograph of a texture of an Fe-based casting material in a semi-molten state, and corresponds to FIG. 19B. This Fe-based casting material was prepared by subjecting an Fe-based casting material to an induction heating with the heating rate Rh from the eutectoid temperature being likewise set at a value equal to 75° C./min, and water-cooling the resulting material at 1200° C. It can be seen from FIG. 20B that the spheroidization was not performed, and the solid phases were coalesced.

Particular Example (1) Three Fe-based rounded billets having the same composition as described above and having mean DAS2 D of 28 μm, 60 μm and 76 μm were produced by utilizing a continuous-casting process in which a steering was not conducted. Then, an Fe-based casting material was cut out from each of the rounded billets. The size of each of the Fe-based casting materials was set such that the diameter was 55 mm and the length was 65 mm.

The Fe-based casting materials were subjected to an induction heating with the heating rate Rh between the eutectoid temperature and the eutectic temperature being varied. Then, when the temperature of each Fe-based casting material reached 1220° C. beyond the eutectic temperature, each Fe-based casting material was water-cooled, whereby the metal texture thereof in a semi-molten state was fixed. Thereafter, the metal texture of each of the Fe-based casting materials was observed by a microscope to examine the presence or absence of dendrite phases.

The mean DAS2 D of each of the Fe-based casting material, the minimum value Rh (min) of the heating rate Rh as in Table 4 and in FIG. 16 required to allow the dendrite phase to disappear, the heating rate Rh and the presence or absence of the dendrite phases in the semi-molten state are shown in Table 5.

TABLE 5

| | Mean DAS 2 D (μm) | Heating rate (° C./min) Rh (min) | Heating rate (° C./min) Rh | Presence or absence of dendrite phases |
|---|---|---|---|---|
| Example 1 | 28 | 51 | 57 | Absence |
| Comparative Example 1 | | | 44 | Presence |
| Example 2 | 60 | 61.8 | 65 | Absence |
| Comparative Example 2 | | | 58 | Presence |
| Example 3 | 76 | 77 | 79 | Absence |
| Comparative Example 3 | | | 75 | Presence |

Figure 21A:
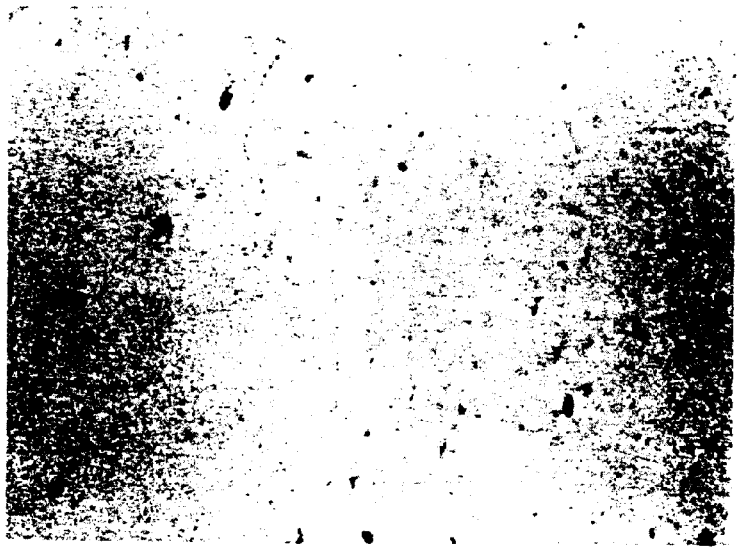
FIGS. 21A and 21B are photomicrographs of textures of an Fe-based casting material according to an example 1.
Figure 21B:
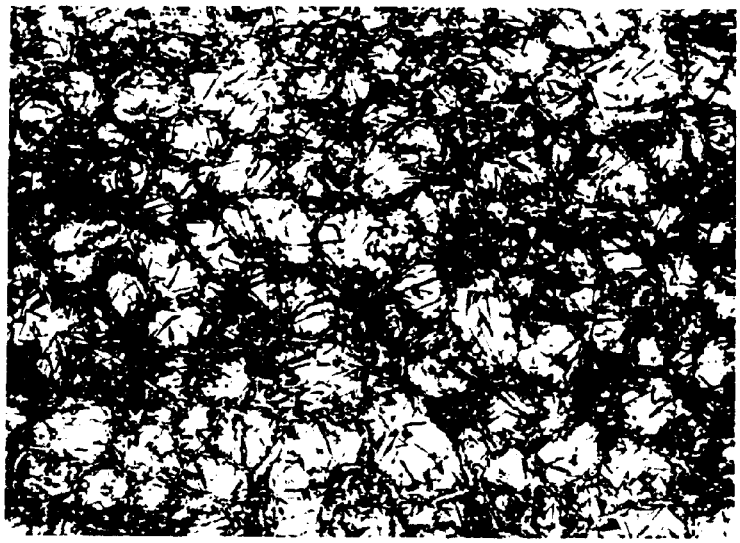
Figure 22A:
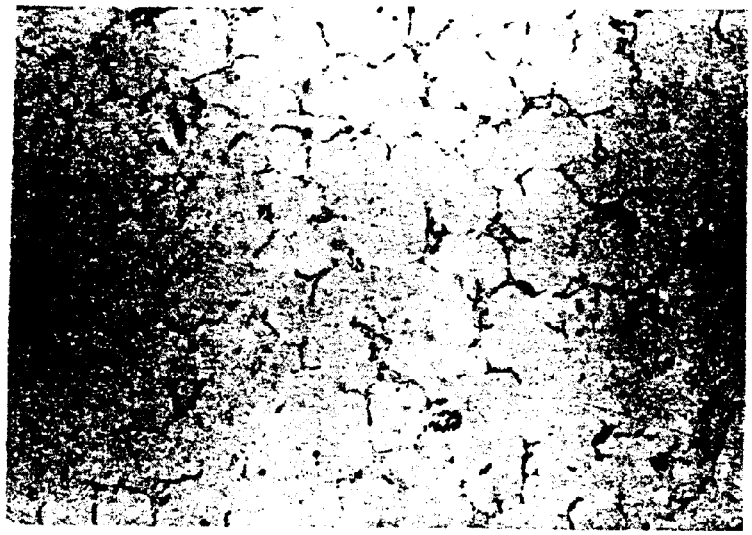
FIGS. 22A and 22B are photomicrographs of textures of an Fe-based casting material according to a comparative example 1.
Figure 22B:
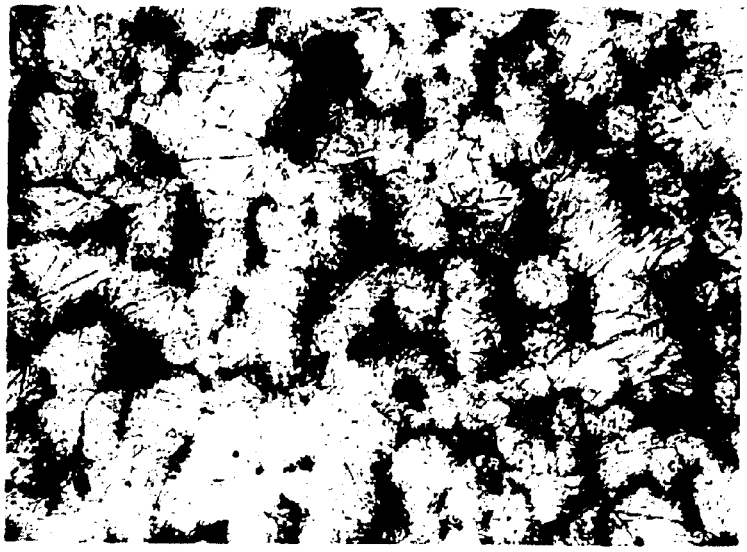
Figure 23A:
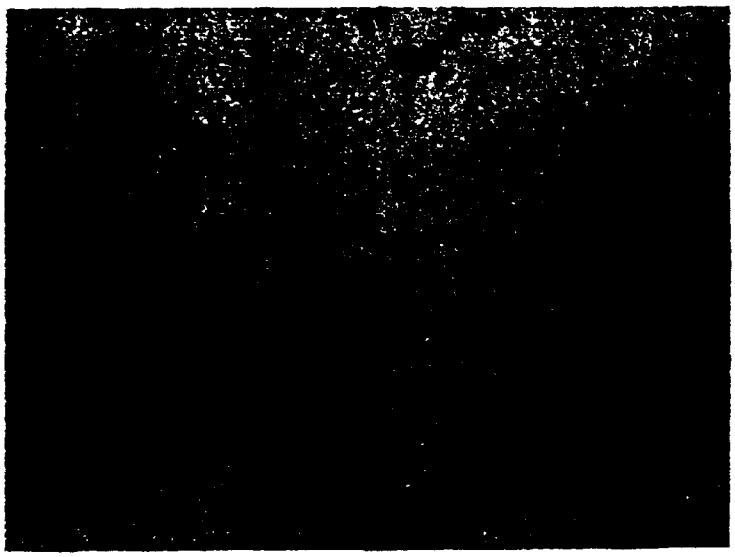
FIGS. 23A and 23B are photomicrographs of textures of an Fe-based casting material according to an example 2.
Figure 23B:
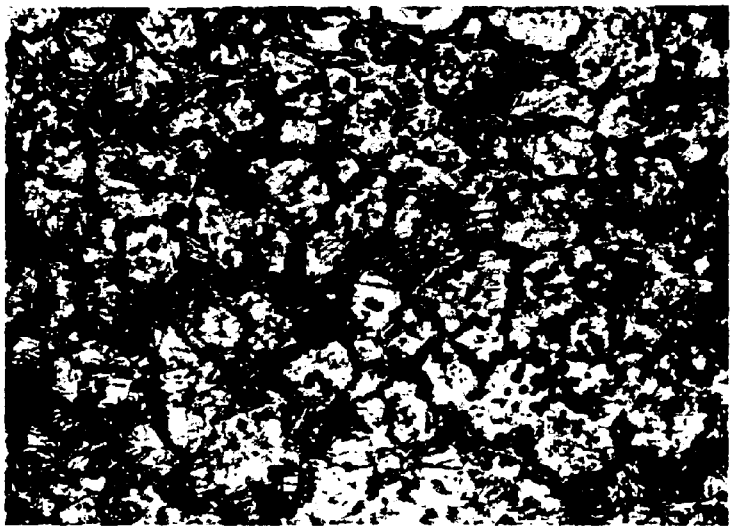
Figure 24A:
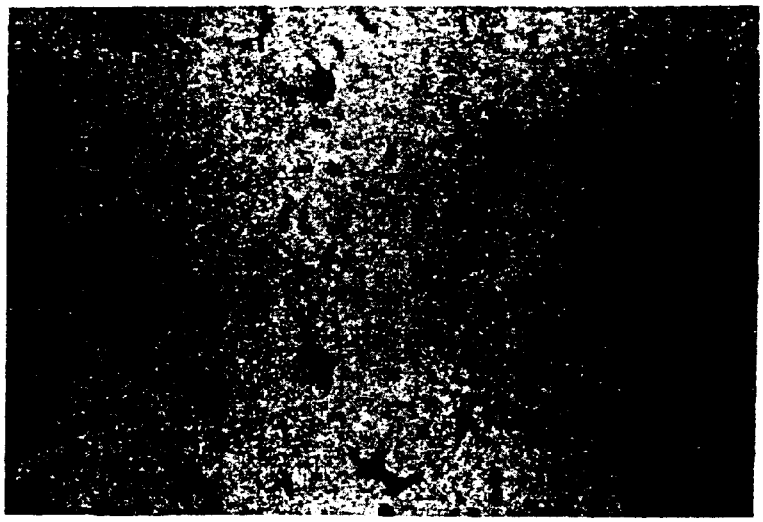
FIGS. 24A and 24B are photomicrographs of textures of an Fe-based casting material according to a comparative example 2.
Figure 24B:
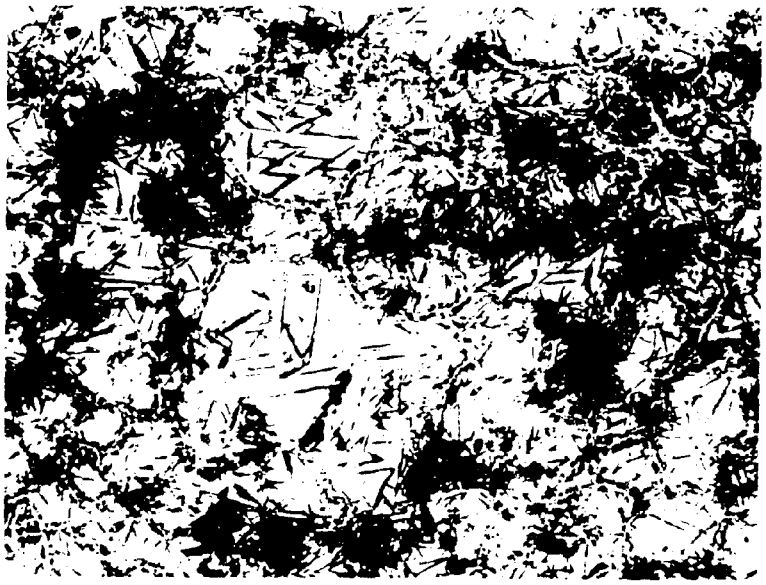
Figure 25A:
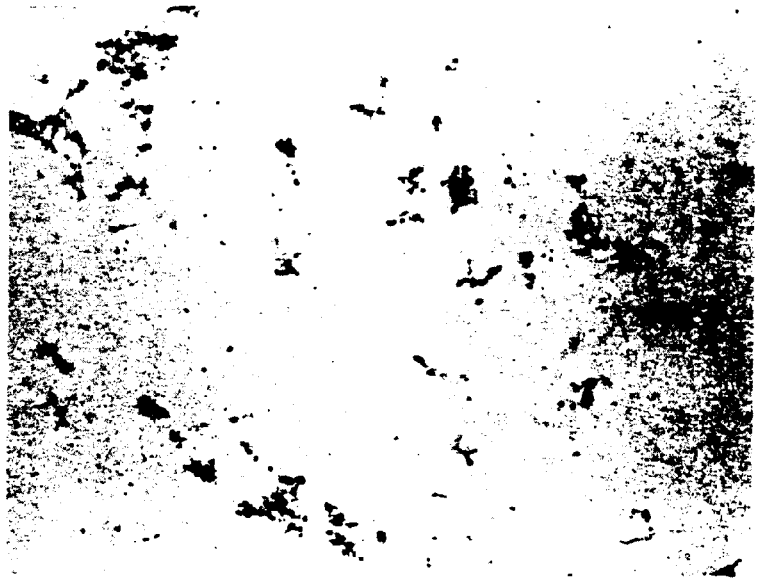
FIGS. 25A and 25B are photomicrographs of textures of an Fe-based casting material according to an example 3.
Figure 25B:
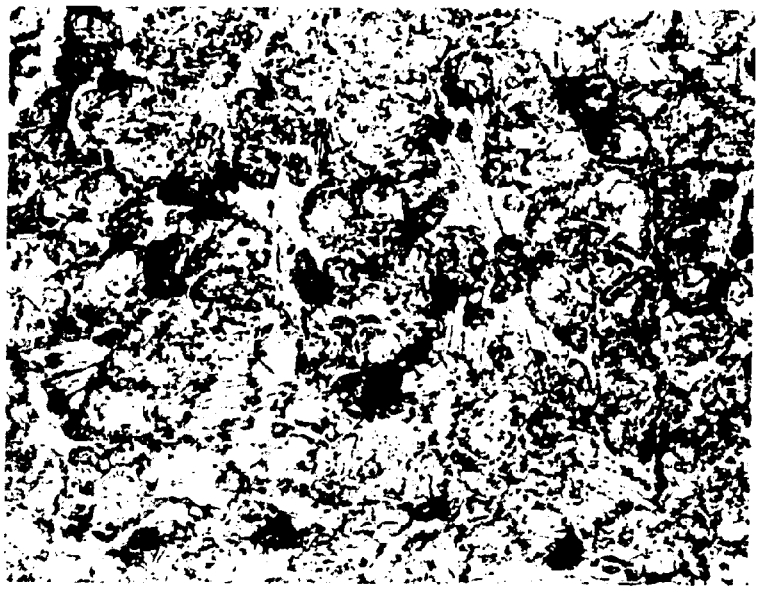
Figure 26A:
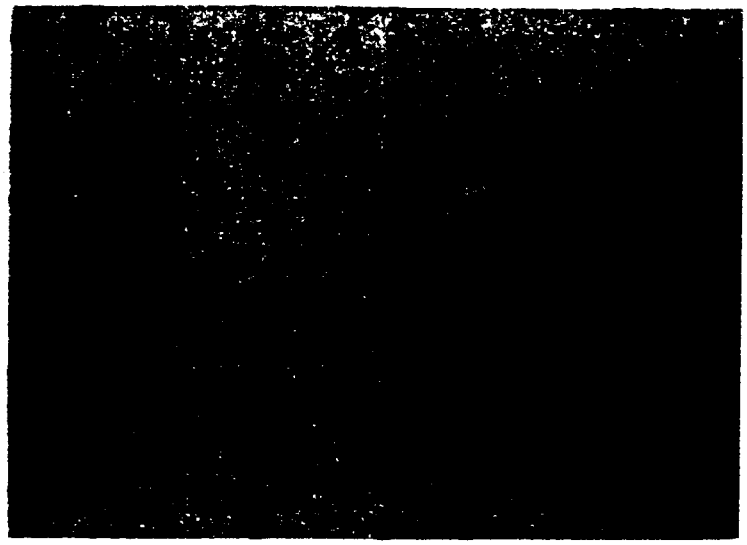
FIGS. 26A and 26B are photomicrographs of textures of an Fe-based casting material according to a comparative example 3.
Figure 26B:
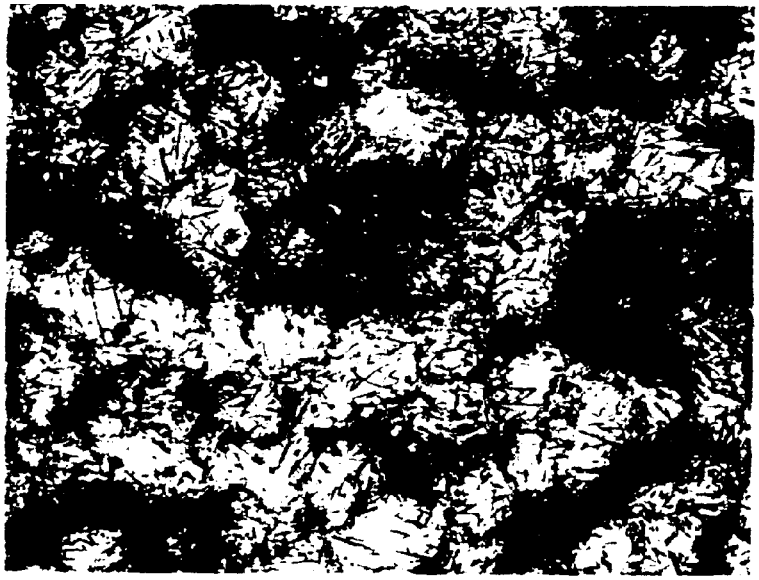

FIGS. 21A and 21B; 23A and 23B; and 25A and 25B are photomicrographs of textures of the Fe-based casting materials according to the examples 1 to 3, respectively. FIGS. 22A and 22B; 24A and 24B; and 26A and 26B are photomicrographs of textures of the Fe-based casting materials according to the comparative examples 1 to 3, respectively. In each of these Figures, an etching treatment was carried out using a 5% niter liquid.

As apparent from Table 5 and FIGS. 21A to 25B, in the examples 1 to 3, the solid phases were spheroidized and hence, the dendrite phases disappeared, due to the fact the heating rate Rh exceeded the corresponding minimum value Rh (min), as also shown in FIG. 15.

On the other hand, as apparent from Table 5 and FIGS. 22A to 26B, in the comparative examples 1 to 3, the dendrite phases remained and hence, the spheroidization of the solid phases was not performed, due to the fact that the heating rate Rh was lower than the corresponding minimum value Rh (min), as also shown in FIG. 15.

(2) An Fe-based casting material similar to the Fe-based casting material having the mean DAS2 D of 76 μm and used in the example 3 in the above-described item (1) was prepared and induction heated to 1220° C. with the heating rate Rh between the eutectoid temperature and the eutectic temperature being set at a value equal to 103° C./min, thereby producing a semi-molten Fe-based casting material having a solid rate R equal to 70%.

Then, the temperature of the stationary and movable dies 2 and 3 in the pressure casting apparatus 1 shown in FIG. 1 was controlled, and the semi-molten Fe-based casting material 5 was placed into the chamber 6. The pressing plunger 9 was operated to fill the Fe-based casting material 5 into the cavity 4. In this case, the filling pressure for the semi-molten Fe-based casting material 5 was 36 MPa. A pressing force was applied to the semi-molten Fe-based casting material 5 filled in the cavity 4 by retaining the pressing plunger 9 at the terminal end of a stroke, and the semi-molten Fe-based casting material 5 was solidified under the application of the pressure to provide an Fe-based cast product.

Figure 27:
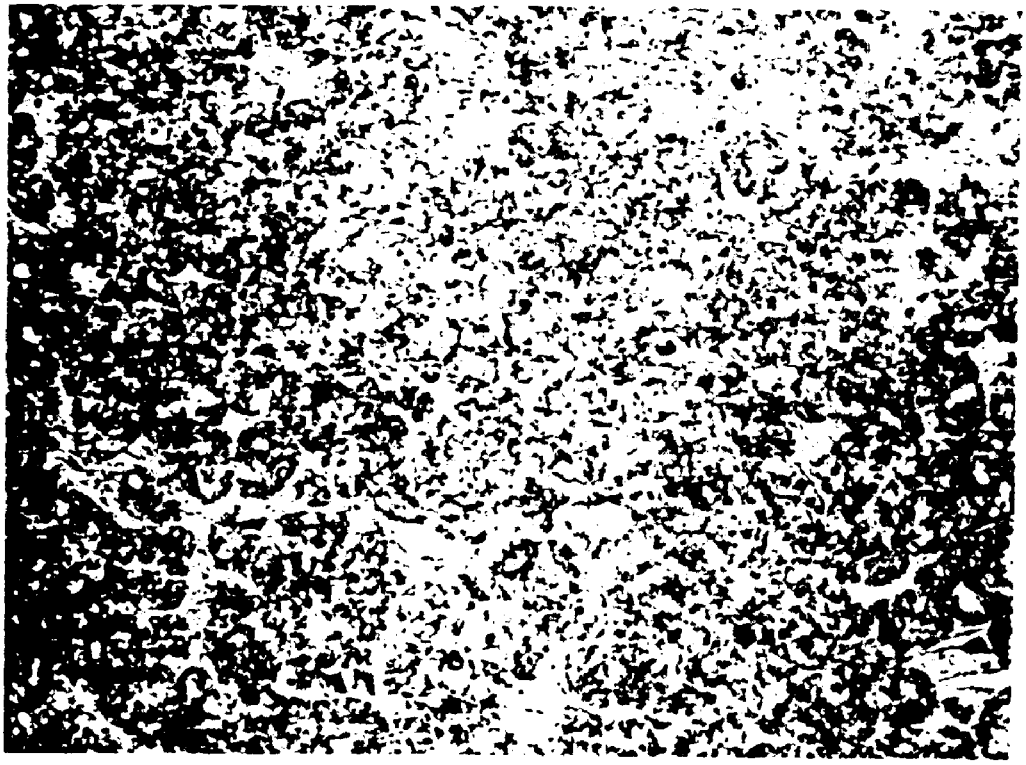
FIG. 27 is a photomicrograph of a texture of an Fe-based cast product.

FIG. 27 is a photomicrograph of a texture of the Fe-based cast product. It can be seen from FIG. 27 that the metal texture is uniform and spherical texture.

Thereafter, the Fe-based cast product was subject to a thermal treatment under conditions of 800° C., 60 minutes and a heating/air-cooling.

Table 6 shows the mechanical properties of the Fe-based cast product resulting from the thermal treatment, the Fe-based casting material used for producing such the Fe-based cast product in the casting process, and other materials.

TABLE 6

| | Fatigue strength 10e70B10 (MPa) | Hardness (HB) | Young's modulus (GPa) | Yield stress 0.2% (MPa) | Tensile strength (Mpa) | Charpy impact value (J/cm$^2$) |
|---|---|---|---|---|---|---|
| Fe-based cast product (thermally-treated) | 284 | 215 | 193 | 528 | 739 | 6.2 |
| Fe-based casting material | 111 | 232 | 142 | 308 | 303 | 9.5 |
| Carbon steel for structure | 277 | 225 | 205 | 570 | 840 | 35 |
| Spherical graphite cast iron | 234 | 174 | 162 | 322 | 531 | 15 |
| Gray cast iron | 71 | 166 | 98 | — | 223 | 1.1 |

As apparent from Table 6, the thermally-treated Fe-based cast product has excellent mechanical properties which are more excellent than those of the spherical graphite cast iron (JIS FCD500) and the gray cast iron (JIS FC250) and substantially comparable to those of the carbon steel for structure (corresponding to JIS S48C).

In an Fe—C—Si based hypoeutectic alloy, C and Si are concerned with the eutectic crystal amount. To control the eutectic crystal amount to 50% or less, the content of C is set in a range of 1.8% by weight≦C≦2.5% by weight, and the content of Si is set in a range of 1.0% by weight≦Si≦3.0% by weight. Thus, it is possible to produce an Fe-based cast product (thermally treated) having excellent mechanical properties as described above.

However, if the content of C is lower than 1.8% by weight, the casting temperature must be risen even if the content of Si is increased and the eutectic crystal amount is increased. For this reason, the advantage of the thixocasting is reduced. On the other hand, if C>2.5% by weight, the graphite amount is increased and hence, the effect of the thermal treatment of the Fe-based cast product is small. Therefore, it is impossible to enhance the mechanical properties of the Fe-based cast product as described above.

If the content of Si is lower than 1.0% by weight, the rising of the casting temperature is brought about as in the case where C<1.8% by weight. On the other hand, if Si>3.0% by weight, silico-ferrite is produced and hence, it is impossible to enhance the mechanical properties of the Fe-based cast product.

It is desirable that the solid phase rate R of the semi-molten Fe-based casting material is equal to or higher than 50% (R≦50%). Thus, the casting temperature can be shifted to a lower temperature range to prolong the life of the pressure casting apparatus. If the solid phase rate R is lower than 50%, the liquid phase amount is increased. For this reason, when a short columnar semi-molten Fe-based casting material is transported in a longitudinal attitude, the self-supporting property of the material is degraded, and the handlability of the material is also degraded.

Figure 28:
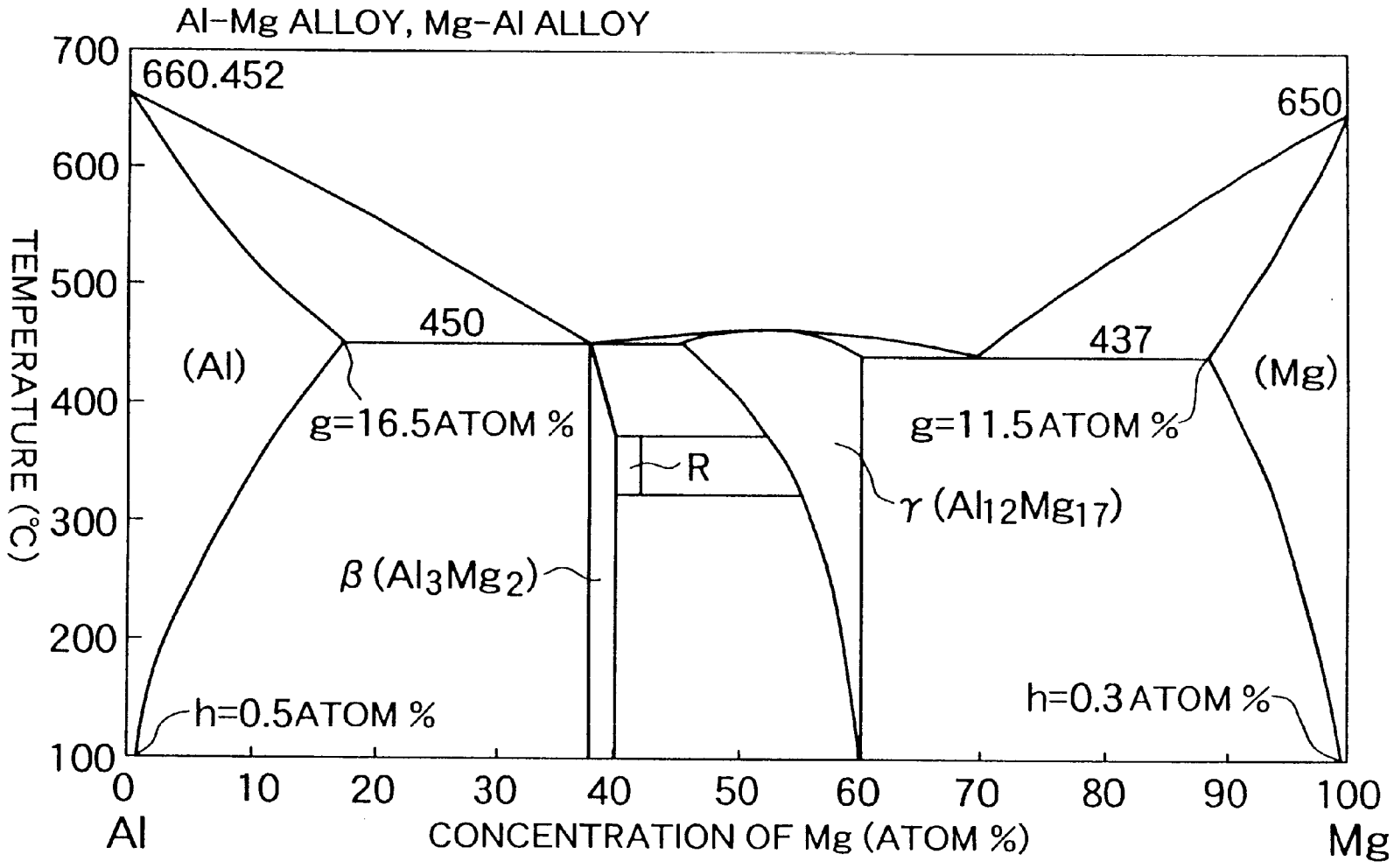
FIG. 28 is state diagram of an Al—Mg alloy and an Mg—Al alloy.
Figure 29:
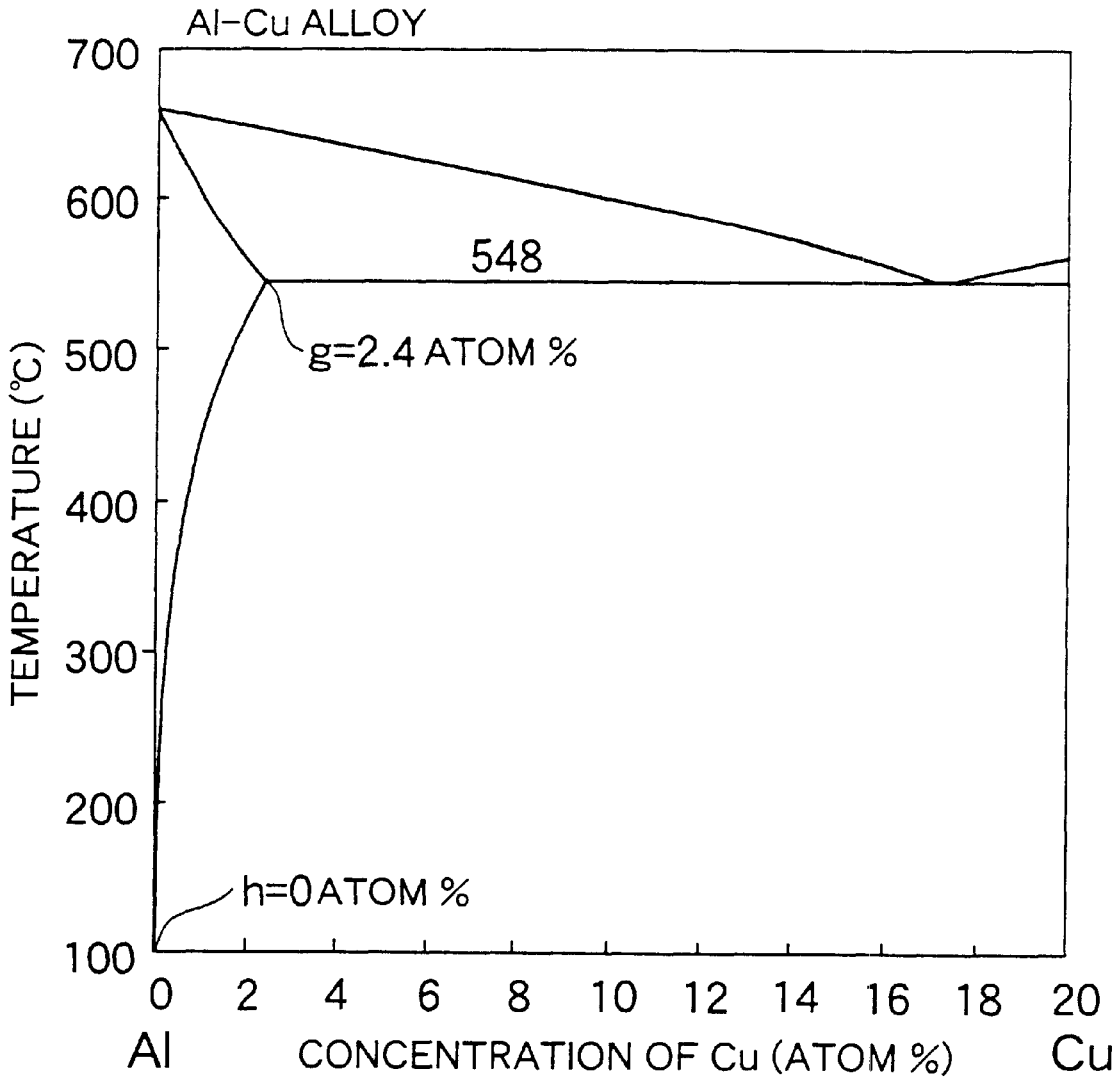
FIG. 29 is state diagram of an Al—Cu alloy.
Figure 30:
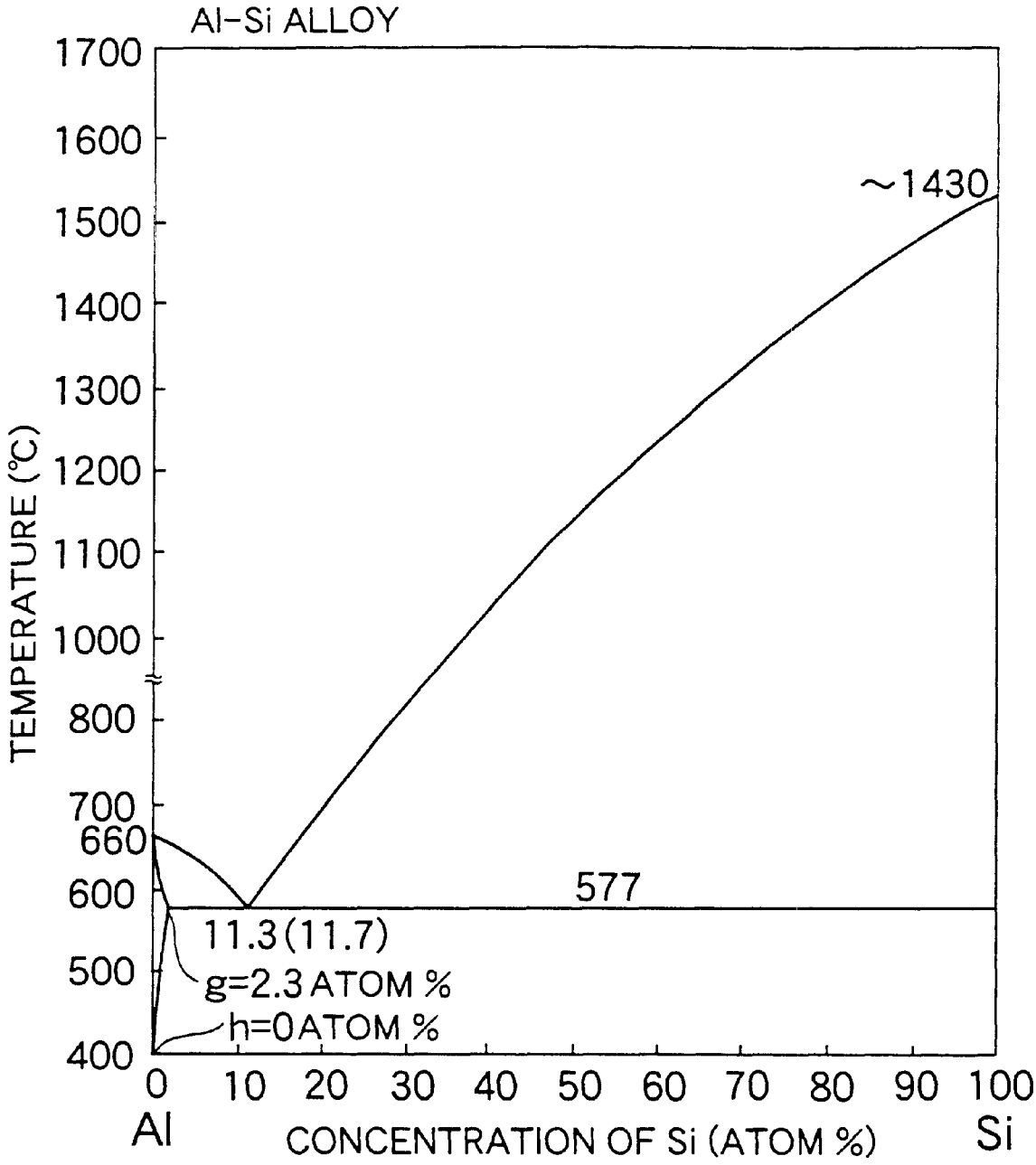
FIG. 30 is state diagram of an Al—Si alloy.

FIG. 28 shows a state diagram of an Al—Mg alloy and an Mg—Al alloy; FIG. 29 shows a state diagram of an Al—Cu alloy; and FIG. 30 shows a state diagram of an Al—Si alloy. Table 7 shows the base metal constitute, the alloy constitute, the maximum solid-solution amount g of alloy constitute solubilized into the base metal constitute and the temperature providing the maximum solid-solution amount, the minimum solid-solution amount h and the temperature providing the minimum solid-solution amount, and the difference g-h for the alloys.

TABLE 7

| Alloy | Base metal constitute | Alloy constitute | Maximum solid-solution amount g (atom %) | Maximum solid-solution amount Temperature (° C.) | Minimum solid-solution amount h (atom %) | Minimum solid-solution amount Temperature (° C.) | Difference g − h (atom %) |
|---|---|---|---|---|---|---|---|
| Al—Mg | Al | Mg | 16.5 | 450 | 0.5 | 100 | 16 |
| Mg—Al | Mg | Al | 11.5 | 437 | 0.3 | 100 | 11.2 |
| Al—Cu | Al | Cu | 2.4 | 548 | 0 | 100 | 2.4 |
| Al—Si | Al | Si | 2.3 | 577 | 0 | 400 | 2.3 |

It can be seen from Table 7 that the Al—Mg alloy and the Mg—Al alloy meet the requirement for the difference g-h equal to or higher than 3.6 atom %, but the Al—Cu alloy and the Al—Si alloy do not meet such requirement.

Figure 31A:
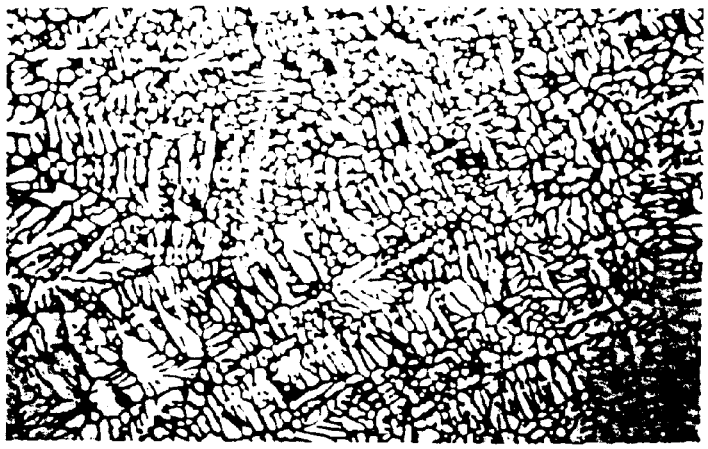
FIGS. 31A to 31C are photomicrographs of textures of an Al—Si based casting material in various states.

FIG. 31A is a photomicrograph of a texture of an Al—Si based casting material comprised of an Al-(7% by weight) Si alloy. From FIG. 31A, dendrite phases formed of α-Al are observed, and the mean DAS2 D thereof was equal to 16 μm. Therefore, to allow the dendrite phases to disappear, it is necessary to set the heating rate Rh in a range of Rh≦53° C./min from FIG. 15.

Figure 31B:
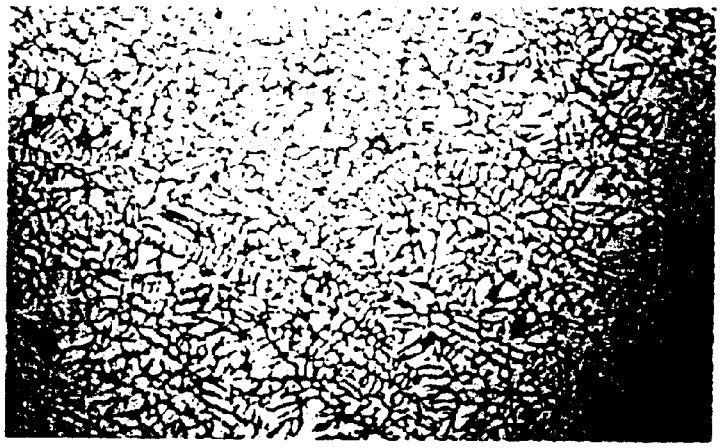

FIG. 31B is a photomicrograph of a texture of an Al—Si based casting material heated to just below the eutectic temperature. This Al—Si based casting material was produced by subjecting the Al—Si based casting material to an induction heating with the heating rate Rh being set at 155° C./min and water-cooling the resulting material at 530° C. It can be seen from FIG. 31B that dendrite phases remained. This is due to the fact that the difference g-h is lower than 3.6 atom %, as shown in Table 7.

Figure 31C:
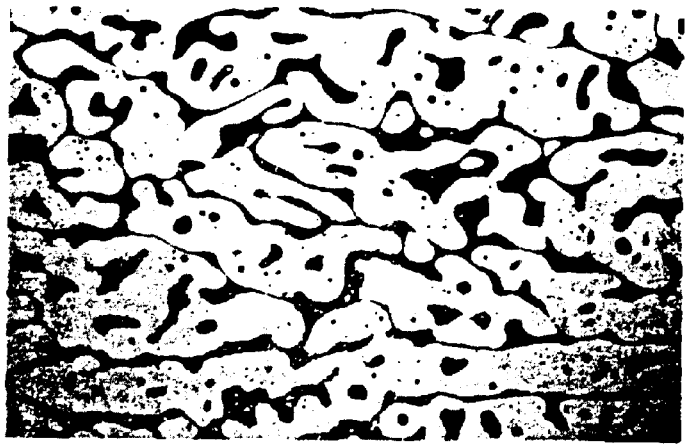

FIG. 31C is a photomicrograph of a texture of an Al—Si based casting material in a semi-molten state. This Al—Si based casting material was produced by subjecting the Al—Si based casting material to an induction heating with the heating rate Rh being likewise set at 155° C./min and water-cooling the resulting material at 585° C. It can be seen from FIG. 31C that dendrite-shaped α-Al phases remained, and the spheroidization thereof was not performed.

EXAMPLE III

Figure 32:
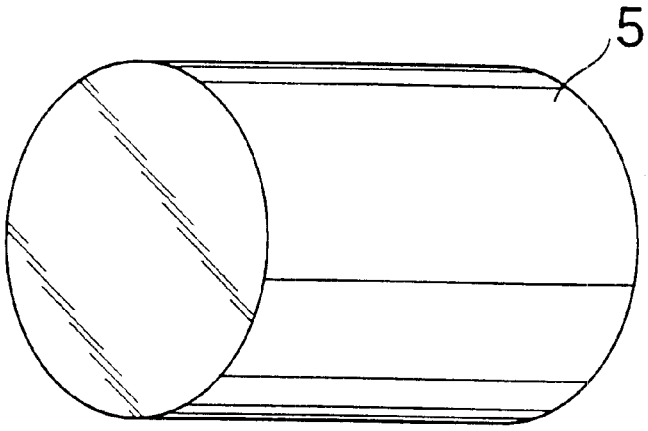
FIG. 32 is a perspective view of an Fe-based casting material.

Short columnar Fe-based casting materials 5 as shown in FIG. 32 are likewise used which are formed of an Fe—C based alloy, an Fe—C—Si based alloy and the like.

Figure 33:
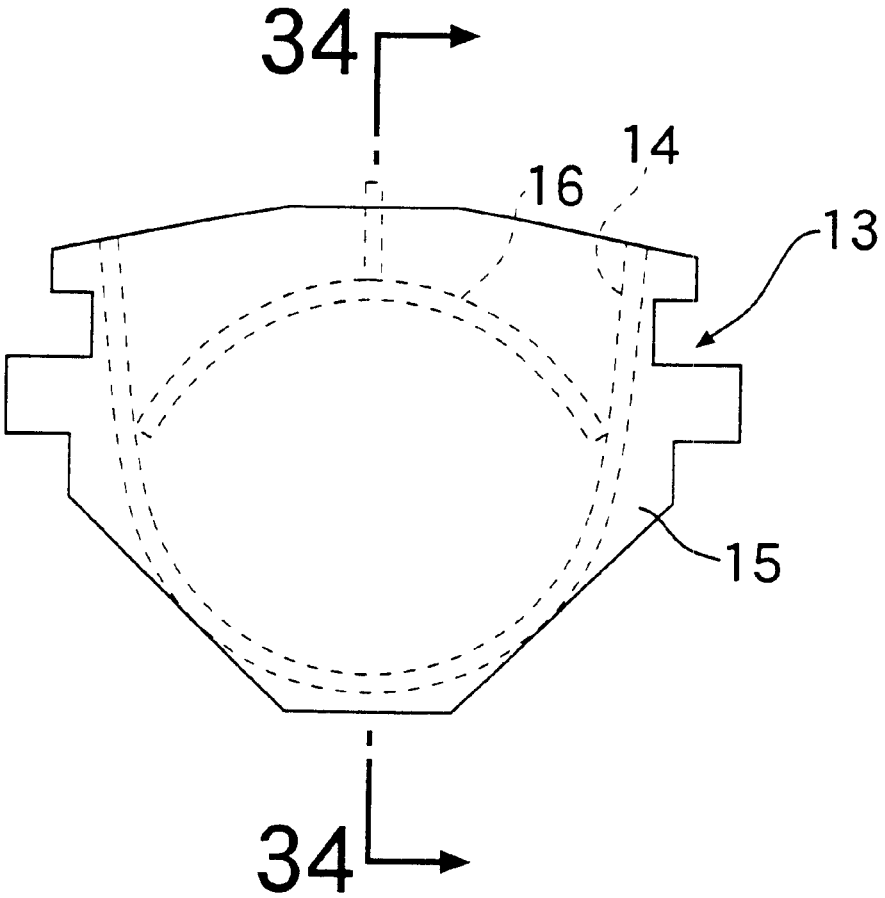
FIG. 33 is a front view of a container.
Figure 34:
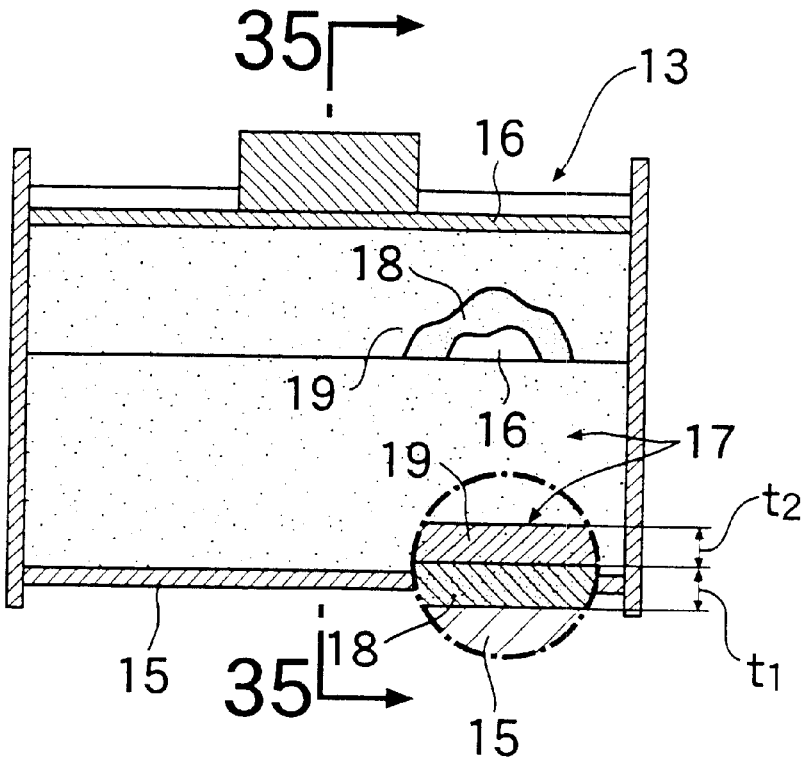
FIG. 34 is a sectional view taken along a line 34—34 in FIG. 33.
Figure 35:
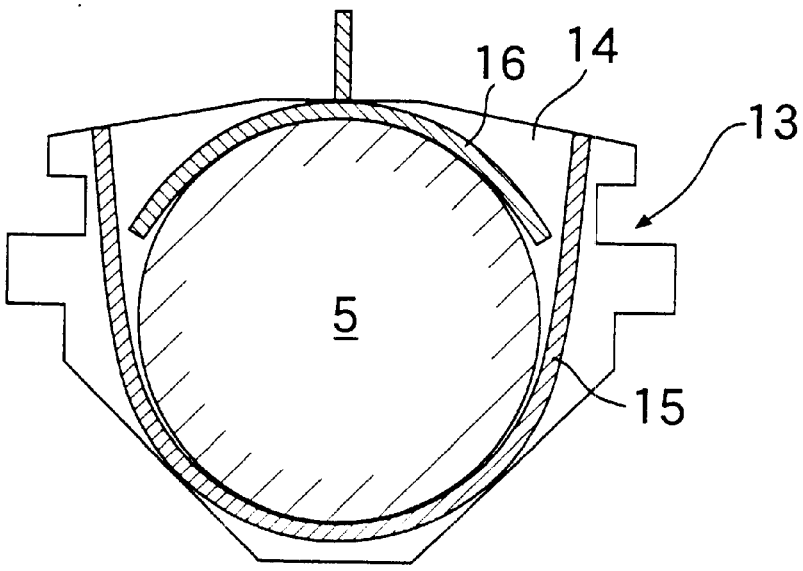
FIG. 35 is a sectional view taken along a line 35–35 in FIG. 34, but showing a state in which the Fe-based casting material has been placed into the container.

A transporting container 13 is used which is comprised of a box-like body 15 having an upward-turned opening 14, and a lid plate 16 leading to the opening 14 and attachable to and detachable from the box-like body 15, as shown in FIGS. 33 to 35.The container 13 is formed of a non-magnetic stainless steel plate (e.g., JIS SUS304) as a non-magnetic metal material, a Ti—Pd based alloy plate or the like.

As best shown in FIG. 34, the container 13 has a laminated skin film 17 on each of inner surfaces of the box-like body 15 and the lid plate 16 for preventing deposition of the semi-molten Fe-based casting material 5. The laminated skin film 17 is closely adhered to each of inner surfaces of the box-like like body 15 and the lid plate 16 and is comprised of an $Si_3N_4$ layer 18 having a thickness $t_1$ in a range of 0.009 mm≦$t_1$≦0.041 mm, and a graphite layer 19 closely adhered to surfaces of the $Si_3N_4$ layer 18 and having a thickness $t_2$ in a range of 0.024 mm≦$T_2$≦0.121 mm.

The $Si_3N_4$ has an excellent heat-insulating property and has characteristics that it cannot react with the semi-molten Fe-based casting material 5 and moreover, it has a good close adhesion to the box-shaped body 15 and the like and is difficult to peel off from the box-shaped body 15. However, if the thickness $t_1$ of the $Si_3N_4$ layer 18 is smaller than 0.009 mm, the layer 18 is liable to peel off. On the other hand, even if the thickness $t_1$ is set in a range of $t_1$>0.041 mm, the effect degree is not varied and hence, such a setting is uneconomical. The graphite layer 19 has a heat resistance and protects the $Si_3N_4$ layer 18. However, if the thickness $t_2$ of the graphite layer 19 is smaller than 0.024 mm, the layer 19 is liable to peel off. On the other hand, even if the thickness $t_2$ is set in a range of $t_2$>0.121 mm, the effect degree is not varied and hence, such a setting is uneconomical.

Particular Example

As shown in FIG. 32, a short columnar material formed of an Fe-2% by weight C-2% by weight Si alloy and having a diameter of 50 mm and a length of 65 mm was produced as an Fe-based casting material 5. This Fe-based casting material 5 was produced in a casting process and has a large number of metallographic dendrite phases. The Curie point of the Fe-based casting material 5 was 750° C.; the eutectic temperature thereof was 1160° C., and the liquid phase line temperature thereof was 1330° C.

A container 13 formed of a non-magnetic stainless steel (JIS SUS304) and having a laminated skin film 17 having a thickness of 0.86 mm was also prepared. In the laminated skin film 17, the thickness $t_1$ of the $Si_3N_4$ layer 18 was equal to 0.24 mm, and the thickness $t_2$ of the graphite layer 19 was equal to 0.62 mm.

As shown in FIG. 4, the Fe-based casting material 5 was placed into the box-like body 15 of the container 13, and the lid plate 6 was placed over the material 5. Then, the container 13 was placed into a lateral induction heating furnace, and a semi-molten Fe-based casting material 5 was prepared in the following manner:

(a) Primary Induction Heating

The temperature of the Fe-based casting material 5 was risen from normal temperature to a Curie point (750° C.) with a frequency $f_1$ being set at 0.75 kHz.

(2) Secondary Induction Heating

The temperature of the Fe-based casting material 5 was risen, with a frequency $f_2$ being set at 1.00 kHz ($f_2$>$f_1$), from the Curie point to a preparing temperature providing a semi-molten state with solid and liquid phases coexisting therein. In this case, the preparing temperature was set at 1220° C. from the fact that the casting temperature was 1200° C.

Thereafter, the container 13 was removed from the induction heating furnace, and the time taken for the temperature of the semi-molten Fe-based casting material 5 to be dropped from the preparing temperature to the casting temperature was measured. The above process is referred to as an embodiment.

For comparison, the temperature of an Fe-based casting material 5 similar to that described above was risen from normal temperature to the preparing temperature by conducting an induction heating with a frequency set at 0.75 kHz (constant). Thereafter, the container 13 was removed from the induction heating furnace, and the time taken for the temperature of the semi-molten Fe-based casting material 5 to be dropped from the preparing temperature to the casting temperature was measured. The above process is referred to as a comparative example 1.

Further, for comparison, the temperature of an Fe-based casting material 5 similar to that described above was risen from normal temperature to the preparing temperature by conducting an induction heating with a frequency set at 1.00 kHz (constant). Thereafter, the container 13 was removed from the induction heating furnace, and the time taken for the temperature of the semi-molten Fe-based casting material 5 to be dropped from the preparing temperature to the casting temperature was measured. The above process is referred to as a comparative example 2.

Figure 36:
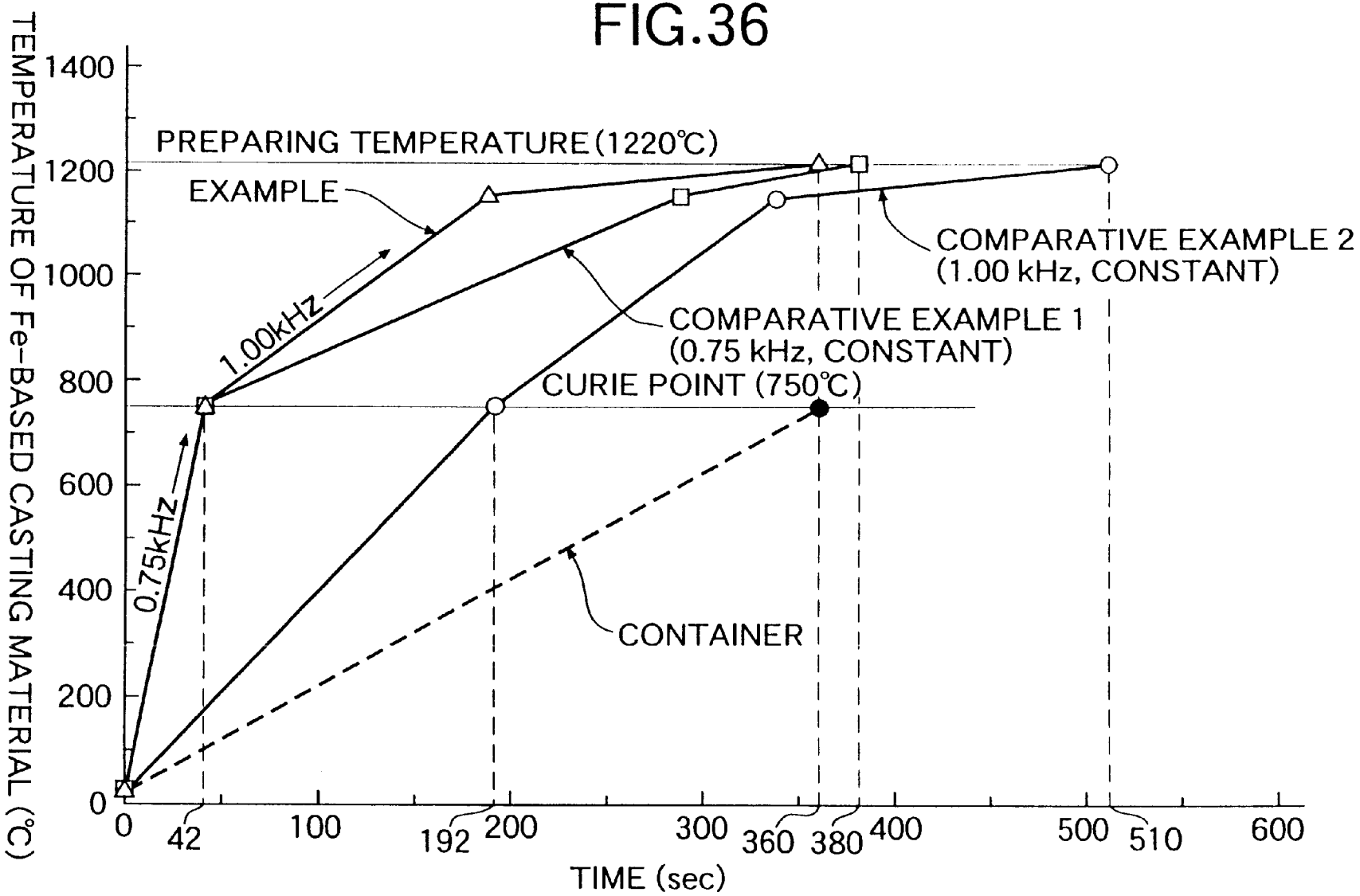
FIG. 36 is a graph illustrating the relationship between the time at a temperature rising stage and the temperature of the Fe-based casting material.

Table 8 shows the time taken for the temperature of the Fe-based casting material 5 to reach the Curie point, the preparing temperature and the casting temperature in the example and the comparative examples 1 and 2. FIG. 36 shows the relationship between the time and the temperature of the Fe-based casting material 5 at the temperature rising stage for the example and the comparative examples 1 and 2. The variation in temperature of the container 4 in the example is also shown in FIG. 36. Further, FIG. 37 shows the relationship between the time and the temperature of the Fe-based casting material 5 at the temperature dropping stage for the example and the comparative examples 1 and 2.

TABLE 8

| | Time taken to reach each of temperatures (sec) | | |
|---|---|---|---|
| | Curie point (750° C.) | Preparing temperature (1220° C.) | Casting temperature (1200° C.) |
| Example | 42 | 360 | 30 |
| Comparative Example 1 | 42 | 380 | 18.5 |
| Comparative Example 2 | 192 | 510 | 30 |

Figure 37:
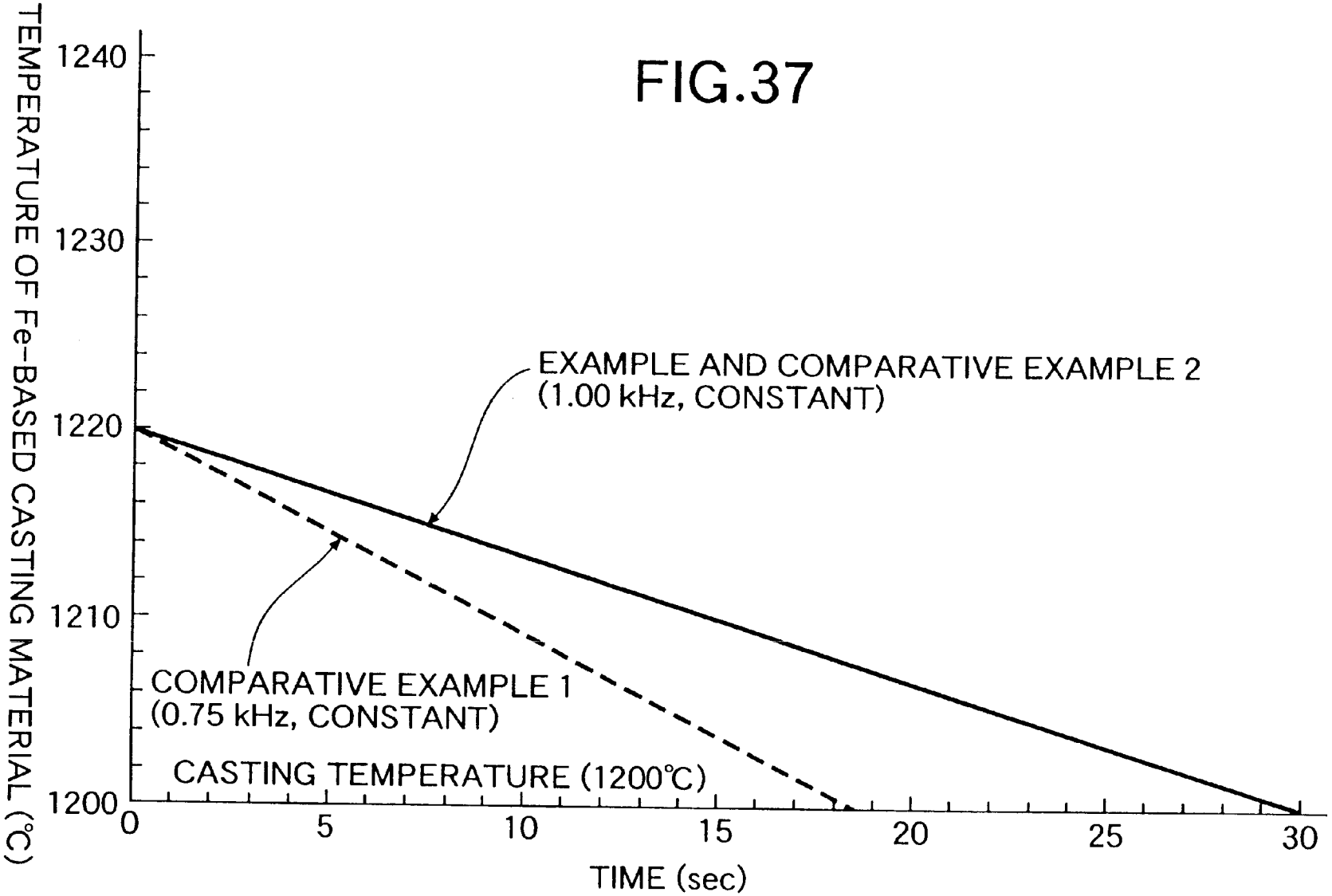
FIG. 37 is a graph illustrating the relationship between the time at a temperature dropping stage and the temperature of the Fe-based casting material.

As apparent from Table 1 and FIGS. 36 and 37, it can be seen that in the example, the time taken for the temperature of the casting material to be risen to the preparing temperature is short and the time taken for the temperature of the casting material to be dropped to the casting temperature is long, as compared with those in the comparative example 2.

In the metal texture of the semi-molten Fe-based casting material 5 in the example, namely, the metal texture provided by quenching the material 5 having the temperature of 1220° C., a large number of solid phases and a liquid phase filling an area between both the adjacent solid phases were observed as in FIG. 17C. The reason why the such metal texture was provided is that the fine division of the dendrite phase was efficiently performed due to the higher heating rate of the Fe-based casting material 5, as apparent from FIG. 36.

In the metal texture of the semi-molten Fe-based casting material 5 in the comparative example 2, namely, the metal texture provided by quenching the material 5 having the temperature of 1220° C., a large amount of dendrite phases were observed as in FIG. 22B. The reason why such metal texture was provided is that the dendrite phases remained and the spheroidization of the solid phases was not performed due to the lower heating rate of the Fe-based casting material 5, as apparent even from FIG. 36.

The frequency $f_1$ in the primary induction heating is in a range of 0.65 kHz$\leqq f_1$<0.85 kHz, preferably, in a range of 0.7 kHz$\leqq f_1 \leqq$0.8 kHz, for the reason that the frequency $f_1$ should be set lower. The frequency $f_2$ in the secondary induction heating is in a range of 0.85 kHz$\leqq f_2 \leqq$1.15 kHz, preferably, in a range of 0.9 kHz$\leqq f_2 \leqq$1.1 kHz, for the reason that the frequency $f_2$ should be set higher.

As a result of the examination of the durability of the laminated skin film 17 in the container 13 in the above-described example, it was found that it is necessary to regenerate the laminated skin film 17 when the preparation of the semi-molten Fe-based casting material 5 has been carried out 20 runs. In this way, the laminated skin film 17 of the above-described configuration has an excellent durability and hence, is effective for enhancing the producibility.

EXAMPLE IV

Table 9 shows the contents of C and Si (the balance is iron including inevitable impurities), the eutectic crystal amount Ec, the liquid phase line temperature, the eutectic temperature and the eutectoid transformation-completed temperature for examples 1 to 9 of the casting material each formed of an Fe—C—Si based alloy.

TABLE 9

| Example of casting material | Content (% by weight) C | Content (% by weight) Si | Eutectic crystal amount Ec (% by weight) | Liquid phase line temperature (° C.) | Eutectic temperature (° C.) | Eutectoid transformation-completed temperature (° C.) |
|---|---|---|---|---|---|---|
| 1 | 2 | 1.5 | 12 | 1343 | 1161 | 771 |
| 2 | 2 | 2 | 17 | 1330 | 1160 | 790 |
| 3 | 1.8 | 3 | 18 | 1322 | 1167 | 820 |
| 4 | 2.4 | 3 | 47 | 1263 | 1168 | 821 |
| 5 | 2.5 | 2.5 | 48 | 1267 | 1166 | 802 |
| 6 | 2.6 | 2.6 | 52 | 1255 | 1166 | 806 |
| 7 | 2.5 | 3 | 52 | 1254 | 1168 | 821 |
| 8 | 2.8 | 2.5 | 65 | 1238 | 1166 | 802 |
| 9 | 3.4 | 3 | 100 | 1169 | 1169 | 826 |

First, using the examples 1 to 8 of the casting materials, examples 1 to 8 of cast products corresponding to the examples 1 to 8 of the material were produced by utilizing a thixocasting process which will be described below.

(a) First Step

The casting material 5 was induction-heated to 1220° C. to prepare a semi-molten casting material 5 with solid and liquid phases coexisting therein. The solid phase rate R of this material 5 was equal to 70%. Then, the temperature of the stationary and movable dies 2 and 3 in the pressure casting apparatus 1 shown in FIG. 1 was controlled. The semi-molten casting material 5 was placed into the chamber 6, and the pressing plunger 9 was operated to fill the casting material 5 into the cavity 4. In this case, the filling pressure for the semi-molten casting material 5 was 36 MPa.

(b) Second Step

A pressing force was applied to the semi-molten casting material 5 filled in the cavity 4 by retaining the pressing plunger 9 at the terminal end of a stroke, and the semi-molten casting material 5 was solidified under the application of such pressing force to provide a cast product. In this case, the mean solidifying rate Rs for the semi-molten casting material 5 was set at 600° C./min.

(C) Third Step

The cast product was cooled down to about 400° C. and then, released from the mold. In this case, the mean cooling rate Rc to the eutectoid transformation-completed temperature range for the cast product was set in a range of Rc≦1304° C./min. The eutectoid transformation-completed temperatures of the examples 1 to 8 of the cast products are as shown in Table 9, and a temperature about 100° C. lower than the eutectoid transformation-completed temperature and a temperature near such temperature are defined as being the eutectoid transformation-completed temperature range.

Then, using the example 9 of the casting material, an example 9 of a cast product corresponding to the example 9 of the material was produced by utilizing a die-cast process which will be described below.

(a) First Step

The casting material was molten at 1400° C. to prepare a molten metal having a solid phase rate of 0%. Then, the temperature of the stationary and movable dies 2 and 3 in the pressure casting apparatus 1 shown in FIG. 1 was controlled, and the molten metal was retained into the chamber 6. The pressing plunger 9 was operated to fill the molten metal into the cavity 4. In this case, the filling pressure for the molten metal was 36 MPa.

(b) Second Step

A pressing force was applied to the molten metal filled in the cavity 4 by retaining the pressing plunger 9 at the terminal end of a stroke, and the molten metal was solidified under the application of the pressing force to provide a cast product. In this case, the mean solidifying rate Rs for the molten metal was set at 600° C./min.

(C) Third Step

The cast product was cooled to about 400° C. and released from the mold. In this case, the mean cooling rate Rc to the eutectoid transformation-completed temperature range for the cast product was likewise set in a range of Rc≦1304° C./min.

The area rate $A_1$ of graphite in the examples 1 to 9 of the cast products, namely, the as-cast products was measured.

Each of the examples 1 to 9 of the as-cast products was subjected to a thermal treatment to perform the fine spheroidization of the carbide, mainly, the cementite and then, for each of examples 1 to 9 of the cast products resulting from the thermal treatment, namely, the thermally treated products, the area rate $A_2$ of graphite was measured, and the Young's modulus E, the tensile strength and the hardness were determined.

Table 10 shows thermally treating conditions for the as-cast products.

TABLE 10

| Example of cast product | Thermally treating conditions: Temperature (° C.) | Time (min) | Cooling |
|---|---|---|---|
| 1 | 800 | 60 | Air-cooling |
| 2 | | | |
| 3 | 850 | | |
| 4 | | | |
| 5 | | | |
| 6 | | | |
| 7 | | | |
| 8 | | | |
| 9 | 1000 | | |

Table 11 shows the area rate $A_1$ of graphite in the examples the as-cast product, as well as the area rate $A_2$ of in the examples 1 to 9 of the thermally-treated the Young's modulus E, the tensile strength and the hereof.

TABLE 11

| Example of cast product | Area rate $A_1$ of graphite in as-cast product (%) | Thermally-treated product: Area rate $A_2$ of graphite (%) | Young's modulus E(GPa) | Tensile strength (MPa) | Hardness HB |
|---|---|---|---|---|---|
| 1 | 0.3 | 1.4 | 200 | 871 | 297 |
| 2 | 0.4 | 2 | 197 | 739 | 215 |
| 3 | 1 | 2.4 | 194 | 622 | 209 |
| 4 | 4.7 | 7.8 | 173 | 610 | 200 |
| 5 | 4.9 | 7.9 | 171 | 600 | 195 |
| 6 | 5.1 | 8.2 | 168 | 590 | 185 |
| 7 | 5.3 | 8.5 | 166 | 580 | 175 |
| 8 | 7.6 | 9.8 | 165 | 574 | 170 |
| 9 | 11.5 | 11.7 | 98 | 223 | 166 |

Figure 38:
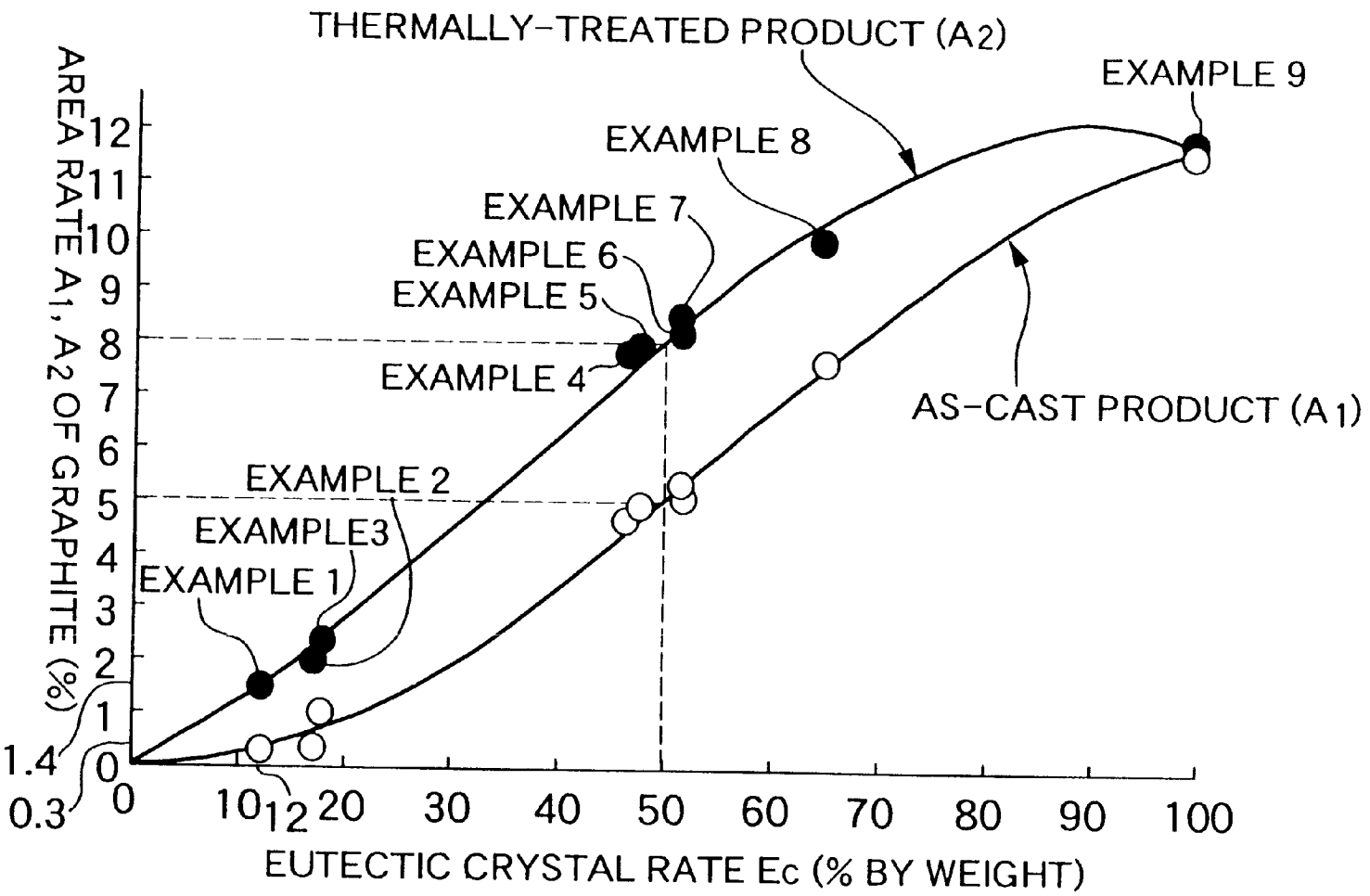
FIG. 38 is a graph illustrating the relationship between the eutectic crystal amount Ec and the area rates $A_1$ and $A_2$ of graphite phases.

FIG. 38 is a graph taken based on Tables 9 and 11 and illustrating the relationship between the eutectic crystal amount Ec and the area rates $A_1$ and $A_2$ of graphite in the as-cast products and the thermally-treated products. It can be seen from FIG. 38 that if the as-cast product is subjected to the thermal treatment, the amount of graphite is increased.

Figure 39:
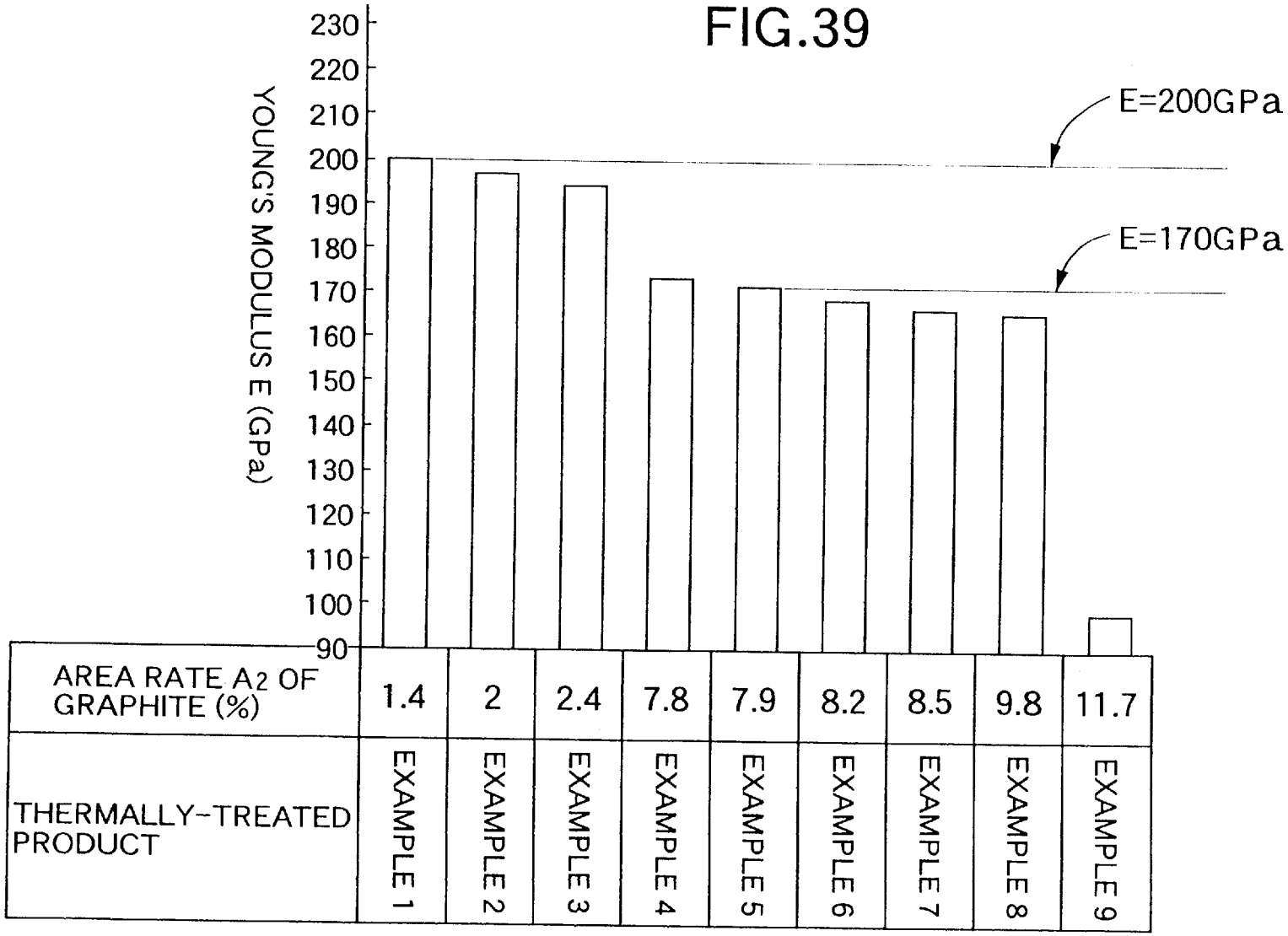
FIG. 39 is a graph showing Young's modulus E of various cast products (thermally-treated products)

FIG. 39 is a graph taken based on Table 10 and illustrating the relationship between the area rate $A_2$ of graphite and the Young's modulus E for the examples 1 to 9 of the thermally-treated products.

As apparent from FIG. 39, if the area rate $A_2$ of graphite is set in a range of $A_2<8\%$, the Young's modulus E can be reliably increased to a level of $E\leqq 170$ GPa larger than that (E=162 GPa) of a spherical graphite cast iron, as in the examples 1 to 5 of the thermally-treated products. To realize this, it is required that the area rate $A_1$ of graphite in the as-cast product is set in a range of $A_1<5\%$ at the eutectic crystal amount Ec lower than 50% by weight, as shown in FIG. 38.

In addition, as apparent from FIG. 39, if the area rate $A_2$ of graphite is set in a range of $A_2\leqq 1.4\%$, the Young's modulus E can be increased to a level of $E\leqq 200$ GPa as high as that (E=202 GPa) of a carbon steel for a mechanical structure, as in the example 1 of the thermally-treated product. To realize this, it is required that the area rate $A_1$ of graphite in the as-cast product is set in a range of $A_1\leqq 0.3\%$ at the eutectic crystal amount Ec lower than 50% by weight, as shown in FIG. 38.

Then, a thixocasting process of the casting material similar to that described above was carried out using the example 2 of the casting material to examine the relationship between the mean solidifying rate Rs as well as the mean cooling rate Rc and the area rate $A_1$ of graphite, thereby providing results shown in Table 12.

TABLE 12

| Example of cast product | Mean solidifying rate Rs (° C./min) | Mean cooling rate Rc (° C./min) | Area rate $A_1$ of graphite (%) |
|---|---|---|---|
| 2 | 600 | 1304 | 0.4 |
| $2_1$ | 565 | 1250 | 2 |
| $2_2$ | 525 | 1040 | 4 |
| $2_3$ | 500 | 900 | 4.9 |
| $2_4$ | 400 | 659 | 6.1 |
| $2_5$ | 343 | 583 | 7 |
| $2_6$ | 129 | 91 | 8.2 |

Figure 40:
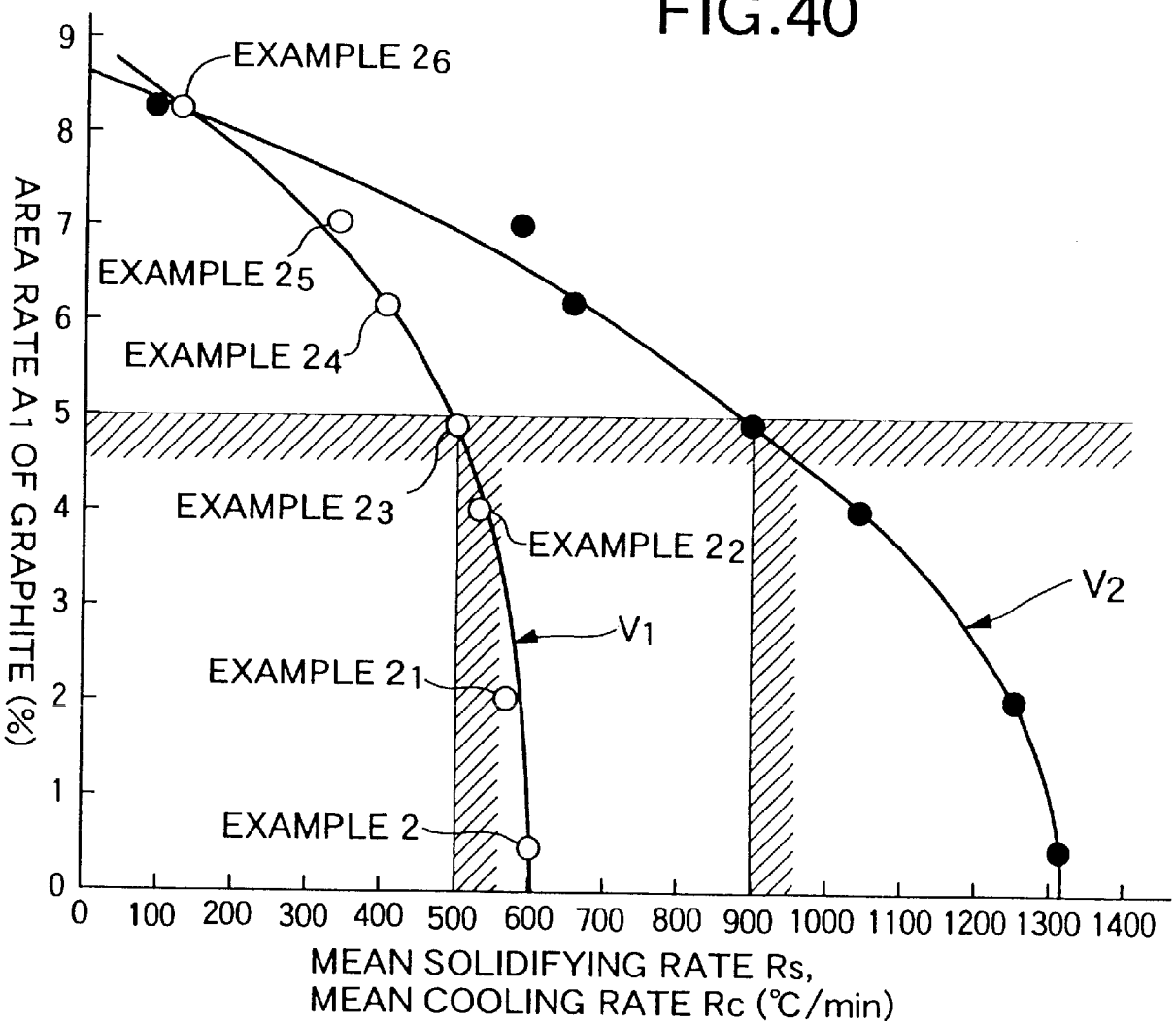
FIG. 40 is a graph illustrating the relationship between the mean solidifying rate Rs as well as the mean cooling rate Rc and the area rate $A_1$ of graphite phases.

FIG. 40 is graph taken based on Table 12 and illustrating the relationship between the mean solidifying rate Rs as well as the mean cooling rate Rc and the area rate $A_1$ of graphite. As apparant from FIG. 40, to bring the area rate $A_1$ of graphite in the as-cast product into a value lower than 5%, it is required that the mean solidifying rate Rs is set in a range of $Rs\geqq 500°$ C./min and the mean cooling rate Rc is set in a range of $Rc\geqq 900°$ C./min. A higher mean solidifying rate Rs as described above is achieved by use of a mold having a high coefficient of thermal conductivity such as a metal mold and a graphite mold and the like.

Figure 41:
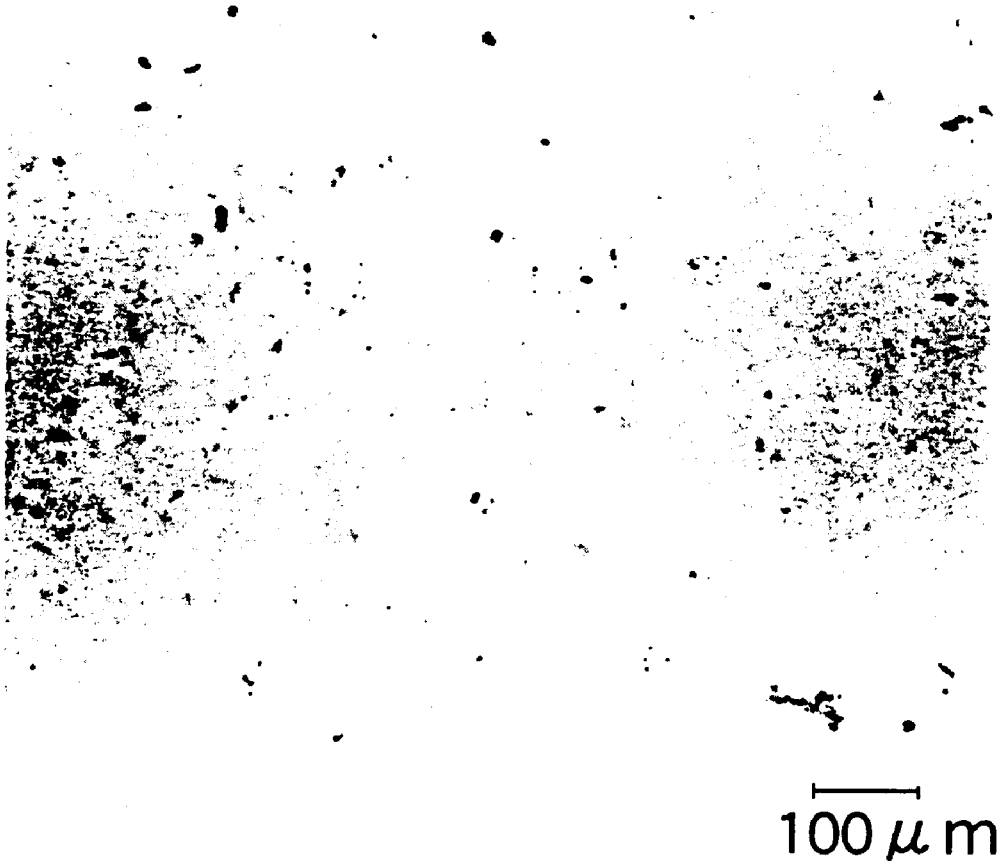
FIG. 41 is a photomicrograph of a texture of an example 2 of an Fe-based cast product (as-cast product) after being polished.
Figure 42A:
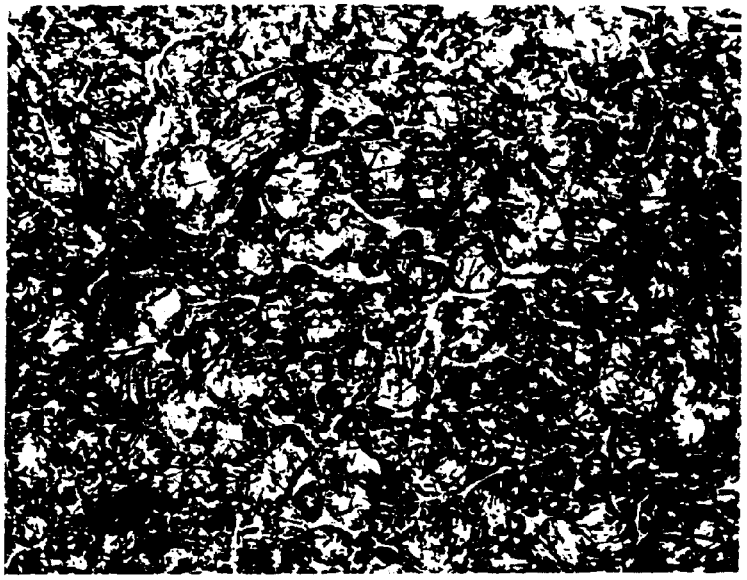
FIG. 42A is a photomicrograph of a texture of the example 2 of the Fe-based cast product (as-cast product) after being etched.
Figure 42B:
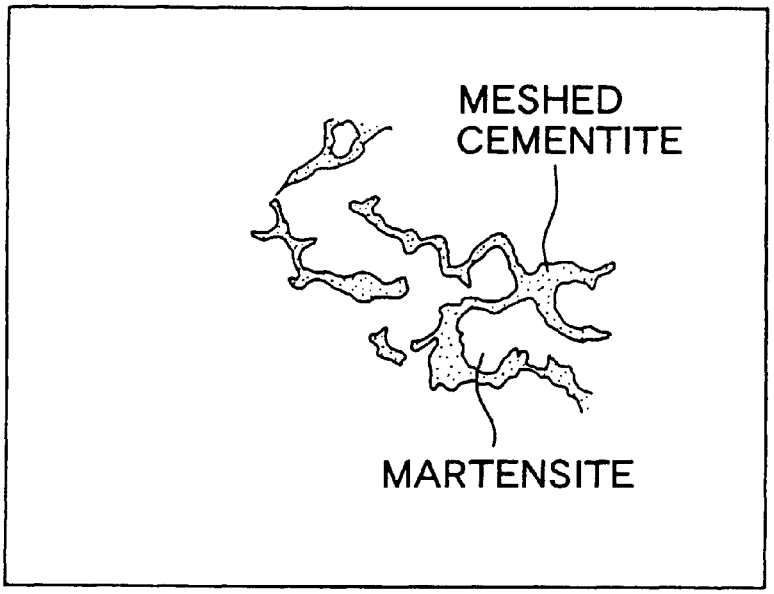
FIG. 42B is a tracing of an essential portion shown in FIG. 42A.

FIGS. 41 and 42A are photomicrographs of a texture of the f the as-cast product. FIG. 41 corresponds to the as-cast product after being polished, and FIG. 42A corresponds to the as-cast product after being etched by a niter liquid. In FIG. 41, black point-shaped portions are fine graphite portions, and the area rate $A_1$ of graphite is equal to 0.4%. In FIGS. 42A and 42B, it is observed that meshed cementite portions exist to surround island-shaped martensite portions.

Figure 43:
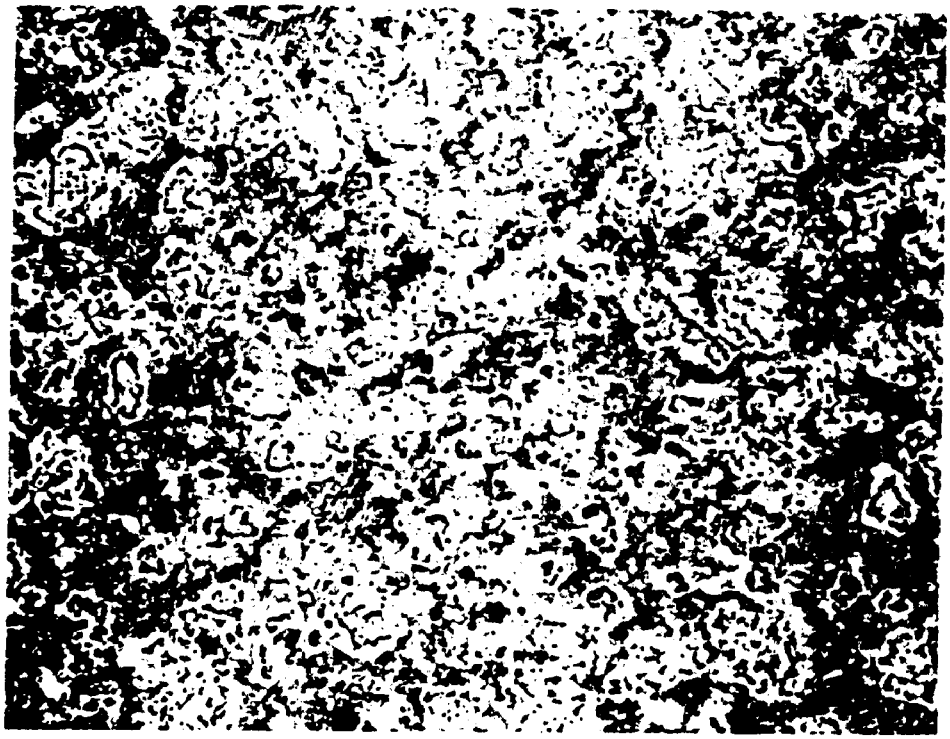
FIG. 43 is a photomicrograph of a texture of an example 2 of an Fe-based cast product (a thermally-treated product)

FIG. 43 is a photomicrograph of a texture of the example 2 (see Table 11) of the thermally-treated product provided by subjecting the example 2 of the as-cast product to the thermal treatment. In FIG. 43, black point-shaped and black line-shaped portions are graphite portions, and the area rate $A_2$ of graphite is equal to 2%. A light gray portion is a ferrite portion, and a dark gray laminar portion is a pearlite portion.

Figure 44A:
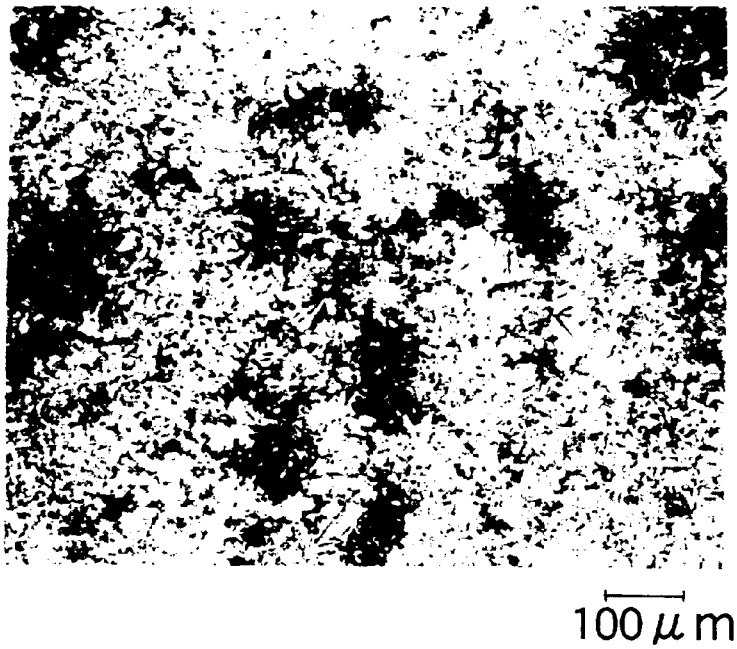
FIG. 44A is a photomicrograph of a texture of an example 24 of an Fe-based cast product (as-cast product) after being etched.
Figure 44B:
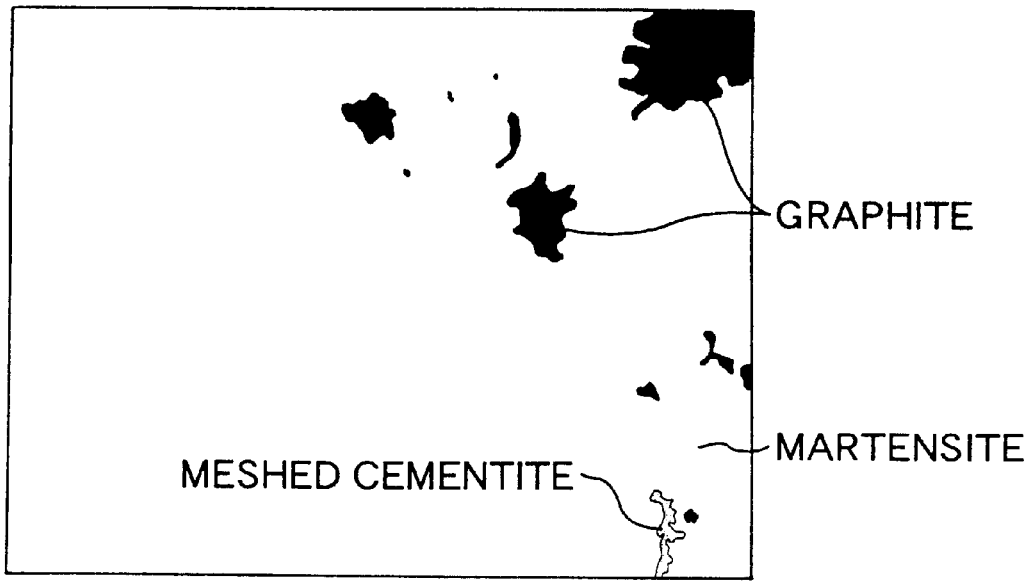
FIG. 44B is a tracing of an essential portion shown in FIG. 44A.

FIG. 44A is a photomicrograph of a texture of the example 24 of the as-cast product after being etched by a niter liquid. In FIGS. 44A and 44B, a small amount of meshed cementite portions and a relatively large amount of large and small graphite portions are observed. The area rate $A_1$ of graphite in this case is equal to 6.1%.

Figure 45:
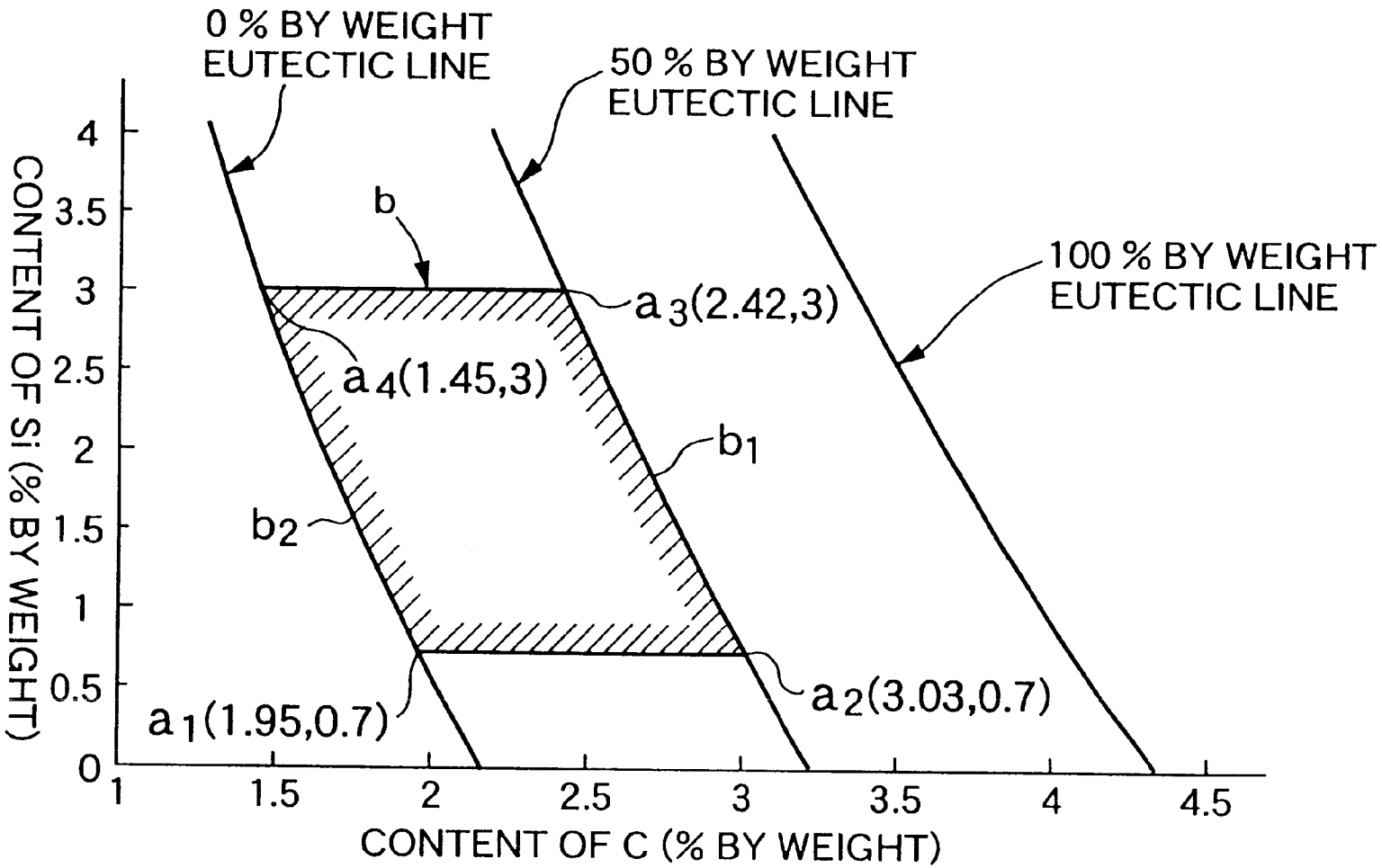
FIG. 45 is a graph illustrating the relationship between the contents of C and Si and the eutectic crystal amount Ec.

FIG. 45 shows the relationship between the contents of C and Si and the eutectic crystal amount Ec in a casting material formed of an Fe—C—Si based alloy.

Used as a casting material according to the present invention is an Fe—C—Si based alloy which is comprised of 1.45% by weight<C<3.03% by weight, 0.7% by weight≦Si≦3% by weight and the balance of Fe containing inevitable impurities and which has an eutectic crystal amount Ec lower than 50% by weight. The range of this composition is within an area of a substantially parallelogram figure provided by connecting a coordinate point $a_1$ (1.95, 0.7), a coordinate point $a_2$ (3.03, 0.7), a coordinate point $a_3$ (2.42, 3) and a coordinate point $a_4$ (1.45, 3), a coordinate point as (1.8, 3), when the content of C is taken on an x axis and the content of Si is taken on y axis in FIG. 45. However, compositions at the points $a_2$ and $a_3$ existing on the 50% by weight eutectic line and on a line segment $b_1$ connecting the points $a_2$ and $a_3$ and at the points $a_1$ and $a_4$ existing on the 0% by weight eutectic line and on a line segment $b_2$ connecting the points $a_1$ and $a_4$ are excluded from the compositions on that profile b of such figure which indicates a limit of the composition range.

However, if the eutectic crystal amount Ec is equal to or higher than 50% by weight, the amount of graphite is increased. On the other hand, if Ec=0% by weight, the carbide is not produced. If the content of Si is smaller than 0.7% by weight, the rising of the casting temperature is brought about. On the other hand, if Si>3% by weight, silico-ferrite is produced and hence, the mechanical properties of a produced cast product tend to be reduced.

EXAMPLE V

Table 13 shows the composition of an Fe-based casting material. This composition belongs to an Fe—C—Si based hypoeutectic alloy. P and S in Table 13 are inevitable impurities. The eutectoid temperature Te of this alloy is equal to 770° C. (see FIG. 12).

TABLE 13

| | Chemical constituent (% by weight) | | | | | |
|---|---|---|---|---|---|---|
| | C | Si | Mn | P | S | Fe |
| Fe-based casting material | 2.00 | 2.03 | 0.65 | 0.002 | 0.006 | Balance |

In producing an Fe-based cast product in a casting process, the Fe-based casting material was induction-heated to 1,200° C. to prepare a semi-molten Fe-based casting material with solid and liquid phases coexisting therein. The solid phase rate R of this material was equal to 70%.

Then, the temperature of the stationary and movable dies 2 and 3 in the pressure casting apparatus 1 shown in FIG. 1 was controlled, and the semi-molten Fe-based casting material 5 was placed into the chamber 6. The pressing plunger 9 was operated to fill the Fe-based casting material 5 into the cavity 4. In this case, the filling pressure for the semi-molten Fe-based casting material 5 was 36 MPa. Then, a pressing force was applied to the semi-molten Fe-based casting material 5 filled in the cavity 4 by retaining the pressing plunger 9 at the terminal end of a stroke, and the semi-molten Fe-based casting material 5 was solidified under the application of such pressing force to provide an Fe-based cast product (an as-cast product).

Figure 46A:
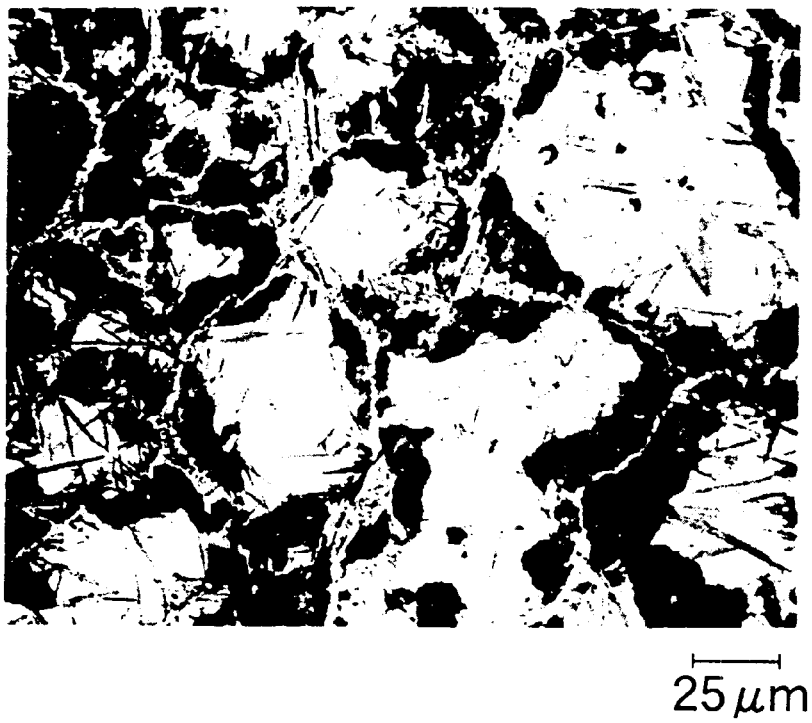
FIG. 46A is a photomicrograph of a texture of an as-cast product.
Figure 46B:
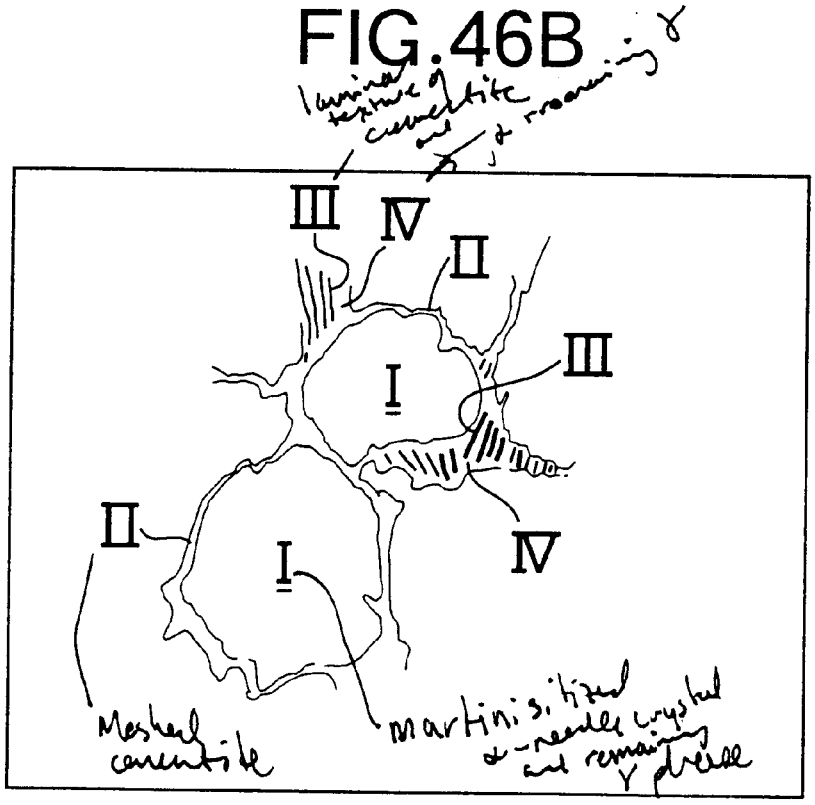
FIG. 46B is a tracing of an essential portion shown in FIG. 46A.

FIG. 46A is a photomicrograph of a texture of the Fe-based as-cast product, and FIG. 46B is a tracing of an essential portion of the photomicrograph. As apparent from FIGS. 46A and 46B, according to the thixocasting process, it is possible to produce an as-cast product free from voids of a micron order or the like and having a dense metal texture. In FIGS. 46A and 46B, a meshed cementite phase II exists at a boundary of each of grains of initial crystal γ, e.g., a massive portion I comprised of a martensitized a-needle crystal and a remaining γ phase in this case, due to quenching from the semi-molten state by the mold, and a laminar texture comprised of branch-shaped cementite phases III and portions IV each comprised of an α-phase and a remaining γ phase is observed in a eutectic crystal portion existing outside the massive portion I.

Then, the Fe-based as-cast product was subjected to a thermal treatment under conditions of the atmospheric pressure, a thermally treating temperature T equal to 770° C. (eutectoid temperature Te), a thermally treating time t equal to 60 minutes and an air-cooling to provide an example 1 of an Fe-based cast product. Examples 2 to 15 of Fe-based cast products were also produced by subjecting the Fe-based as-cast product to a thermal treatment with the thermally treating temperature T and/or the thermally treating time t being varied. Table 14 shows the thermally treating conditions of the examples 1 to 15.

TABLE 14

| | Thermally treating conditions | |
|---|---|---|
| Fe-based cast product | Temperature T (° C.) | Time t (min) |
| Example 1 | 770 | 60 |
| Example 2 | 780 | |
| Example 3 | 800 | |
| Example 4 | 900 | |
| Example 5 | 940 | |

TABLE 14-continued

| | Thermally treating conditions | |
|---|---|---|
| Fe-based cast product | Temperature T (° C.) | Time t (min) |
| Example 6 | 780 | 20 |
| Example 7 | 800 | |
| Example 8 | | 90 |
| Example 9 | 780 | |
| Example 10 | 750 | 60 |
| Example 11 | 780 | 10 |
| Example 12 | | 120 |
| Example 13 | 800 | 10 |
| Example 14 | | 120 |
| Example 15 | 1050 | 60 |

Figure 47A:
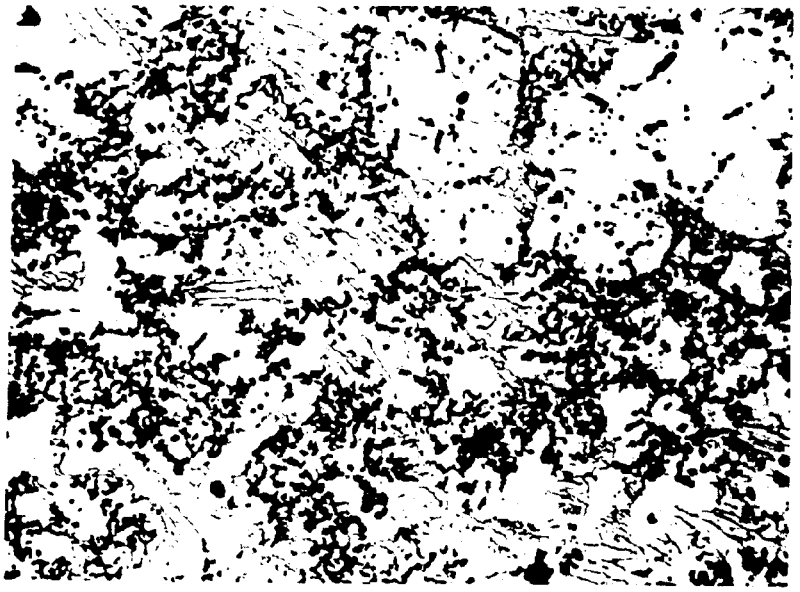
FIG. 47A is a photomicrograph of a texture of an example 1 (a thermally-treated product) of an Fe-based cast product.
Figure 47B:
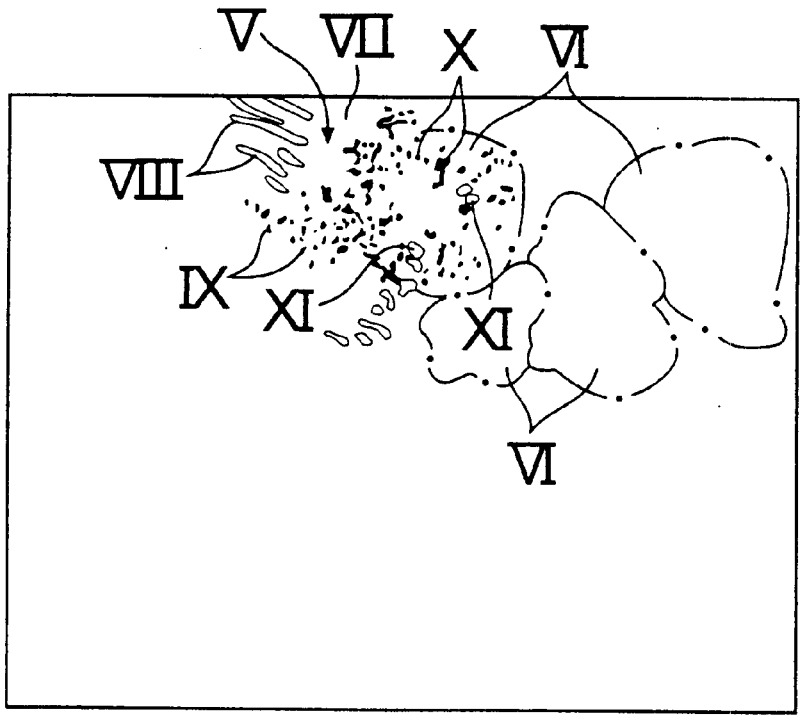
FIG. 47B is a tracing of an essential portion shown in FIG. 47A.

FIG. 47A is a photomicrograph of a texture of the example 1 (the thermally-treated product), and FIG. 47B is a tracing of an essential portion of the photomicrograph in FIG. 47A. In FIGS. 47A and 47B, a matrix V and a large number (definite four groups were selected in the illustrated embodiment) of massive groups VI of fine α-grains dispersed in the matrix V are observed. The matrix V is comprised of an α phase VII, and a large number of cementite phases VIII resulting from fine division of the meshed cementite phase II or the like. A large number of fine graphite phases IX and X are dispersed in the matrix V and in each of the groups VI of fine α-grains, respectively. A large number of cementite phases XI are also dispersed in each of the groups VI of fine α-grains.

As described above, the area rate A of graphite in the entire thermally-treated texture is represented by $A=\{(X+Y)/(V+W)\}\times 100$ (%), and the area rate B of graphite in all the groups of fine α-grains is represented by $B=(Y/W)\times 100$ (%) In the above equations, V is an area of the matrix; W is a sum of areas of all the groups of fine α-grains; X is a sum of areas of all the graphite phases in the matrix; and Y is a sum of areas of the graphite phases in all the groups of fine α-grains.

The ratio B/A of the area rates A and B for the examples 1 to 15 was determined, and the cutting test for the examples 1 to 15 using a bit was carried out to determine the maximum flank wear width $V_B$. Conditions for the cutting test were as follows: a cutting blade made by coating a carbide tip with TiN; a speed of 200 m/min; a feed of 0.15 to 0.3 mm/rev; a cutout of 1 mm; a cutting oil; and a water-soluble cutting oil.

Table 15 shows the ratio B/A of the area rates A and B and the maximum flank wear width $V_B$ for the examples 1 to 15.

TABLE 15

| Fe-based cast product | Ratio B/A | Maximum flank wear width $V_B$ (mm) |
|---|---|---|
| Example 1 | 0.138 | 0.125 |
| Example 2 | 0.240 | 0.120 |
| Example 3 | 0.195 | 0.120 |
| Example 4 | 0.240 | 0.120 |
| Example 5 | 0.138 | 0.125 |
| Example 6 | 0.500 | 0.120 |
| Example 7 | 0.138 | 0.125 |
| Example 8 | 0.140 | 0.123 |
| Example 9 | 0.230 | 0.120 |
| Example 10 | $1\times 10^{-6}$ | — |
| Example 11 | 0.029 | 0.215 |
| Example 12 | 0.078 | 0.18 |
| Example 13 | 0.029 | 0.215 |

TABLE 15-continued

| Fe-based cast product | Ratio B/A | Maximum flank wear width $V_B$ (mm) |
|---|---|---|
| Example 14 | 0.110 | 0.171 |
| Example 15 | 0.030 | 0.210 |

Figure 48:
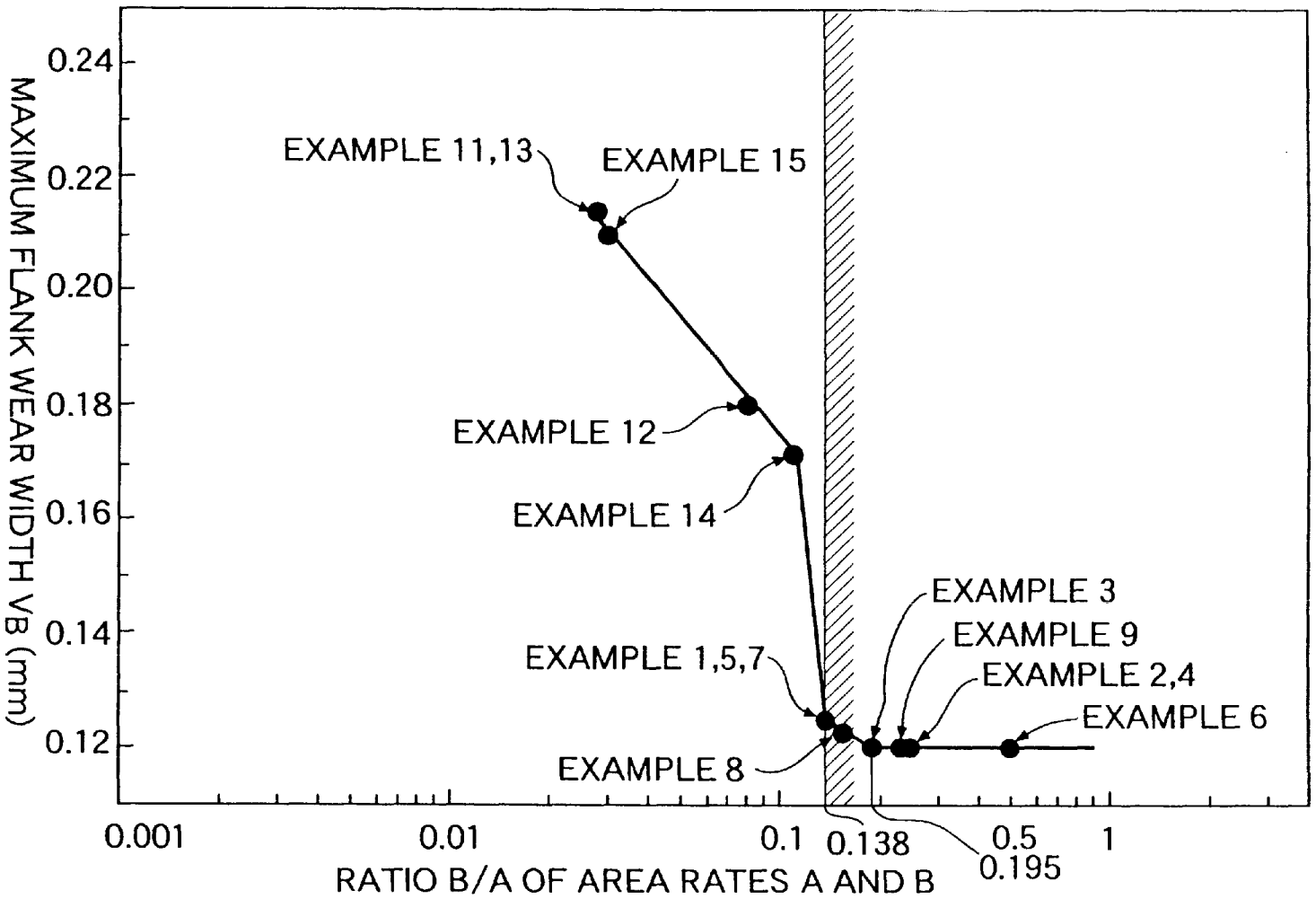
FIG. 48 is a graph illustrating the relationship between the ratio B/A of the area rate B to the area rate A and the maximum flank wear width $V_B$.

FIG. 48 is a graph taken based on Table 15 and illustrating the relationship between the ratio B/A of the area rates A and B and the maximum flank wear width $V_B$. As apparent from FIG. 48, it can be seen that the maximum flank wear width $V_B$ of the bit can be remarkably reduced by setting the ratio B/A of the area rates of A and B in a range of B/A≧0.138 as for the examples 1 to 9, and therefore, each of the examples 1 to 9 has a free-cutting property. When the ratio B/A is in a range of B/A≧0.2, the maximum flank wear width $V_B$ is substantially constant and hence, an upper limit of the ratio B/A is defined as B/A≈0.2.

Figure 49:
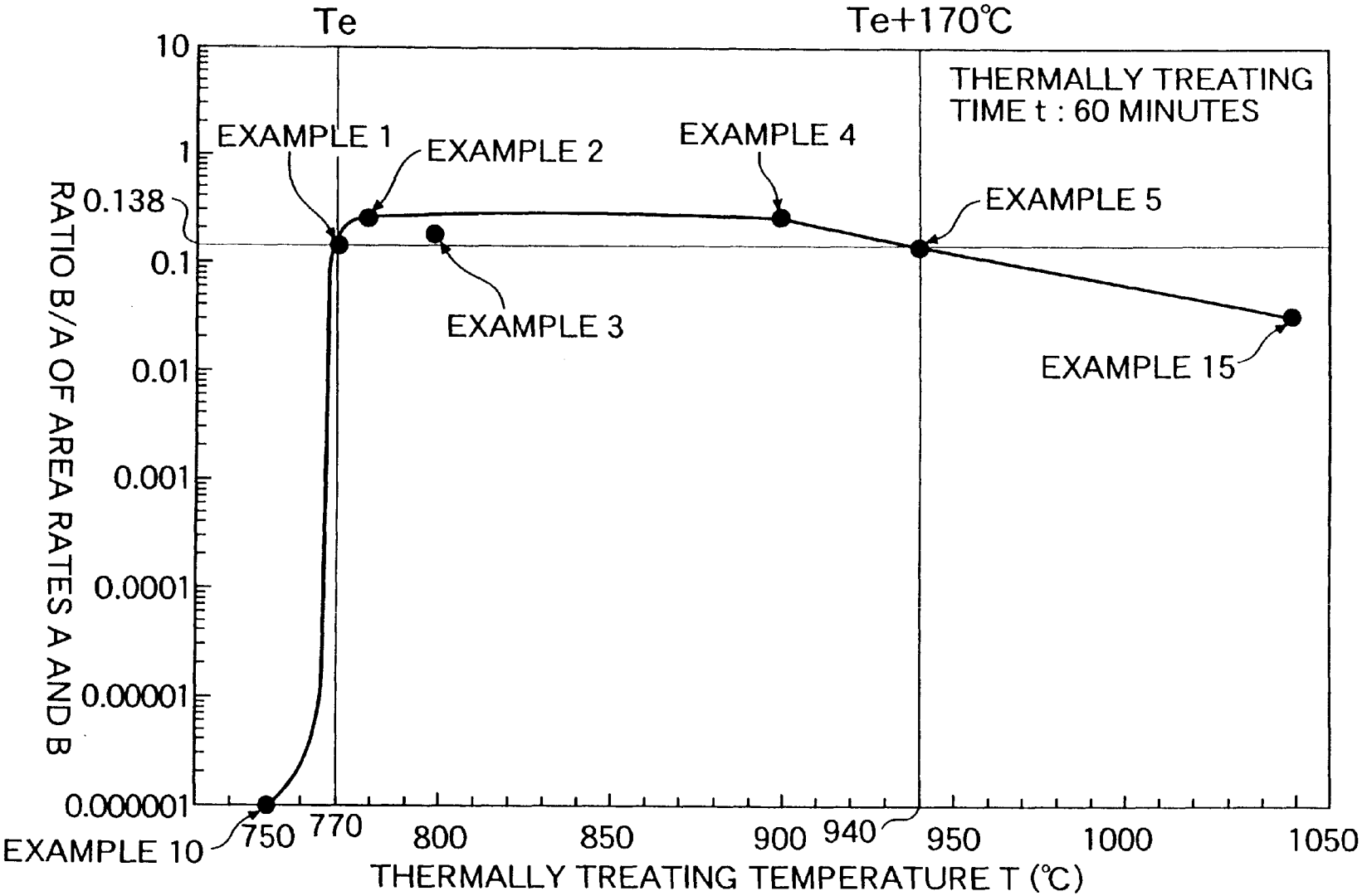
FIG. 49 is a graph illustrating the relationship between the thermally treating temperature T and the ratio B/A of the area rate B to the area rate A.

FIG. 49 is a graph illustrating the relationship between the thermally treating temperature T and the ratio B/A of the area rates A and B for the examples 1 to 5, 10 and 15 resulting from the thermal treatment with the thermally treating time t set at 60 minutes in Tables 14 and 15. As apparent from FIG. 49, if the thermally treating temperature T is set in a range of 770° C. (Te)≦T≦940° C. (Te+170° C.) with the thermally treating time t equal to 60 minutes as for the examples 1 to 5, the ratio B/A of the area rates A and B can be determined in a range of B/A≧0.138.

Figure 50:
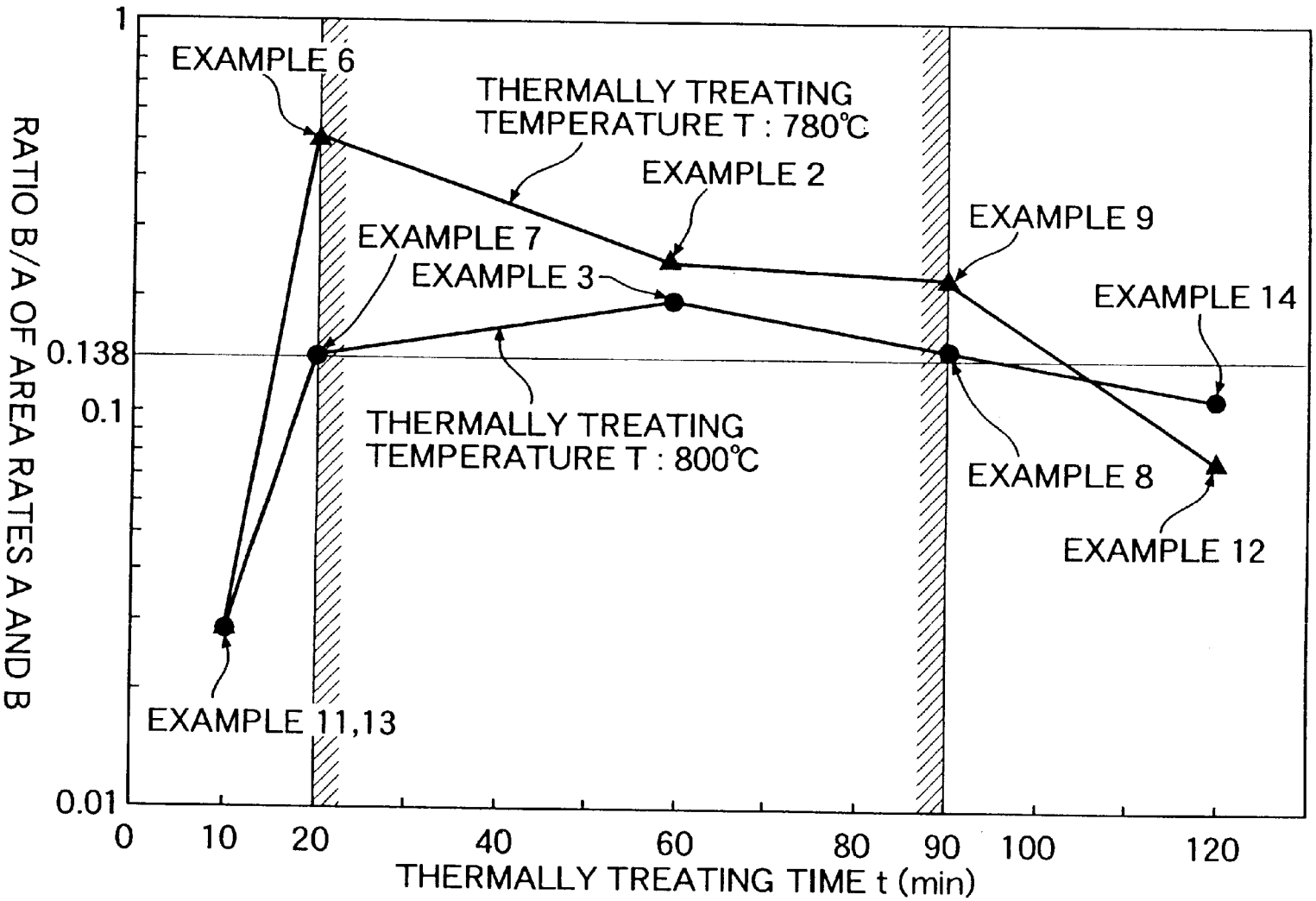
FIG. 50 is a graph illustrating the relationship between the thermally treating time t and the ratio B/A of the area rate B to the area rate A.

FIG. 50 is a graph illustrating the relationship between the thermally treating time t and the ratio B/A of the area rates A and B for the examples 2, 6, 9, 11 and 12 resulting from the thermal treatment with the thermally treating temperature T set at 780° C. and the examples 3, 7, 8, 13 and 14 resulting from the thermal treatment with the thermally treating temperature T set at 800° C. in Tables 14 and 15. As apparent from FIG. 50, if the thermally treating time t is set in a range of 20 minutes≦t≦90 minutes with the thermally treating temperature T equal to 780° C. as for the examples 2, 6 and 9 and with the thermally treating temperature T equal to 800° C. as for the examples 3, 7 and 8, the ratio B/A of the area rates A and B can be determined in a range of B/A≦0.138.

Then, the Young's modulus, the fatigue strength and the hardness were measured for the examples 1, 3, 4, 5 and 15. Table 16 shows results of the measurement. The area rate A of graphite in the entire thermally-treated texture of the example 1 and the like and the young's modulus of a forged-product of a steel as a comparative example are also shown in Table 16.

TABLE 16

| Fe-based cast product | Area rate A of graphite (%) | Young's modulus (GPa) | Tensile compression fatigue strength (MPa10e7P.5) | Hardness HB |
|---|---|---|---|---|
| Example 1 | 1.8 | 193 | 287 | 215 |
| Example 3 | 2.0 | 192.8 | 313 | 185 |
| Example 4 | 3.0 | 188.8 | 286 | 270 |
| Example 5 | 2.9 | 182.8 | 271 | 225 |
| Example 15 | 2.6 | 155 | 200 | 268 |
| Forged product (JIS S48C) | — | 202 | 200 | 185 |

As apparent from Table 16, it can be seen that each of the examples 1, 3, 4 and 5 has a Young's modulus near that of the forged product of the steel, a fatigue strength larger than that of the forged product, and a hardness equal to or higher than that of the forged product.

Figure 51:
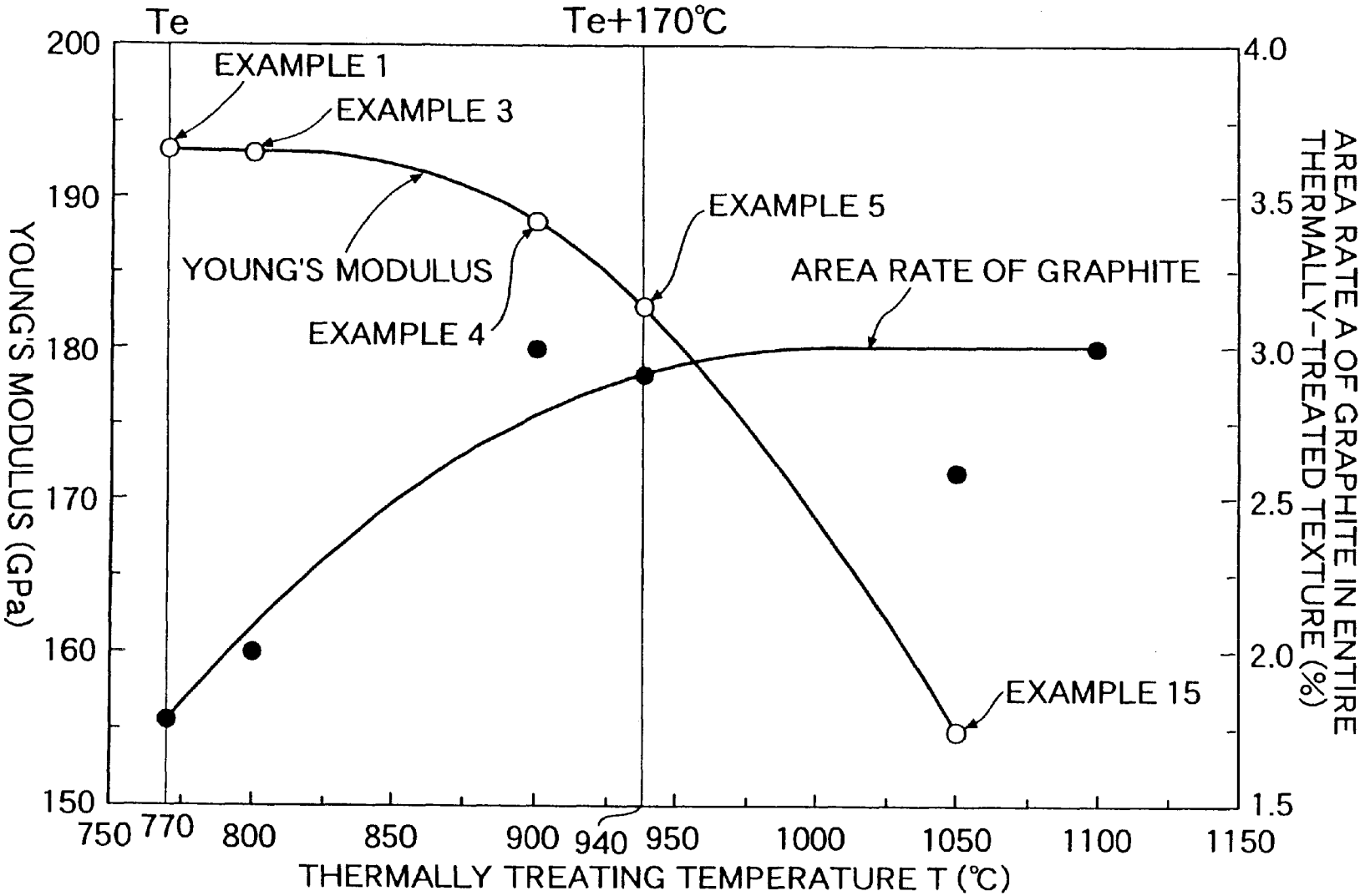
FIG. 51 is a graph illustrating the relationship between the thermally treating temperature T, the Young's modulus and the area rate A of graphite phases in the entire thermally-treated texture.

FIG. 51 is a graph based on Tables 14 and 16 and illustrating the relationship between the thermally treating temperature T and the Young's modulus as well as the area rate A of graphite in the entire thermally treated texture for the examples 1, 3, 4, 5 and 15. It can be seen from FIG. 51 that the area rate A of graphite is increased and the Young's modulus is decreased, with rising of the thermally treating temperature T.

In an Fe—C—Si-Mn based hypoeutectic alloy, C and Si are concerned with the eutectic crystal amount, and to control the eutectic crystal amount to 50% or lower, the content of C is set in a range of 1.8% by weight≦C≦2.5% by weight, and the content of Si is set in a range of 1.4% by weight≦Si≦3.0% by weight. However, if the content of C is lower than 1.8% by weight, the casting temperature must be risen even if the content of Si is increased to increase the eutectic crystal amount, resulting in a reduced advantage of the thixocasting. On the other hand, if C>2.5% by weight, the amount of graphite is increased. For this reason, the effect of the thermal treatment of the Fe-based cast product is less and therefore, it is impossible to enhance the mechanical properties of the Fe-based cast product. If the content of Si is lower than 1.4% by weight, the rising of the casting temperature is caused as in the case where C<1.8% by weight. On the other hand, if Si>3.0% by weight, silico-ferrite is produced and hence, it is impossible to enhance the mechanical properties of the Fe-based cast product.

Mn functions as a deoxidizing agent and is required for producing cementite phases. The content of Mn is set in a range of 0.3% by weight≦Mn≦1.3% by weight. However, if the content of Mn is lower than 0.3% by weight, the deoxidizing effect is less. For this reason, defects are liable to be produced due to inclusion of an oxide produced by oxidation of the molten metal or due to air bubbles. On the other hand, if Mn>1.3% by weight, the amount of cementite [$(FeMn)_3C$] crystallized is increased. For this reason, it is difficult to finely divide the increased amount of cementite by the thermal treatment, and the cutting property of the Fe-based cast product is reduced.

What is claimed is:

1. A thermally treated Fe-based cast product which is produced by thermally treating an Fe-based cast product made by utilizing a thixocasting process using a Fe-based hypoeutectic casting material as a casting material, said thermally treated Fe-based cast product including a matrix and a large number of massive groups of fine α-grains dispersed in the matrix, said thermally treated Fe-based cast product having a thermally-treated texture where a large number of graphite phases are dispersed in said matrix and in each of said groups of fine α-grains, and said thermally treated Fe-based cast product having a free-cutting property such that a ratio B/A of an area rate B of the graphite phases in all said groups of fine α-grains to an area rate A of the graphite phases in the entire thermally-treated texture is in a range of B/A≧0.138.

2. A thermally treated Fe-based cast product having a free-cutting property according to claim 1, wherein said thermally treated Fe-based cast product comprises 1.8% by weight≦C≦2.5% by weight of carbon, 1.4% by weight≦Si≦3.0% by weight of silicon, 0.3% by weight≦Mn≦1.3% by weight of manganese and a balance of Fe including inevitable impurities.

3. A thermally treated Fe-based cast product which is produced by thermally treating a Fe-based cast product made from a thixocasting process using a Fe-based hypoeutectic casting material as a casting material, said thermally treated Fe-based cast product having a thermally treated microstructure comprising a matrix and a large number of groups of fine α-grains dispersed in the matrix, wherein said matrix and each of said groups of fine α-grains include graphite phases dispersed therein such that a ratio B/A of an area rate B of the graphite phases in all said groups of fine α-grains to an area rate A of the graphite phases in the entire thermally-treated microstructure is in a range of $B/A \geqq 0.138$, said groups of fine α-grains are formed from the transformation of γ in portions of the Fe-based cast product that were formed from proeutectic γ, and said thermally treated Fe-based cast product having a Young's modulus greater than 180 GPa.

4. A thermally treated Fe-based cast product according to claim 3, wherein said thermally treated Fe-based cast product comprises carbon, silicon, manganese and a balance of Fe including inevitable impurities, and wherein the concentration of carbon, silicon, and manganese are set in the following ranges: 1.8% by weight $\leqq$ C $\leqq$ 2.5% by weight, 1.4% by weight $\leqq$ Si $\leqq$ 3.0% by weight, and 0.3% by weight $\leqq$ Mn $\leqq$ 1.3% by weight.

* * * * *